US007196683B2

(12) United States Patent
Yamamoto et al.

(10) Patent No.: US 7,196,683 B2
(45) Date of Patent: Mar. 27, 2007

(54) DRIVING METHOD OF IMAGE DISPLAY DEVICE, DRIVING DEVICE OF IMAGE DISPLAY DEVICE, AND IMAGE DISPLAY DEVICE

(75) Inventors: Tomohiko Yamamoto, Nara (JP); Hisashi Nagata, Nara (JP); Youji Yoshimura, Nara (JP); Noboru Noguchi, Tenri (JP); Hideki Ichioka, Nabari (JP); Koji Fujiwara, Tenri (JP); Naoto Inoue, Shiki-gun (JP); Keiichi Tanaka, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 851 days.

(21) Appl. No.: 09/832,232

(22) Filed: Apr. 10, 2001

(65) Prior Publication Data

US 2002/0008688 A1 Jan. 24, 2002

(30) Foreign Application Priority Data

| | | |
|---|---|---|
| Apr. 10, 2000 | (JP) | 2000-108542 |
| Sep. 22, 2000 | (JP) | 2000-288998 |
| Jan. 23, 2001 | (JP) | 2001-015122 |
| Mar. 13, 2001 | (JP) | 2001-071080 |

(51) Int. Cl.
*G09G 3/36* (2006.01)

(52) U.S. Cl. ..... 345/87; 345/204

(58) Field of Classification Search ..... 345/87, 345/89, 690–691, 204, 55, 208–209, 90, 345/92–96, 98, 101, 88, 91, 97, 99, 100
See application file for complete search history.

(56) References Cited

U.S. PATENT DOCUMENTS

| | | | | |
|---|---|---|---|---|
| 3,995,942 A * | 12/1976 | Kawakami et al. | 345/94 |
| 5,300,945 A * | 4/1994 | Iemoto et al. | 345/92 |
| 5,430,460 A * | 7/1995 | Takabatake et al. | 345/96 |
| 5,592,190 A * | 1/1997 | Okada et al. | 345/89 |
| 5,621,426 A * | 4/1997 | Okada et al. | 345/95 |
| 5,726,674 A * | 3/1998 | Greve | 345/94 |
| 5,754,154 A * | 5/1998 | Katakura et al. | 345/97 |
| 5,825,343 A * | 10/1998 | Moon | 345/94 |
| 5,847,687 A * | 12/1998 | Hirakata et al. | 345/96 |
| 5,874,933 A * | 2/1999 | Hirai et al. | 345/89 |
| 5,892,496 A * | 4/1999 | Wakeland | 345/694 |

(Continued)

FOREIGN PATENT DOCUMENTS

| | | |
|---|---|---|
| JP | 55-140889 | 11/1980 |
| JP | 63-015227 | 1/1988 |
| JP | 01-293322 | 11/1989 |
| JP | 03-010217 A | 1/1991 |
| JP | 03-062094 | 3/1991 |
| JP | 03-062094 A | 3/1991 |
| JP | 04-142592 | 5/1992 |

(Continued)

*Primary Examiner*—Richard Hjerpe
*Assistant Examiner*—Jean Lesperance
(74) *Attorney, Agent, or Firm*—David G. Conlin; William J. Daley, Jr.; Edwards Angell Palmer & Dodge LLP

(57) ABSTRACT

In an image display device which employs pulse width modulation driving, a voltage which is less than a voltage supplied to signal lines is applied to pixel electrodes. Tones are displayed by shifting phases of waveforms of the signal lines and scanning lines, and polarities of pixels in a signal line direction are inverted alternately. This prevents increase in power consumption which is caused by pulse intervals which become too small at high tone levels, in addition to preventing change in tone level due to external factors such as temperature, or signal delays in a driver or wiring.

12 Claims, 48 Drawing Sheets

U.S. PATENT DOCUMENTS

| | | | | |
|---|---|---|---|---|
| 5,926,162 | A * | 7/1999 | Wood et al. | 345/101 |
| 5,936,598 | A * | 8/1999 | Hayama et al. | 345/76 |
| 5,953,002 | A * | 9/1999 | Hirai et al. | 345/204 |
| 6,005,542 | A * | 12/1999 | Yoon | 345/92 |
| 6,037,920 | A * | 3/2000 | Mizutome et al. | 345/87 |
| 6,075,511 | A * | 6/2000 | Iwasaki et al. | 345/101 |
| 6,091,390 | A * | 7/2000 | Sim | 345/98 |
| 6,094,184 | A * | 7/2000 | Okamoto | 345/89 |
| 6,329,976 | B1 * | 12/2001 | Johnson et al. | 345/101 |
| 6,359,607 | B1 * | 3/2002 | Yanagi et al. | 345/94 |
| 6,424,328 | B1 * | 7/2002 | Ino et al. | 345/87 |
| 6,496,170 | B1 * | 12/2002 | Yoshida et al. | 345/87 |
| 6,504,521 | B1 * | 1/2003 | Inoue et al. | 345/89 |
| 6,577,295 | B2 * | 6/2003 | Kikkawa | 345/92 |
| 6,590,552 | B1 * | 7/2003 | Yokoyama et al. | 345/92 |
| 2003/0151573 | A1 * | 8/2003 | Yamaguchi et al. | |

FOREIGN PATENT DOCUMENTS

| | | |
|---|---|---|
| JP | 04-299388 A | 10/1992 |
| JP | 05-045623 | 2/1993 |
| JP | 05-289054 | 11/1993 |
| JP | 06-043493 | 2/1994 |
| JP | 06-138843 | 5/1994 |
| JP | 06-347753 | 12/1994 |
| JP | 07-253765 | 10/1995 |
| JP | 07-281641 | 10/1995 |
| JP | 07-306660 | 11/1995 |
| JP | 07-318903 | 12/1995 |
| JP | 07-318904 | 12/1995 |
| JP | 08-101670 | 4/1996 |
| JP | 08-137442 | 5/1996 |
| JP | 08-160393 | 6/1996 |
| JP | 08-248395 | 9/1996 |
| JP | 09-258698 | 10/1997 |
| JP | 09-274469 | 10/1997 |
| JP | 10-288769 | 10/1998 |
| JP | 10-301094 | 11/1998 |
| JP | 11-109929 | 4/1999 |
| JP | 11-326870 | 11/1999 |
| JP | 2000-132135 | 5/2000 |
| KR | 1999-0049879 | 7/1999 |

* cited by examiner

| REFERENCE VOLTAGE | UTILIZE CHARGING SIGNAL OUTPUT | UTILIZE DISCHARGING SIGNAL OUTPUT |
|---|---|---|
| low | low → high | high → low |
| high | high → low | low → high |

POSITIVE POLARITY

NEGATIVE POLARITY 1H (1 HORIZONTAL) PERIOD 1H (1 HORIZONTAL) PERIOD

T=Tr

T=Th(Th>Tr)

DRIVING METHOD OF IMAGE DISPLAY DEVICE, DRIVING DEVICE OF IMAGE DISPLAY DEVICE, AND IMAGE DISPLAY DEVICE

FIELD OF THE INVENTION

The present invention relates to a driving method of an image display device, a driving device of an image display device, and an image display device for displaying an image by controlling an applied voltage to pixel electrodes in a conduction period of pixel switching elements according to a pulse width which is supplied to signal lines.

BACKGROUND OF THE INVENTION

Conventionally, image display devices such as activematrix liquid crystal display devices have been widely used, as exemplified by liquid crystal display devices which employ thin-film transistors (TFTs) (TFT-LCD) as the pixel switching elements ("switching elements" hereinafter). In recent years, the liquid crystal display devices (LCD) have also been used in portable information terminals, portable phones, and the like.

The activematrix liquid crystal display device carries out display by a voltage modulation driving method in which, as shown in FIG. 59, a signal of a voltage according to image data is supplied to signal lines, and this voltage is then supplied to pixels which are selected by switching elements. Here, the switching elements are designed such that the voltage of the signal lines is sufficiently supplied to the pixel electrodes, i.e., a charging rate close to 100 percent (commonly, 99 percent or above) is attained. In this method, a required voltage is generated by an external circuit, and there is power consumption at a tone voltage generating section.

In display devices for which low power consumption is sought, such as portable information terminals and portable phones, this power loss adds up to a value which cannot be ignored. As a counter-measure, there has been proposed a method for carrying out tone display by supplying only an externally supplied reference voltage to the signal lines without the provision of the tone voltage generating section, and, as shown in FIG. 60, by controlling the charging rate according to a conduction period of the switching elements. Such a pulse width modulation driving method utilizing a two-value signal is disclosed, for example, in Japanese Unexamined Patent Publication No. 299388/1992 (Tokukaihei 4-299388) (published date. Oct. 22, 1992), Japanese Unexamined Patent Publication No. 140889/1980 (Tokukaisho 55-140889) (published date: Nov. 4, 1980), and Japanese Unexamined Patent Publication No. 62094/1991 (Tokukaihei 3-62094) (published date: Mar. 18, 1991).

The following describes the pulse width modulation driving (phase modulation driving). Unlike the driving method by voltage variance (voltage variance driving), the phase modulation driving employs modulation utilizing a pulse width to drive, for example, an activematrix liquid crystal display device which uses switching elements such as thin-film transistors (TFTs) or thin-film diodes. The switching elements have steep current-voltage characteristics and highly responsive, and thus accumulation of charge between the pixel electrodes and the counter electrode is rapid and the voltage between the electrodes increases at a high rate.

Therefore, the voltage applied between the pixel electrodes and the counter electrode varies according to a pulse width of a select voltage which was applied between a driving signal input terminal of the switching elements and the counter electrode. Thus, controlling the pulse width of the select voltage according to image data varies the applied voltage between the pixel electrodes and the counter electrode, thus controlling transmittance of pixels and carrying out tone display.

The following will explain the voltage variance driving and the phase modulation driving more specifically referring to drawings. FIG. 63 is a graph explaining a tone display mode by the voltage variance driving. As shown in FIG. 63, the voltage variance driving varies the level of an applied voltage to the liquid crystal according to image data so as to control transmittance of pixels and perform tone display.

This driving method by the voltage variance driving carries out tone display by varying the voltage value of a select voltage, and therefore requires a voltage signal as a driving signal in the same number as that of displayed tones. This necessitates a power circuit for outputting voltages of multi-levels as the number of displayed tones are increased, and the driving circuit is made complex as a result. Further, when the voltages of multi-levels are to be created from an input voltage, a step-up/step-down circuit, such as an operational amplifier, must be used to create pre-set voltages, which always accompanies a power loss. As a result, power consumption of the liquid crystal display device is increased.

The following will explain a tone display mode by the phase modulation driving. FIG. 64 is a graph explaining the tone display mode by the phase modulation driving. As shown in FIG. 64, the phase modulation driving carries out tone display by controlling the pulse width according to image data. That is, the power level applied to the liquid crystal is controlled by changing a pulse width, so as to perform tone display.

Unlike the voltage variance driving, the phase modulation driving employs the pulse width modulation mode, and thus allows a tone display only with voltages of two values without using the driving signal of multiple voltage levels as in the voltage variance driving. Performing tone display only with voltages of two values is very effective in reducing power consumption of the liquid crystal display device, because the voltage variance driving requires multiple voltage levels as described above. Further, creating pre-set voltages by the voltage variance driving results in power loss by the step-up/step-down circuit such as an operational amplifier.

On the other hand, in the phase modulation driving, the driving voltage in tone display only has two levels, and there is no power loss associated with step-up or step-down, thus driving the liquid crystal display panel at lower power consumption. Therefore, the liquid crystal display devices can be driven at lower power consumption with the phase modulation driving.

In practice, the pulse width modulation driving (phase modulation driving) is employed in liquid crystal display devices (MIM-LCD) which use an MIM element (metal-insulator-metal element), which is a two-terminal element, as the switching element. For example, Japanese Unexamined Patent Publication No. 326870/1999 (Tokukaihei 11-326870) (published date: Nov. 26, 1999) discloses a liquid crystal display device for portable information terminals, which employs the MIM element as the switching element. In the pulse width modulation driving method, a two-value voltage is outputted to the signal line, and there is no power consumption at the tone voltage generating section, and further, because a buffer is not required for each output with respect to the signal line, there is no constant current consumption at the tone voltage generating section and the buffer, thus having the advantage of lower power consumption over the voltage variance driving.

However, it is difficult by the foregoing conventional pulse width modulation driving to realize desirable multi-tone display while suppressing power consumption for the following reasons.

That is, as recited in the foregoing Tokukaihei 11-326870, it is not necessarily the case that a proportion of a conduction period of the switching element within one horizontal (1H) period should be set and allocated equally to each tone. This is explained in FIG. 61 and FIG. 62 which show a change in electrostatic capacitance. Here, FIG. 61 shows the case where a pixel is charged from 0 V to 5 V, and FIG. 62 shows the case where a pixel is charged from 0 V to −5 V.

The switching element is a thin-film transistor having a channel width and a channel length of 14 μm and 5 μm, respectively, and the pixel capacitance and the gate voltage are 0.5 pF and 10 V, respectively. As it can be expected from the standard equation of a delay circuit composed of a capacitor element and a resistance element, the voltage changes exponentially as a function of a charging time. Thus, a change in voltage of the pixel electrode is abrupt at the early stage and levels off (becomes gradual) as the voltage approaches the voltage of the signal line. The slope is about 0.5 V/μs in the vicinity of 2 V, which corresponds to a half-tone display of the liquid crystal display device, and if one is to have specifications capable of displaying 64 tones, controlling this would require a pulse width of about 60 ns. This is practically unachievable considering signal delays in wiring and non-uniform characteristics of the switching elements, and assuming that the signal line has a delay of, for example, 0.6 μs, the difference in slope between the input side and the non-input side of the signal line alone becomes equivalent of 10 tones. On the other hand, a change in voltage with respect to a charging time is small in the vicinity of the maximum level of charging which is required for a black display, and the allocated pulse width of one tone becomes about 12 μs at most, thus causing unbalance.

In order to actually realize the foregoing control, a very high frequency must be used for a reference clock which is used to generate a signal of a desired short pulse width within a signal line driver, and power consumption is increased as a result. That is, depending on the method of expressing tones, the frequency of the applied signal to the signal line is increased. Power consumption is generally proportional to frequency, and therefore, in the pulse width modulation driving method, the effect of lower power consumption is diminished as a whole by the increase in power consumption due to higher frequency, despite no power consumption at the tone voltage generating section and the buffer.

Further, the phase modulation driving has another problem that the display quality is easily changed by a change in ambient temperature of operation. One of the problems which is intrinsic to the liquid crystal display devices is that the display shows change with respect to ambient temperature of operation. This is likely to be caused by ① temperature characteristics (dielectric constant, retention, etc.) of a liquid crystal material, and ② temperature characteristics of the switching elements.

The behavior of a display change due to the liquid crystal material according to factor ① is basically the same in the voltage variance driving and the phase modulation driving. However, the behavior of the liquid crystal display device with respect to change in temperature characteristics of the switching elements according to factor ② differs greatly between the voltage variance driving and the phase modulation driving. The following will explain the reasons for this based on an example using the thin-film transistor (TFT) elements as the switching elements.

FIG. 65 is an equivalent circuit diagram per pixel of a liquid crystal display panel having the TFT elements. In the liquid crystal display panel having the TFT elements, the TFT elements are disposed at the intersections of the signal lines and the scanning lines, wherein the gate, source, and drain of a TFT element are connected to a scanning line, a signal line, and a liquid crystal capacitance, respectively. In this liquid crystal display panel, when the gate electrode becomes selected, the transistor is conducted and a video signal of the signal line is applied to the liquid crystal capacitance. When the gate electrode becomes non-selected, the transistor takes high impedance to prevent the video signal of the signal line from leaking into the liquid crystal capacitance.

FIG. 66 is a graph showing temperature dependance of Vg-√Id characteristics (Vg indicates a voltage applied to the gate electrode of the TFT element, and Id indicates a drain current) of a TFT (a-Si). It can be seen from the temperature characteristics in FIG. 66 that the drain current flown into the TFT increases with increase in temperature. The increased flow of the drain current means an increased current flow into the liquid crystal. This results in abrupt increase in drain voltage with respect to an input signal.

In view of the foregoing, the following considers the voltage variance driving and the phase modulation driving when there is a temperature change. First, the voltage variance driving is examined. FIG. 67(*a*) is a graph showing a tone signal (half-tone display) at temperature T=Tr (room temperature). In FIG. 67(*a*) the signal indicated by rectangular wave 1 is an input signal, and the signal indicated by curve 2 is a drain voltage. Here, it is assumed in the half-tone display that the set voltage Va is reached within a pre-set time period (application time: 1 H).

FIG. 67(*b*) is a graph showing a tone signal (half-tone display) when temperature T=Th (Th>Tr). FIG. 67(*b*) shows the case where T=Th by increasing the temperature from FIG. 55(*a*). It can be seen from FIG. 67(*a*) and FIG. 67(*b*) that the drain current flown into the TFT increases with increase in temperature and the drain voltage increases abruptly with respect to the input signal.

However, even though the drain voltage rises abruptly with increase in temperature, the change of this degree will not change the behavior of the voltage reaching the set voltage Va within a pre-set time period (application time: 1 H). As a result, the applied voltage to the pixel will not be changed by temperature, and there will be no change in tone display due to the temperature characteristics of the TFT. Evidently, however, the display does show a change in the voltage variance driving, when the characteristics of the TFT elements are changed by a larger temperature change.

The following considers the case of the phase modulation driving. FIG. 68(*a*) is a graph showing a tone signal (half-tone display) when temperature T=Tr. In FIG. 68(*a*), the signal indicated by a rectangular wave 1 is an input signal, and the signal indicated by a curve 2 is a drain voltage. Here, it is assumed in the half-tone display that the set voltage Vc is reached within a pre-set time period (application time: 1 H).

FIG. 68(*b*) is a graph showing a tone signal (half-tone display) when temperature T=Th (Th>Tr). FIG. 68(*b*) shows the case where T=Th by increasing the temperature from FIG. 68(*a*). The drain current flown into the TFT increases with increase in temperature, and the drain voltage with respect to the input signal increases abruptly. As a result, in response to this change in drain voltage, the set voltage Vc of the half-tone display is shifted higher than the case where T=Tr. As a result, when the temperature is increased, a voltage Vc', which is increased by ΔV from a normal level, is applied, changing the tone display.

That is, the phase modulation driving employs the pulse width modulation mode, and thus the way a rise of the drain voltage is changed directly affects the tone display.

As a counter-measure for preventing display change due to a change in panel temperature in the liquid crystal display device, for example, Japanese Unexamined Patent Publication No. 10217/1991 (Tokukaihei 3-10217) (published date: Jan. 17, 1991) discloses a method of temperature compensation by changing a pulse width of a voltage applied to the signal electrodes according to temperature. However, the control in this conventional technique is very complex since it requires controlling a pulse signal according to tones.

Further, Japanese Unexamined Patent Publication No. 301094/1998 (Tokukaihei 10-301094) (published date: Nov. 13, 1998) discloses a method of preventing non-uniform image display in a transmissive liquid crystal display device by compensating for a change in threshold value of liquid crystal due to temperature distribution of a back light, according to a change in voltage of a scanning signal. However, this conventional technique only teaches compensating for a change in threshold value of liquid crystal in the transmissive liquid crystal display device, and is totally silent as to compensation with respect to the reflective liquid crystal display device, phase modulation driving, and switching element (TFT) characteristics.

SUMMARY OF THE INVENTION

It is a first object of the present invention to provide a driving method of an image display device for realizing a desirable multi-tone display while suppressing increase in power consumption in image display devices which employ pulse width modulation driving.

It is a second object of the present invention to provide an image display device which can obtain a desirable display quality at any temperature in a working temperature range in image display devices which employ activematrix driving, by preventing a display change due to temperature change of a panel using a voltage varying circuit which carries out temperature compensation for bringing lower power consumption.

In order to achieve the first object, a driving method of an image display device in accordance with the present invention is for an image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, the method controlling a voltage applied to the pixel electrodes in a conduction period of the pixel switching elements according to a pulse width supplied to the signal lines, wherein the voltage applied to the pixel electrodes is less than a voltage supplied to the signal lines.

With this method, the voltage which is applied to the pixel electrodes is less than the voltage supplied to the signal lines. For example, the foregoing arrangement may be adapted so that the maximum value of the voltage applied to the pixel electrodes is not less than 80 percent and not more than 98 percent of an amplitude of the voltage supplied to the signal lines. This means, in the example as shown in FIG. 61, utilizing a charging curve in an area from the charging time 0 μs to 12 μs (corresponds to 80 percent), or to 30 μs (corresponds to 98 percent).

Thus, the required intervals of a pulse do not become too small even at high tone levels. As a result, it is possible to prevent change in tone level due to external factors such as temperature, or signal delays and the like in a driver or wiring. Further, it is possible to adopt a lower frequency for a reference clock which is required to create a signal of a predetermined pulse width within a signal line driver, thus suppressing increase in power consumption.

As a result, it is possible to realize a desirable multi-tone display while suppressing increase in power consumption in a multi-tone image display device which employs pulse width modulation driving.

Further, a driving method of an image display device of the present invention applies a voltage between a potential of signal lines and a potential of a common electrode when a potential of scanning lines is ON, and displays tones by modulating a pulse width of a two-value voltage supplied to the signal lines, wherein tones are displayed by shifting phases of waveforms of the signal lines and the scanning lines, and polarities of pixels in a signal line direction are inverted alternately. For example, the image display device may be a TFT-LCD, i.e., a liquid crystal display device of the TFT (thin film transistor) mode. Note that, the common electrode (counter electrode) may have a potential, which is a direct current or an alternating current (two values).

In general, the pulse width modulation driving method accompanies increased frequency of the signal lines depending on how tones are expressed, even though the power consumption in creating tones and in buffering is eliminated by the two-value output of the signal lines (FIG. 60), which undermines the effect of lower power consumption as a whole because power consumption is proportional to frequency.

In contrast, with the arrangement of the present invention, tones are displayed by shifting phases of waveforms of the signal lines and the scanning lines, and polarities of pixels in a signal line direction are inverted alternately. Thus, any tone can be expressed without increasing the frequency of the signal line. As a result, it is possible to realize a desirable multi-tone display while suppressing increase in power consumption in a multi-tone image display device which employs the pulse width modulation driving.

The foregoing tokukaihei 3-62094 discloses a technique of pulse width modulation driving for an activematrix liquid crystal display device. This pulse width modulation driving creates a data signal of a pulse width having the same active period as that of the scanning signal, or a data signal of a pulse width having the same inactive period as that of the scanning signal. In this method, the polarity of the signal line is inverted twice, one at a rise or fall of the scanning signal in one horizontal period, and one in a period of setting a tone. In contrast, according to the method of the present invention which displays tones by modulating a pulse width of a two-value voltage supplied to the signal lines in an image display device such as the TFT-LCD, tones are displayed by shifting the waveform phases of the signal lines and the scanning lines, and the polarities of pixels in a signal line direction are inverted alternately, thus suppressing increase in power consumption without increasing the frequency of the signal line signal (source signal). The driving for alternately inverting polarities of pixels in a signal line direction may be one horizontal period inversion driving or dot inversion driving.

Further, a driving method of an image display device of the present invention applies a voltage between a potential of signal lines and a potential of common electrode when a potential of scanning lines is ON, and displays tones by modulating a pulse width of a two-value voltage supplied to the signal lines, wherein tones are displayed by shifting phases of waveforms of the signal lines and the common electrode, and polarities of pixels in a signal line direction are inverted alternately.

According to this arrangement, tones are displayed by shifting phases of waveforms of the signal lines and the common electrode, and the polarities of pixels in a signal line direction are inverted alternately. Thus, any tone can be expressed without increasing the frequency of the signal line. As a result, it is possible to realize a desirable multi-tone display while suppressing increase in power consumption in a multi-tone image display device which employs the pulse width modulation driving.

The foregoing arrangement is applicable to the case where the scanning signal is a constant pulse signal with respect to the period of one horizontal period, or to the case where the scanning signal is not a constant pulse signal with respect to the period of one horizontal period.

Further, a driving method of an image display device of the present invention displays tones by modulating a pulse width of a two-value voltage supplied to the signal lines, wherein the amplitude of the scanning lines is varied between positive application and negative application. Such an image display device may be, for example, a TFT-LCD.

In general, in the pulse width modulation driving on the TFT-LCD, tones are expressed by stopping charging pixels during charging. Therefore, in order to improve reproduciability of tones, the initial state of applying an ON resistance to the transistor needs to be the same in every case. However, since the TFT is a three-terminal element, the resistance is changed by a relation of element potentials.

In view of this drawback, according to the foregoing arrangement of the present invention, the amplitude of the scanning line is varied between positive application and negative application. Thus, a difference in application ability can be made smaller between positive application and negative application. As a result, the initial state of applying an ON resistance to the transistor can be made the same in every case, even when the three-terminal element, the TFT, is used, thereby realizing a desirable multi-tone display while suppressing increase in power consumption in a multi-tone image display device which employs the pulse width modulation driving.

Further, a driving method of an image display device of the present invention displays tones by modulating a pulse width of a two-value voltage supplied to the signal lines, wherein a resistance of a transistor for switching ON or OFF signal application from the signal lines to the pixels is increased with time from the beginning to the end of an application time of a single pixel. Such a image display device may be, for example, the TFT-LCD.

In general, the pulse width modulation driving method expresses tones by stopping charging pixels during charging; however, the resistance of a transistor which is designed for the conventional voltage modulation driving method is too low for the pulse width modulation driving method, and since high time resolution is required to display tones on the low voltage side, expression of tones is made difficult.

In contrast, according to the foregoing arrangement of the present invention, a resistance of a transistor for switching ON or OFF signal application from the signal lines to the pixels is increased with time from the beginning to the end of an application time of a single pixel. Thus, less accuracy is required for the time resolution which is required in half-tone expression of the pulse width modulation driving method. As a result, it becomes easier to express tones on the low voltage side, thus realizing a desirable multi-tone display while suppressing increase in power consumption in a multi-tone image display device which employs the pulse width modulation driving.

In order to achieve the second object, an image display device in accordance with the present invention is an active-matrix-driven image display device having an image display panel for displaying an image by switching by a plurality of active elements, wherein the image display device includes a voltage varying circuit for varying a voltage of a signal for driving the active elements according to temperature change of the image display panel, so as to carry out temperature compensation of the active elements.

According to this arrangement, the image display device includes a voltage varying circuit for varying a voltage of a signal for driving the active elements according to temperature change of the image display panel, so as to carry out temperature compensation of the active elements, thus compensating a change in temperature characteristics of the active elements and obtaining a desirable display quality at any temperature in a working temperature range.

For a fuller understanding of the nature and advantages of the invention, reference should be made to the ensuing detailed description taken in conjunction with the accompanying drawings.

DESCRIPTION OF THE EMBODIMENTS

[First Embodiment]

The following will describe one embodiment of the present invention with reference to FIG. 1 through FIG. 17. An image display device which is driven by a driving method in accordance with the present embodiment displays an image by controlling an applied voltage to pixel electrodes in a conduction period of pixel switching elements (simply "switching elements" hereinafter) according to a pulse width which is supplied to signal lines. Such a driving method has widely been used in flat panel displays and the like, for example, such as liquid crystal display devices and EL (electroluminescence) display devices.

Figure 61:
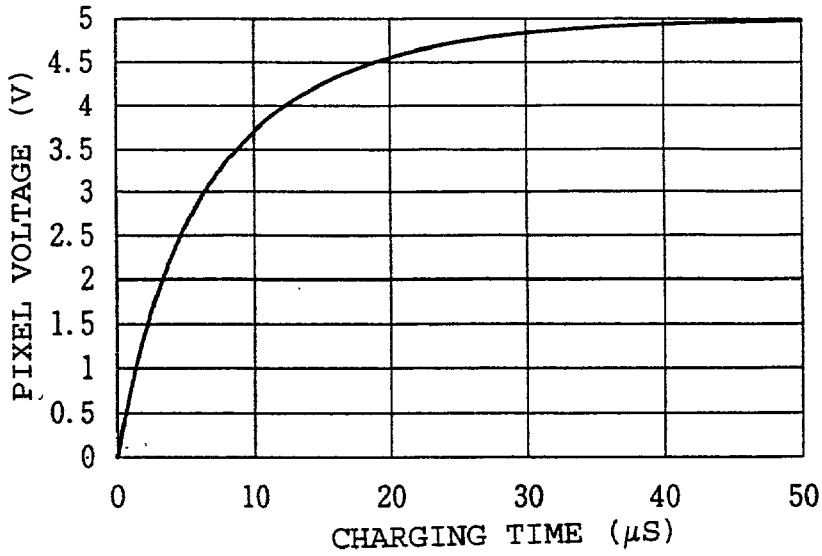
FIG. 61 is a graph showing a state of pixel voltage in conventional driving.

As shown in FIG. 61, in order to bring a pixel voltage sufficiently to 5 V, which is the supplied voltage to a signal line, it was required conventionally to reduce the time constant of a circuit composed of an electrostatic capacitance of a pixel and an ON resistance of a switching element. In contrast, in the present embodiment, the voltage on the plus side of the signal line is set to 6.5 V, instead of the desired level 5 V, to perform AC driving with the two voltage levels +6.5 V and −5 V. As a result, it is not required to obtain near 100 percent charging, and the time constant of the pixel can be increased, thus having a gradual change in pixel voltage with respect to a charging time.

Figure 1:
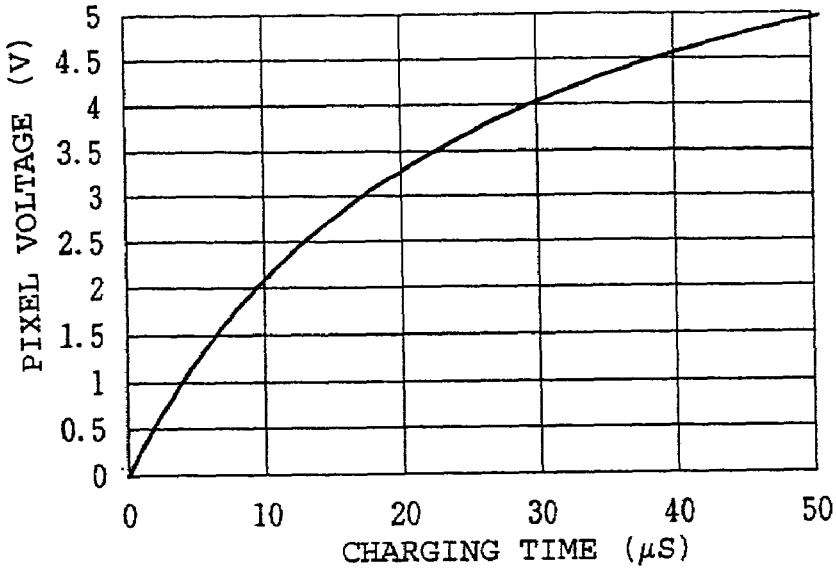
FIG. 1 is a graph showing a state of pixel voltage by driving according to the present invention.
Figure 2:
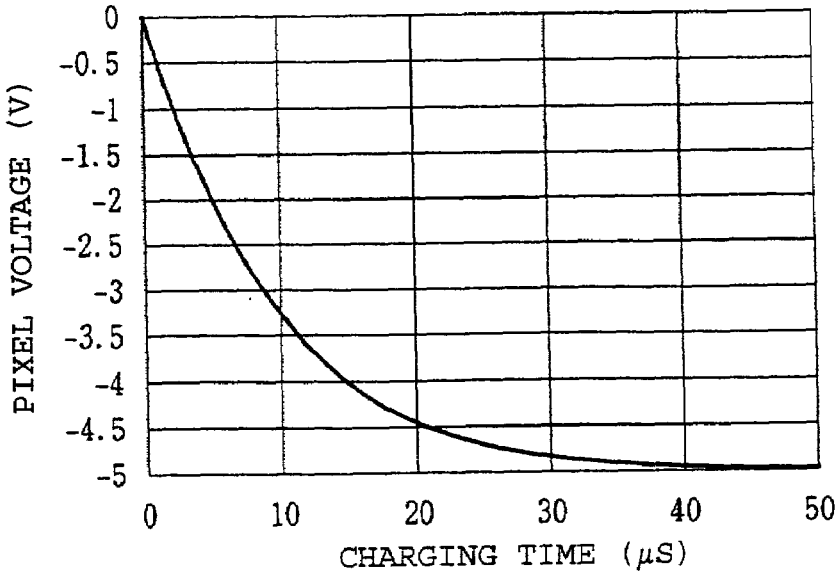
FIG. 2 is a graph showing a state of pixel voltage by driving in according to the present invention.
Figure 7:
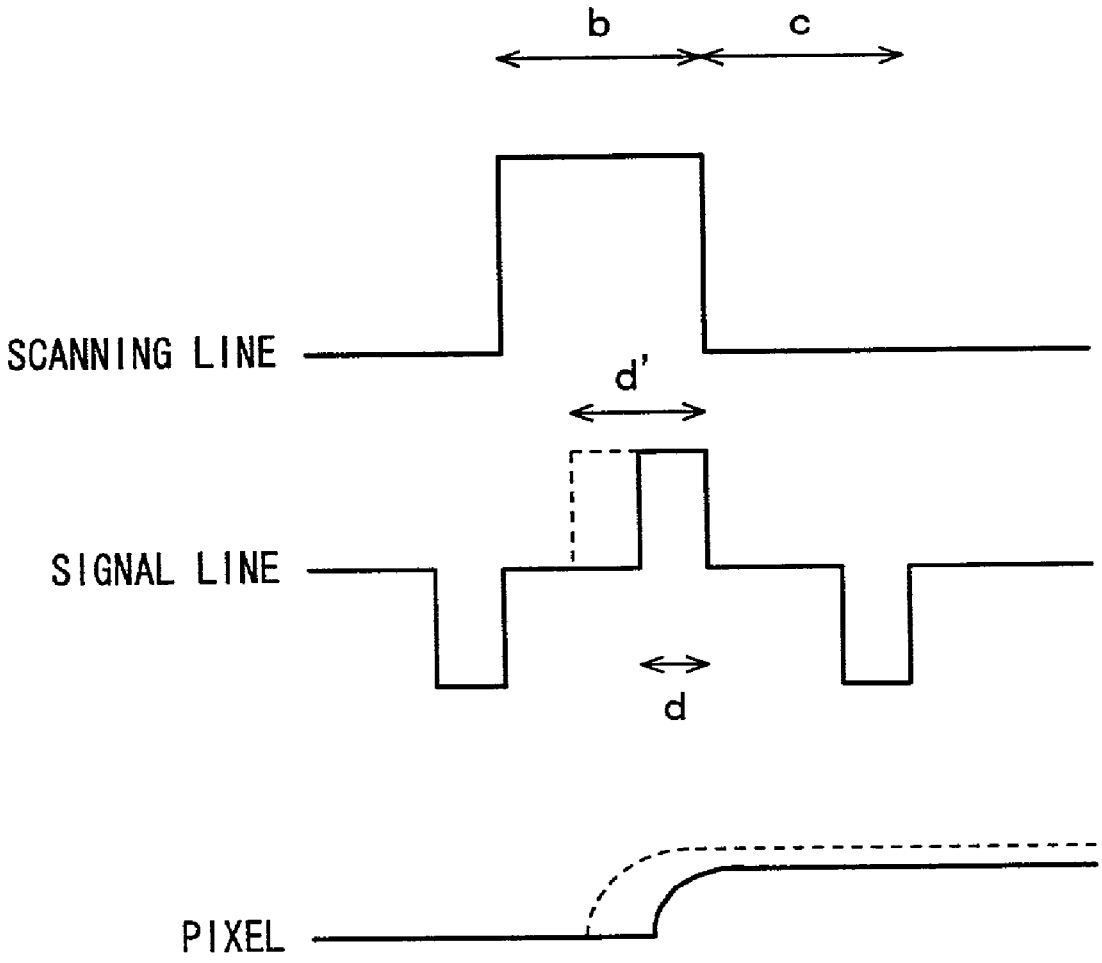
FIG. 7 is a timing chart showing driving signals of the present invention.

FIG. 1 and FIG. 2 show charging characteristics when the time constant is increased using a transistor having a channel width of 7 μm and a channel length of 6 μm and a pixel capacitance of 0.7 pF. Note that, a gate voltage is set at 10 V. FIG. 1 shows the case where the pixel is charged from 0 V to 5 V, and FIG. 2 shows the case where the pixel is charged from 0 V to −5 V. Further, FIG. 7 shows voltages of respective signals on a scanning line, a signal line, and a pixel, when driving a certain pixel. In FIG. 7, the horizontal axis indicates time and the vertical axis indicates voltage. Further, indicated in FIG. 7 by "b" and "c" are one horizontal period, and a period "d" corresponds to a charging time. Here, the voltages on the signal line and the pixel change as indicated by the solid lines.

Figure 62:
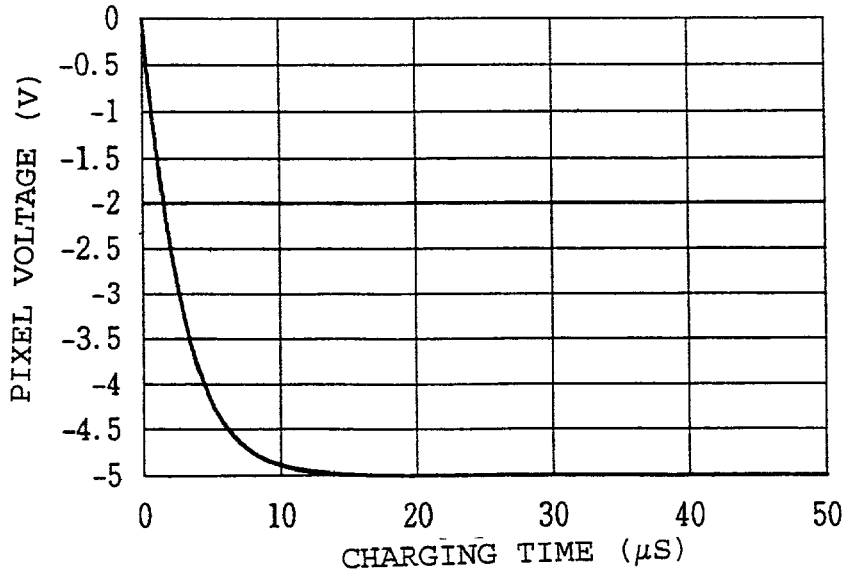
FIG. 62 is a graph showing a state of pixel voltage in conventional driving.
Figure 63:
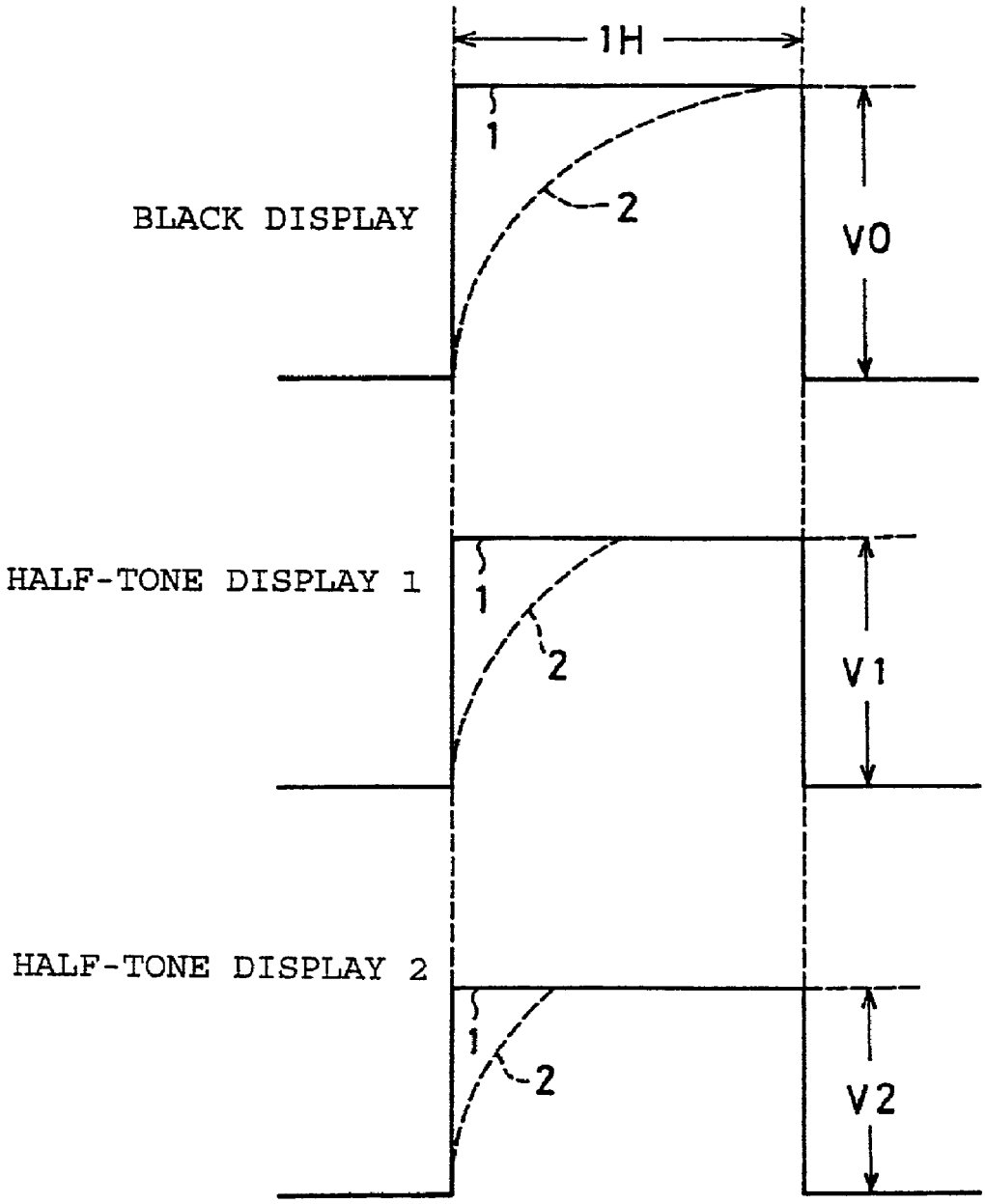
FIG. 63 is a graph explaining a tone display system in voltage variance driving.
Figure 64:
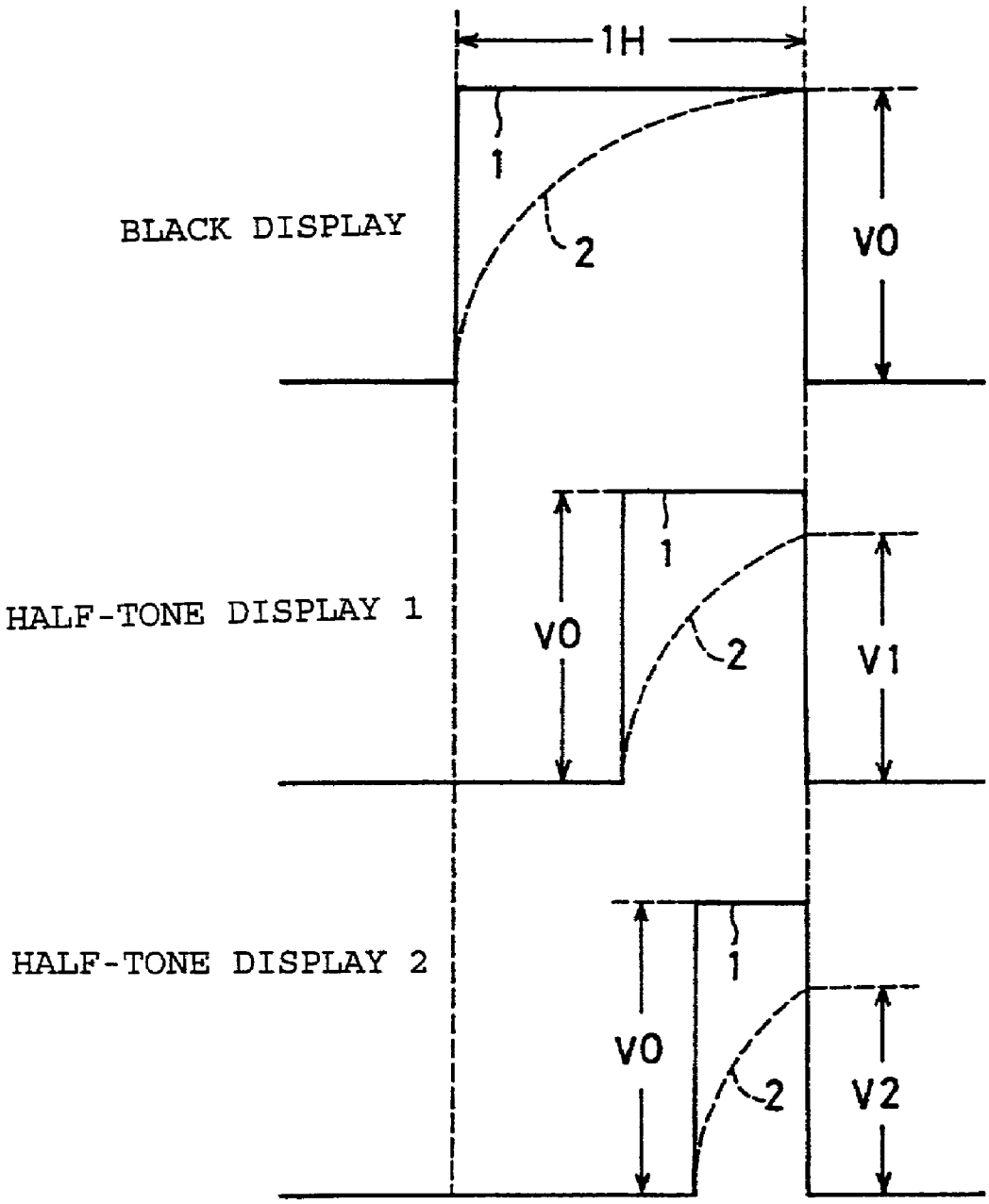
FIG. 64 is a graph explaining a tone display system in phase modulation driving.
Figure 65:
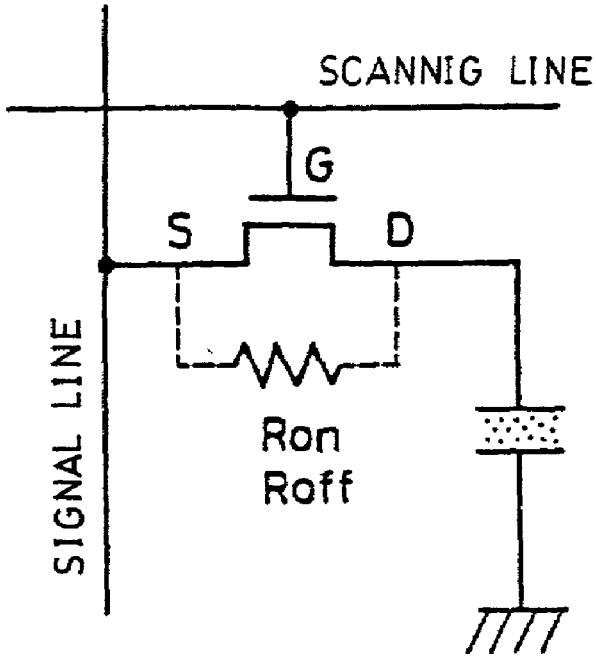
FIG. 65 is an equivalent circuit diagram per pixel of a liquid crystal display panel having a TFT element.

Comparing FIG. 62 and FIG. 2 which show charging characteristics of the negative application, FIG. 62 has a slope of about 1 V/μs in the vicinity of 2 V which corresponds to a half-tone display. In this case, if one is to have specifications capable of displaying 64 tones, controlling this would require a pulse width of 30 ns. On the other hand, in FIG. 2, which relates to a driving method of the present embodiment, the slope is about 0.25 V/μs in the vicinity of 2 V which corresponds to a half-tone display. In this case, the specifications capable of displaying 64 tones are controlled with a pulse width of 120 ns.

In this manner, the time constant of a pixel can be increased by increasing the supplied voltage to the signal line on the positive application, which process takes more time for charging, larger than the required voltage for the pixel. As a result, the charging characteristics can be made gradual both in the positive and negative directions and a width of time control in tone display can be increased, thus obtaining a stable display state. Namely, it is possible to provide an image display device with improved stability with respect to signal delays or non-uniformity in transistor characteristics.

Further, it is also possible to employ a lower frequency for a reference clock which is required to generate a signal of a desired pulse width in a signal line driver, thus suppressing power consumption.

Here, the applied voltage to the signal line has the peak-to-peak voltage of 11.5 V between the positive side and the negative side, whereas the voltage supplied to the pixel electrodes is 10 V. That is, 87 percent (10/11.5=87 percent) of the voltage applied to the signal line is supplied to the pixel electrodes. Generally, drivers used for the signal lines of activematrix liquid crystal display devices, in particular the ones which can also be used for dot inversion, have the maximum peak-to-peak voltage of about 12 V, and a larger voltage would require a special driver which can withstand a high voltage. Meanwhile, the maximum voltage to be applied to the liquid crystal is 10 V (5 V each on the positive side and the negative side). Therefore, in order to obtain a voltage which is required to drive the liquid crystal within a range of the maximum voltage of the driver, it is practical in terms of cost to set the charging rate at 80 percent or greater.

As is clear from FIG. 1, the curve is almost linear already, and the benefit of having further linearity will be insignificant even when a range which corresponds to a charging rate lower than 80 percent is utilized. On the contrary, below 80 percent, a voltage at least 1.25 times (1/0.8=1.25) the voltage actually required to drive the liquid crystal is supplied to the signal line, and power consumption, which is proportional to the square of the voltage, is increased by 1.5 times or greater, resulting in adverse poor efficiency.

On the other hand, as clearly indicated by the area above 30 μs, inclusive, in FIG. 61, at the charging rate exceeding 98 percent (past 4.8 V of the positive application when adjusting only on the positive side as in the present embodiment with respect to the signal line amplitude of 10 V), essentially, there is no increase in pixel voltage as a function of the charging time, despite that this area occupies 40 percent or greater of the total charging time. Furthermore, in this area, there is no substantial increase in transmittance of the liquid crystal with increase in pixel voltage, which necessitates the charging time to be changed by 10 μs or greater just to change the tone by one scale, making the area very inefficient. Therefore, it is meaningful to omit the area where the charging rate is small in order to obtain linear charging characteristics.

As described, with the driving method of the present embodiment, the maximum amplitude value of the voltage applied to the pixel electrodes can be set within a range of not less than 80 percent and not more than 98 percent of the amplitude of the supplied voltage to the signal line. This means, taking the example of FIG. 61, utilizing the charging curve in a range of the charging time from 0 μs to 12 μs (equivalent to 80 percent) or to 30 μs (equivalent to 98 percent).

Note that, to be exact, the foregoing charging rate does not indicate a charging rate which starts from the origin at 0 V, but rather indicates a charging rate from a pixel potential before charging to a signal line potential being charged, such as from the negative side to the positive side, and vice versa. Therefore, "the charging rate of 98 percent (reaching 4.8 V in the positive application when adjusting only on the positive side)" indicates a state of voltage application from −5V to +4.8 V, i.e., a change in pixel potential of 9.8 V with respect to the signal line amplitude of 10 V. Thus, strictly speaking, FIG. 61 and FIG. 62 cannot be used to accurately describe this phenomenon. Nevertheless, in the area of charging up to 0 V from a voltage of the positive polarity or negative polarity, the curve of charging characteristics is more steep than that at 0 μs in FIG. 61 and FIG. 62, and, even when this section of the curve is taken into consideration, the curve only differs for a period of several μs, at most, up to 0 V. Therefore, one still sees the phenomenon in which the pixel voltage hardly changes as a function of a charging time in the area of the charging rate 98 percent or greater.

Accordingly, charging can be described based on FIG. 61 and FIG. 62 which show charging from 0 V. Further, the pixel potential immediately before normal application with respect to a signal line potential (corresponds to "d" in FIG. 7) becomes different depending on a proportion of a duration of the normal application in one horizontal period (period "d" subtracted from period "b"), and thus the pixel potential takes various patterns depending on the mode of driving, which makes it difficult to make generalizations. Therefore, explanations here are based on the charging curve from 0 V, which is the simplest form of charging characteristics, to help understand the concept of the present invention. The driving modes will be described in more detail later with reference to FIG. 12 and FIG. 13.

Incidentally, since the switching elements are realized by transistors of three-terminal elements, as discussed, the characteristics of the switching elements vary depending on the polarity of the signal line. Therefore, in order to obtain the pixel voltage of 2 V on the both polarities to display, for example, a half-tone image, it is required to set a different charging time for the positive polarity and the negative polarity. That is, as shown in FIG. 7, with respect to the charging time "d" on the positive polarity, the charging time "d'" is set for the negative polarity as indicated by the broken line.

Further, the transistor of the three-terminal element making up the switching elements is drawn toward the negative side by the parasitic capacitance between a gate and a drain when the scanning line is switched from ON to OFF. Thus, the DC (direct current) level of the pixel potential is balanced toward the negative side, and the extent of this "pull" is in accordance with the proportion of the parasitic capacitance in the total pixel capacitance. Thus, in the liquid crystal panel in which the electrostatic capacitance of the liquid crystal is different for each tone, the DC level of the pixel potential becomes also different for each tone. As a counter-measure, in a tone display by the conventional voltage application, the signal supply to the signal line may be offset in advance by the estimated extent of the pull. In the present embodiment, the offset is also controlled by the duration of the charging time in the described manner. That is, a different charging time is set for the positive polarity and the negative polarity, and, with respect to the charging time "d", the charging time "d'" is set for the negative polarity in the described manner as indicated by the broken line as shown in FIG. 7.

The following describes another example. As mentioned earlier, the characteristics of the switching element become different depending on the polarity of the signal line. That is, as shown in FIG. 1 and FIG. 2, the characteristics are relatively linear in the positive application (FIG. 1), whereas the area where the changing rate of the pixel voltage is high is concentrated in a short time period of the charging time in the negative application (FIG. 2).

Figure 3:
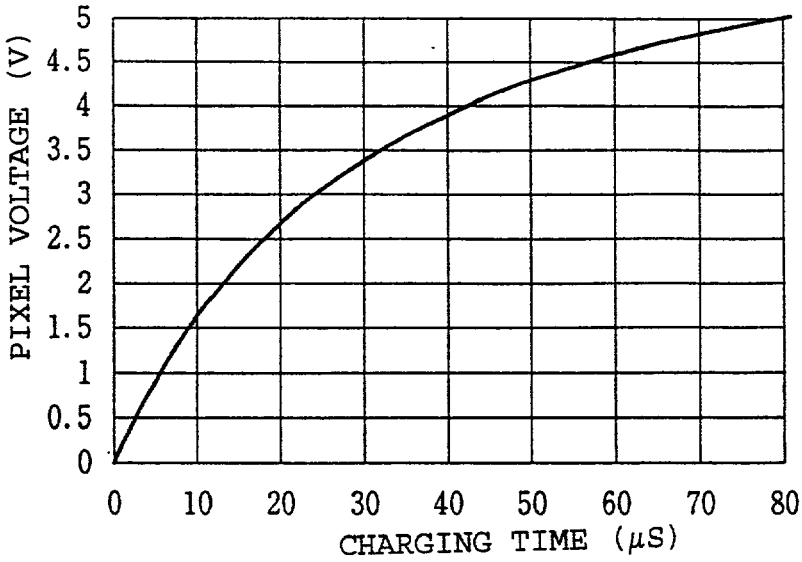
FIG. 3 is a graph showing a state of pixel voltage by driving in according to the present invention.
Figure 4:
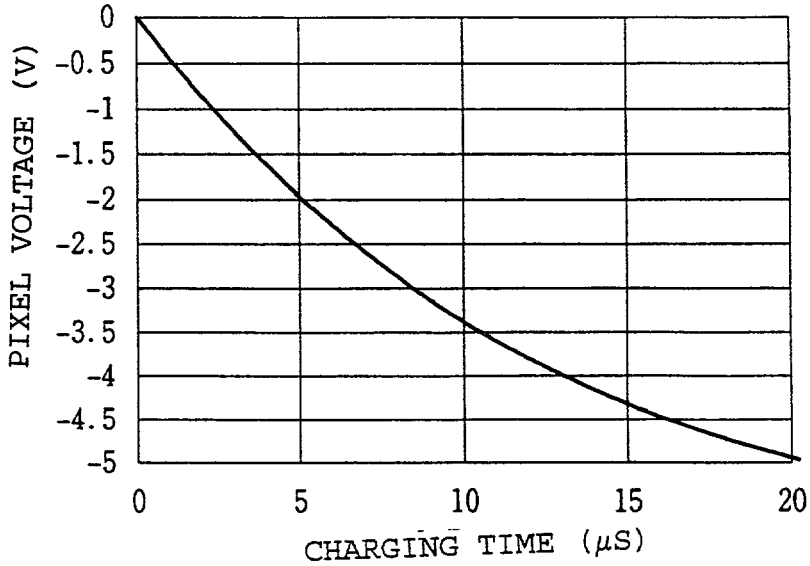
FIG. 4 is a graph showing a state of pixel voltage by driving in according to the present invention.

FIG. 3 and FIG. 4 show charging characteristics which are obtained by setting a voltage to the signal line so as to eliminate the area above the charging time 20 μs, inclusive, of FIG. 2 where efficiency is poor. FIG. 3 shows the case where the pixel is charged from 0 V to 5 V, and FIG. 4 shows charging from 0 V to −5 V. This allows the charging time for the duration of 30 μs to be allocated to the positive application, making the time constant larger than that in FIG. 1 and FIG. 2. It should be noted however that in order to increase the time constant and allow charging up to −5 V even at 20 μs, the negative voltage to the signal line is set to −6 V. In addition, the positive voltage and the gate voltage are 6 V and 10 V, respectively, and the channel width and channel length of the transistor are 7 μm and 8 μm, respectively, and the pixel capacitance is 0.7 pF.

By thus changing the allocation time of a single scanning line by the polarity of the signal line (by changing it between periods "b" and "c" in FIG. 7), it is possible, though only on the side of positive polarity, to increase the width of time control in tone display, thus obtaining a stable display state. That is, it is possible to provide an image display device with further improved stability with respect to signal delays or non-uniformity in transistor characteristics.

Figure 6:
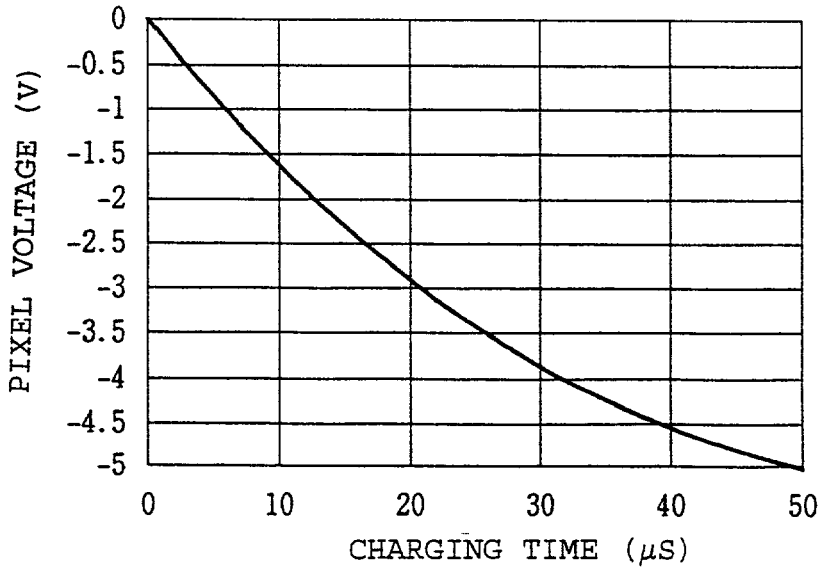
FIG. 6 is a graph showing a state of pixel voltage by driving in according to the present invention.

The following describes yet another example. In the example of charging characteristics as shown in FIG. 6, the change in pixel potential as a function of the charging time is more gradual on the side of the negative application, compared with the example of FIG. 4, making it possible to adopt a less degree of precision for the precision required for selecting a pulse width in a tone display. Further, in case of signal delays, it is possible to prevent a change in shift amount from a set value of the charge voltage from being too different between the positive side and the negative side. This reduces the occurrence of display failure which is caused by an offset DC value adding a DC voltage to the liquid crystal.

Figure 5:
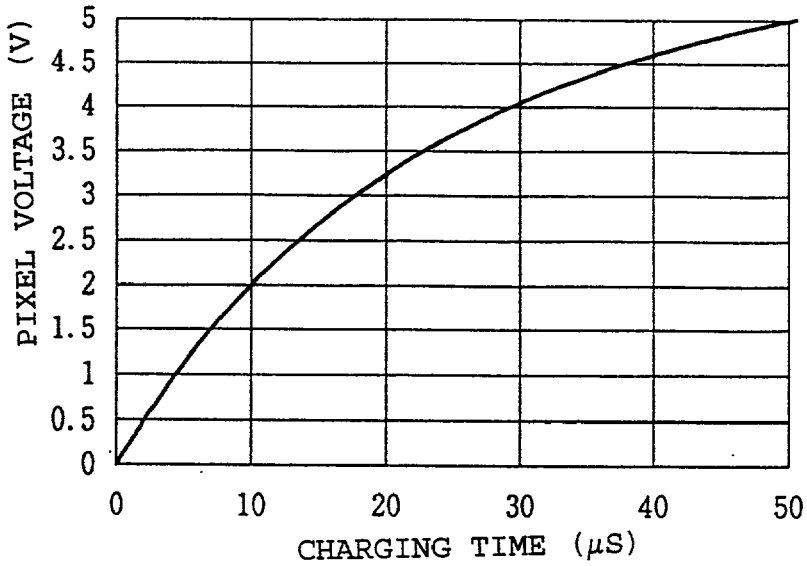
FIG. 5 is a graph showing a state of pixel voltage by driving in according to the present invention.

That is, in the example of charging characteristics as shown in FIG. 6, the voltage for switching ON the scanning line is varied according to the polarity so that the shape of the curve is nearly the same as that of the positive side. FIG. 5 shows the case where the pixel is charged from 0 V to 5 V, and FIG. 6 shows charging from 0 V to −5 V. Here, the gate voltages are 15 V and 6 V, respectively, in the positive application and the negative application. In addition, the channel width and channel length of the transistor are 7 μm and 13 μm, respectively, and the pixel capacitance is 0.7 pF, and the supplied voltages to the signal line are ±6 V.

Despite the need to change the charging time depending on the polarity to compensate for the offset per tone as discussed earlier, the shape of the curve is almost the same between the negative side and the positive side. Therefore, it is not required to take into consideration the difference in characteristics due to polarity, making it easier to set the charging time. Further, influence of signal delays and the like acts equally on the both polarities, and thus signal delays only result in change in tone level as a whole, thus solving the problem of poor reliability and other deficiencies due to DC offset.

Note that, it is assumed in FIG. 1 through FIG. 6 that the charging starts from 0 V, so as to clearly indicate how the voltage which is charged according to a pulse width changes. However, in a mode which is more up to actual applications, charging starts from a corresponding voltage level of the opposite polarity, or from a voltage which is maintained at 0 V until a certain point during an ON state of the transistor and is then switched to a specific voltage at a certain timing on the signal line. Therefore, the actual voltage change of the pixel electrodes is different from those shown in FIG. 1 through FIG. 6.

Figure 8:
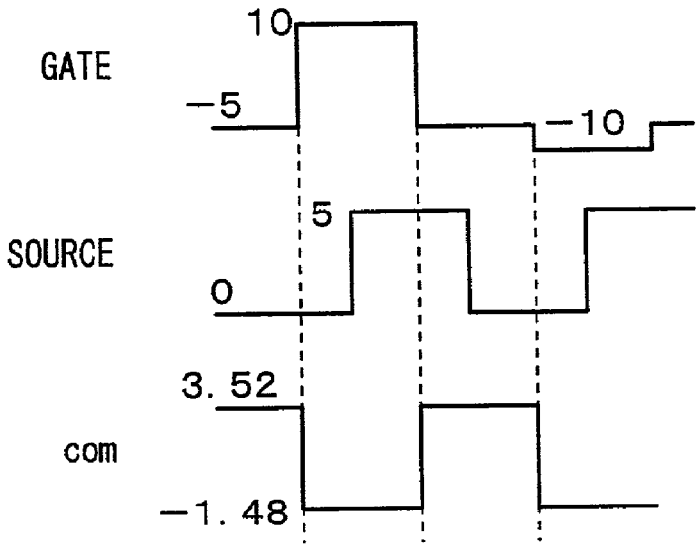
FIG. 8 is a timing chart showing driving signals of the present invention.
Figure 9:
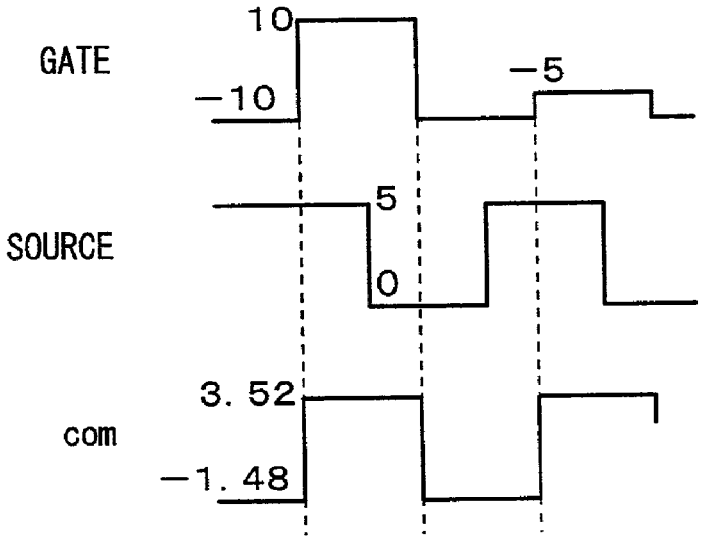
FIG. 9 is a timing chart showing driving signals of the present invention.

To explain such a mode which is more up to actual applications, FIG. 8 and FIG. 9 show driving waveforms of a scanning signal (gate), a data signal (source), and a common electrode signal (com). FIG. 8 shows the case of positive application and FIG. 9 shows the case of negative application. Note that, as shown in these drawings, the signals of common electrode (counter electrode) and auxiliary capacitance electrodes are driven by an AC voltage of the opposite polarity with respect to a signal line under a black display state. This is to suppress the amplitude which drives the signal lines, so as to allow the use of a low-voltage-resistant driver and reduce power consumption. Note that, this method has also been employed by conventional liquid crystal panels which realize tone-display by amplitude.

Figure 10:
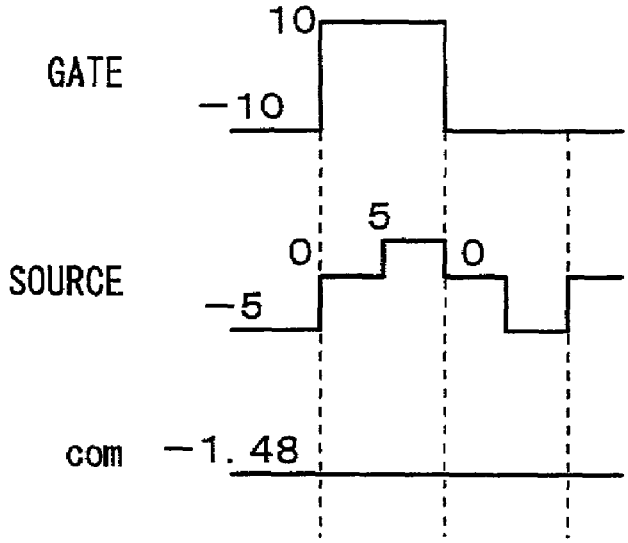
FIG. 10 is a timing chart showing driving signals of the present invention.
Figure 11:
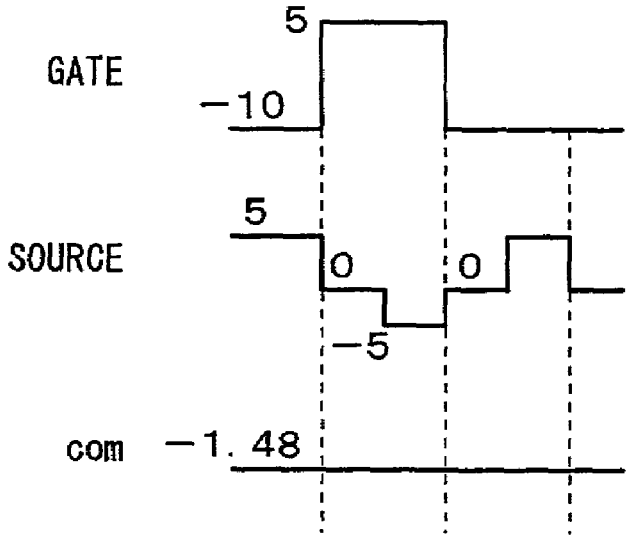
FIG. 11 is a timing chart showing driving signals of the present invention.

In order to examine the charging characteristics, which is somewhat difficult with FIG. 8 and FIG. 9, these drawings were revised as shown in FIG. 10 and FIG. 11, respectively, taking into consideration a potential difference between the respective signals. In FIG. 10 and FIG. 11, the common electrode is assumed to have a direct current, and a potential difference with respect to the potential of this current is represented by waveforms in practically the same state as that of FIG. 8 and FIG. 9.

In FIG. 8 and FIG. 9, the ON voltage of the gate is 10 V, and a tone-display is realized by shifting the timing of inverting the signal line. In term of FIG. 10 and FIG. 11, this driving is practically the same as that as illustrated by FIG. 5 and FIG. 6 in which the gate voltage of the positive application and the gate voltage of the negative application are different from each other. Further, a tone-display is realized by a ratio of an applied white voltage (voltage corresponding to a white display) and a black voltage (voltage corresponding to a black display) during an ON period of the gate, and this is practically the same as controlling tones by the charging time as described above.

Figure 12:
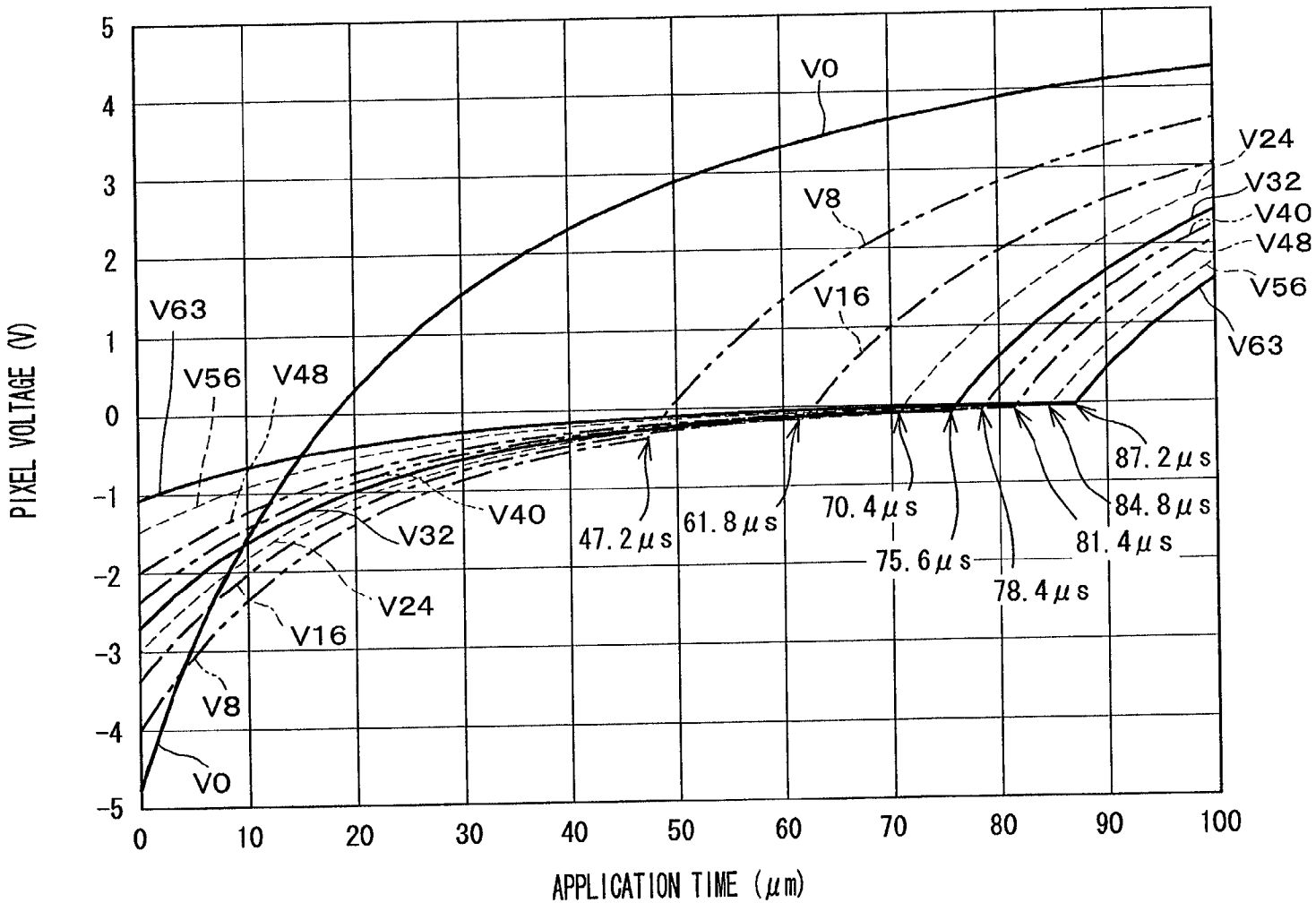
FIG. 12 is a graph showing a state of pixel voltage by driving in according to the present invention.
Figure 13:
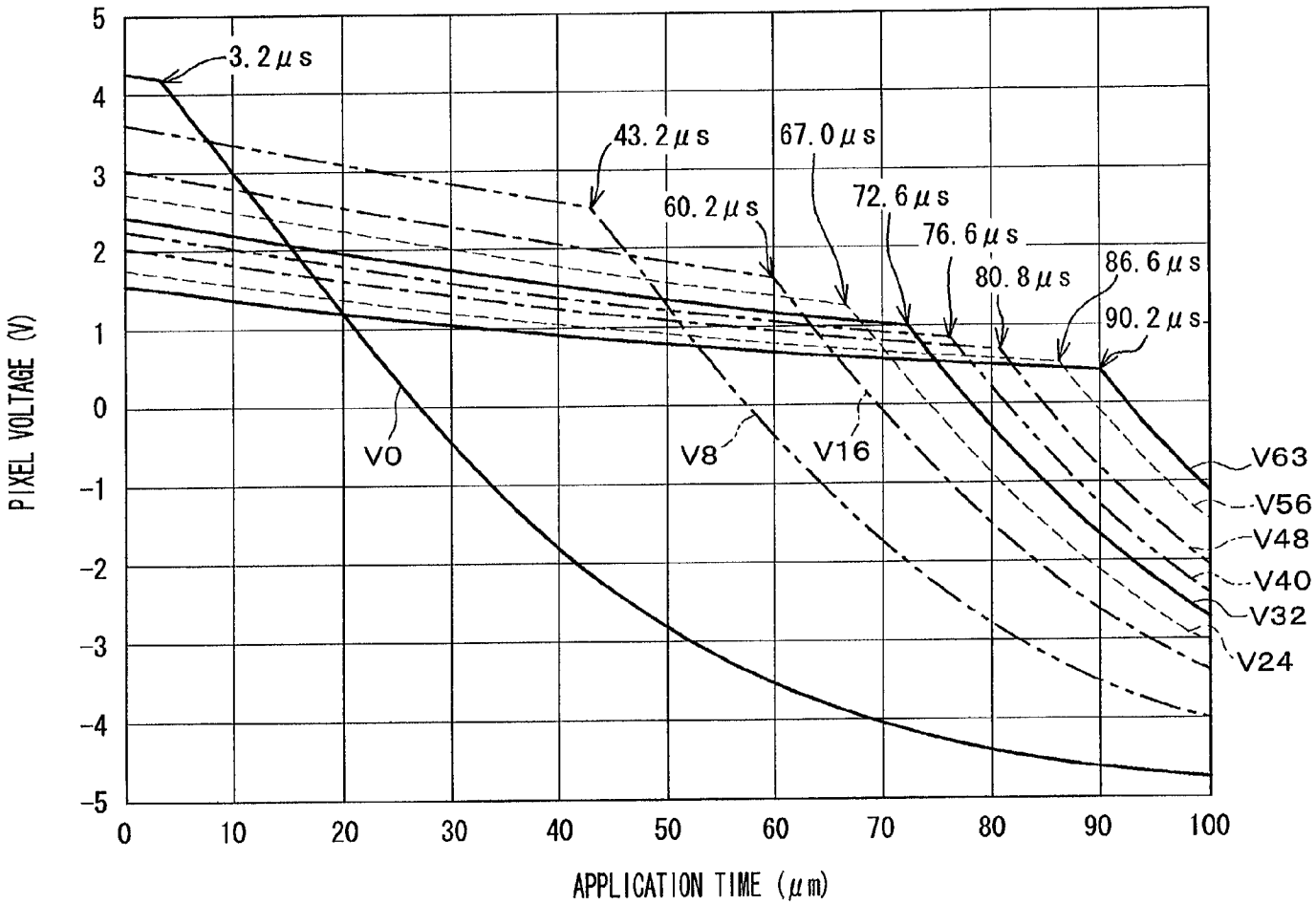
FIG. 13 is a graph showing a state of pixel voltage by driving in according to the present invention.
Figure 14:
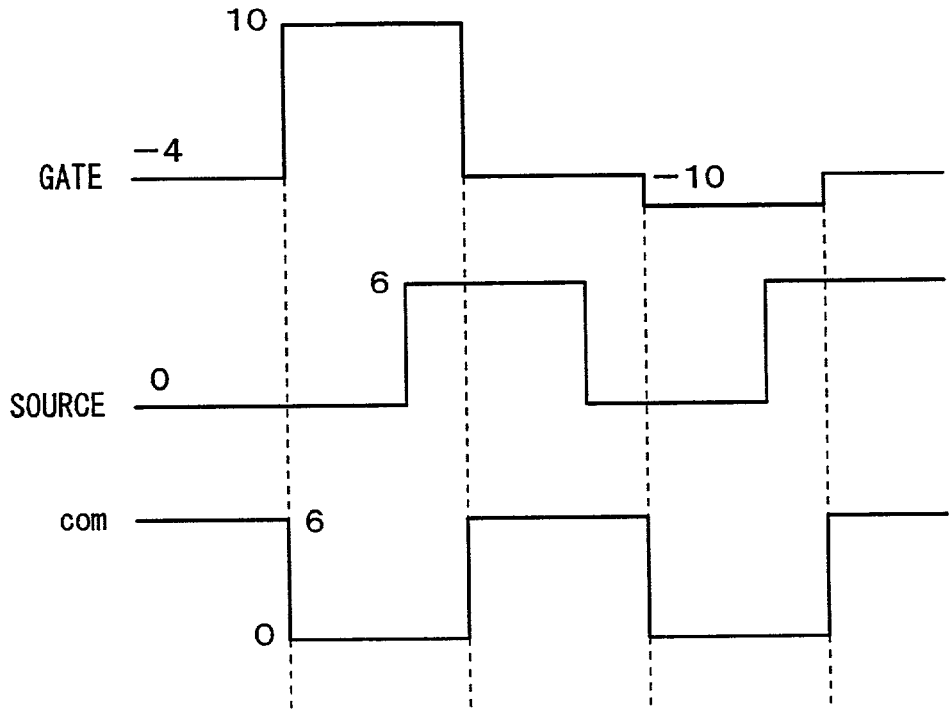
FIG. 14 is a timing chart showing driving signals of the present invention.

FIG. 12 and FIG. 13 show how pixel potentials are charged at main tone levels according to the foregoing driving. FIG. 12 shows the case where the pixels are charged in a positive direction and FIG. 13 shows the case where the pixels are charged in a negative direction. Further, a potential difference with respect to a potential of a pseudo direct current of the common electrode is represented by a waveform. That is, the voltage waveforms shown in FIG. 12 and FIG. 13 are a source-gate voltage and a gate-drain voltage, along with the voltage of the AC common electrode.

FIG. 12 and FIG. 13 illustrate estimates of charging characteristics of pulse width modulation under a constant state. In FIG. 12, the source voltages are 0 V and 5 V. In FIG. 13, the source voltages are 0 V and −5 V. Also, in FIG. 12, the pixel capacitance is 0.7436 pF and the allocation time of a single scanning line (i.e., ON time of switching element, corresponding to "b" or "c" of FIG. 7) is 100 μs, and the channel width and channel length of the transistor are 10 μm and 13 μm, respectively. Further, the gate voltage while the transistor is ON is 10 V, and the charging rate in a black display (application of maximum voltage) is 85 percent.

Further, in using this liquid crystal panel to perform display of 64 tones, the pixel voltage of a black display and the pixel voltage of a white display are V0 and V63, respectively. Pixel voltages of main tone levels (after elapsed application time of 100 μs) in FIG. 12 are V0=4.25 V, V8=3.59 V, V16=3.02 V, V24=2.71 V, V32=2.42 V, V40=2.23 V, V48=2.02 V, V56=1.75 V, and V63=1.55 V. Similarly, in FIG. 13, V0=−4.75 V, V8=−4.02 V, V16=−3.38 V, V24=−3.02 V, V32=−2.68 V, V40=−2.38 V, V48=−2.02 V, V56=−1.47 V, and V63=−1.06 V.

It can be seen from this, as described above, that the target pixel voltage is determined, including the offset according to the extent of a pull, and different inversion timings are set for the positive polarity and the negative polarity, even at the same tone level, by the offset and the difference in application characteristics due to polarity. It can also be seen that the amplitude supplied to the signal line is 10 V whereas the target pixel voltage is 9 V, so as to set the charging rate at 90 percent.

Figure 15:
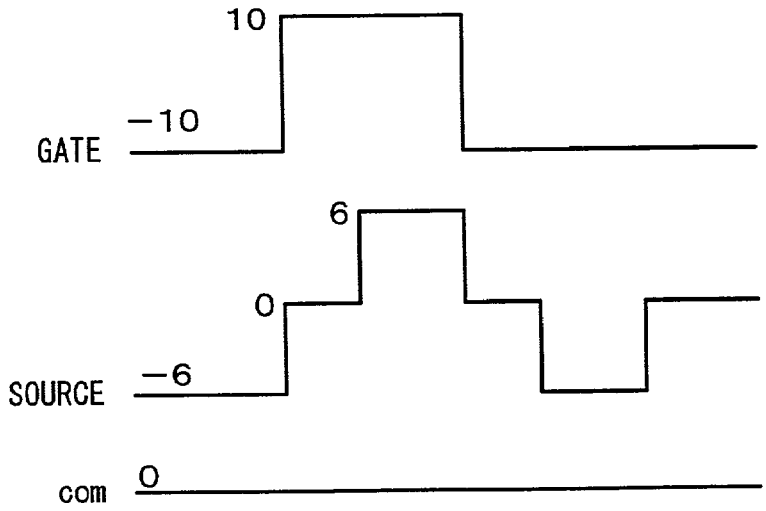
FIG. 15 is a timing chart showing driving signals of the present invention.
Figure 16:
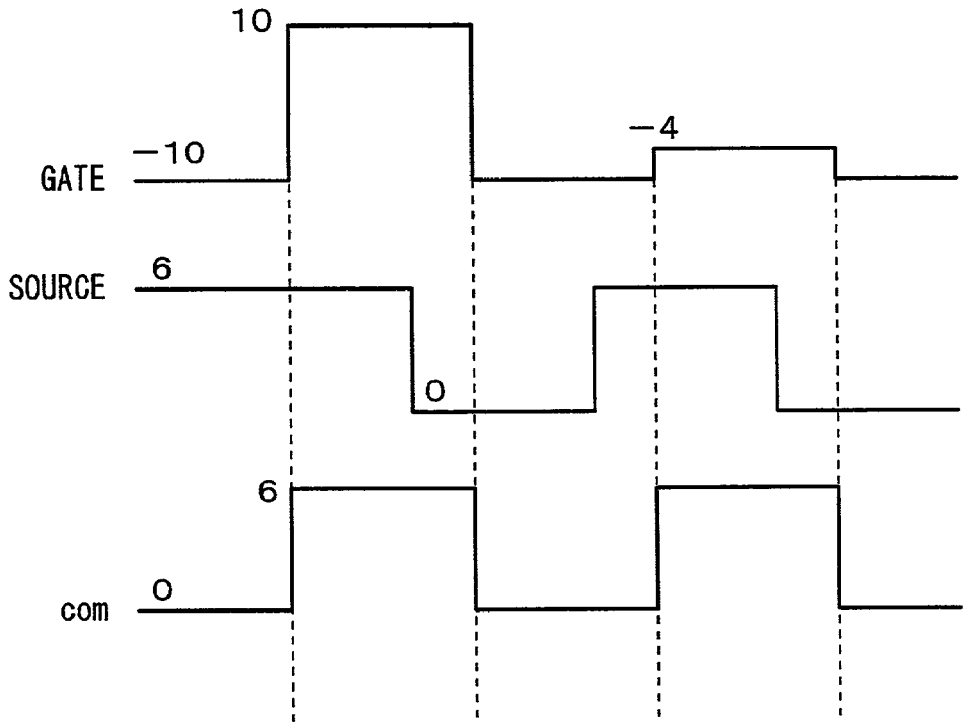
FIG. 16 is a timing chart showing driving signals of the present invention.
Figure 17:
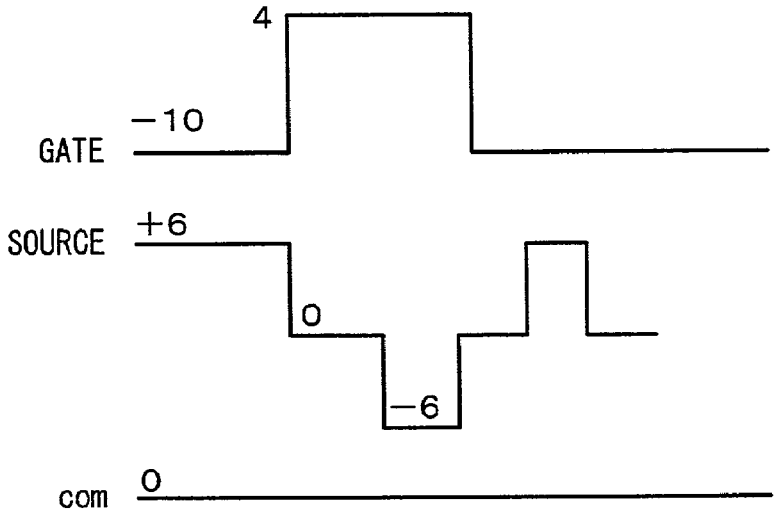
FIG. 17 is a timing chart showing driving signals of the present invention.

The following describe still another example. FIG. 14 through FIG. 17 show the case where the voltage supplied to the signal line is the same as the voltage supplied to the common electrode (counter electrode). As with FIG. 8 through FIG. 11, FIG. 14 shows the case of positive application, and FIG. 16 shows the case of negative application. FIG. 15 and FIG. 17 are analogous to FIG. 14 and FIG. 16, respectively, showing waveforms of a potential difference with respect to a potential of the common electrode which is assumed to have a direct current. By thus making the supplied voltage to the signal line the same as the supplied voltage to the common electrode (counter electrode), the number of voltage systems which are externally supplied to the driver can be decreased. This reduces a loss in forming a power voltage, and therefore is effective for reducing power consumption. The voltages set for the respective tone levels are as shown in Table 1, and they can be set easily by adjusting the charging time. Table 1 shows values of pixel voltages which are set in this example.

TABLE 1

| | POSITIVE APPLICATION (V) | NEGATIVE APPLICATION (V) |
|---|---|---|
| V0 | 5.73 | −3.27 |
| V8 | 5.07 | −2.54 |
| V16 | 4.5 | −1.9 |
| V24 | 4.19 | −1.54 |
| V32 | 3.9 | −1.2 |
| V40 | 3.71 | −0.9 |
| V48 | 3.5 | −0.54 |
| V56 | 3.23 | 0 |
| V63 | 3.03 | 0 |

[Second Embodiment]

The following will describe yet another embodiment of the present embodiment with reference to FIG. 18 through FIG. 33.

Figure 18:
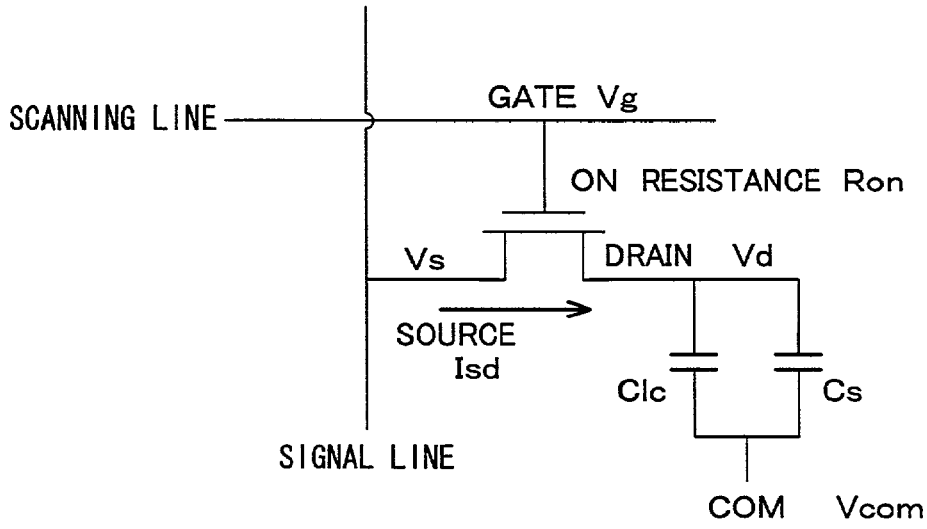
FIG. 18 is a circuit diagram showing an equivalent circuit of a unit pixel.

FIG. 18 is a circuit diagram per pixel (unit pixel) of a liquid crystal display panel (TFT-LCD) as an image display device of the present embodiment. A group of such a unit pixel is disposed in a matrix pattern. In this example, a plurality of signal lines are connected to pixel electrodes via pixel switching elements, which are switched ON or OFF by scanning lines.

A liquid crystal capacitance Clc and an auxiliary capacitance Cs, which are pixel capacitances, are connected to a counter electrode COM having a common voltage (common potential) Vcom. Note that, here, the liquid crystal capacitance Clc and the auxiliary capacitance Cs have the same potential (=common potential Vcom), which, however, may be different. Also, the counter electrode COM may be provided in the form of a line.

Further, the counter electrode may be provided on a substrate (counter substrate) opposite a substrate having TFTs. Alternatively, the counter electrode may be provided on the substrate having TFTs, so as to be driven by an IPS (In Plane Switching) mode.

Figure 19:
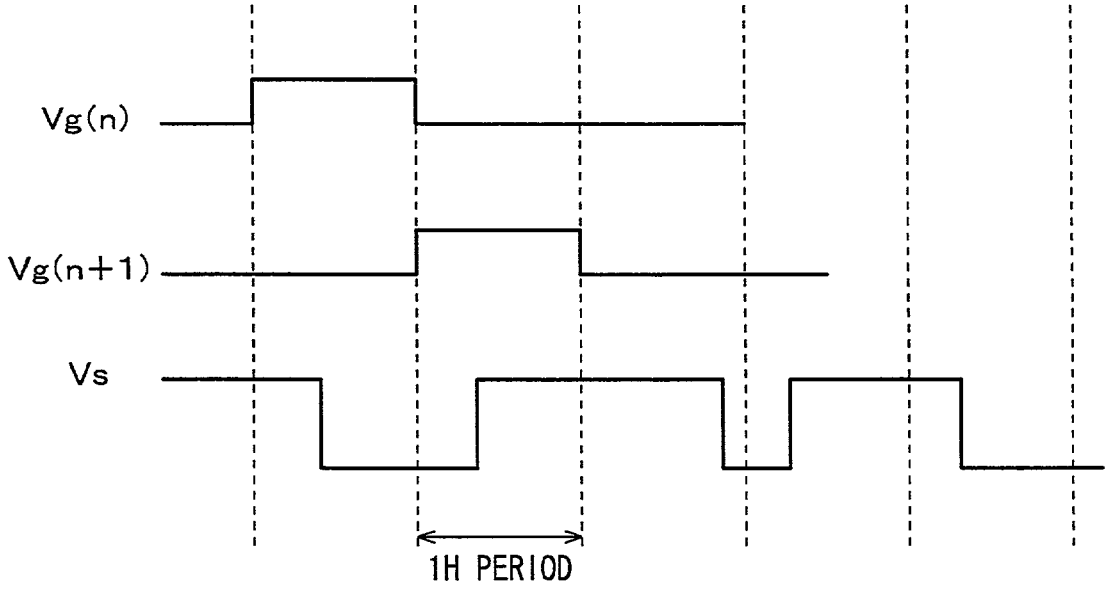
FIG. 19 is an explanatory drawing showing signal waveforms in a pulse width modulation driving method of the present invention.

In the present embodiment, as shown in FIG. 19, the signal line and the scanning line are shifted in phase of their waveforms to perform a tone display, and the polarities of pixels in the signal line direction are inverted alternately. Note that, in FIG. 19, indicated by Vg(n), Vg(n+1), and Vs from the top are an nth gate potential, an (n+1)th gate potential, and a source potential, respectively. Thus, any tone can be realized without increasing the frequency of the signal line.

The following describes a structure for shifting the phase of a waveform of the signal line with respect to the phase of a waveform of the scanning line.

Figure 20:
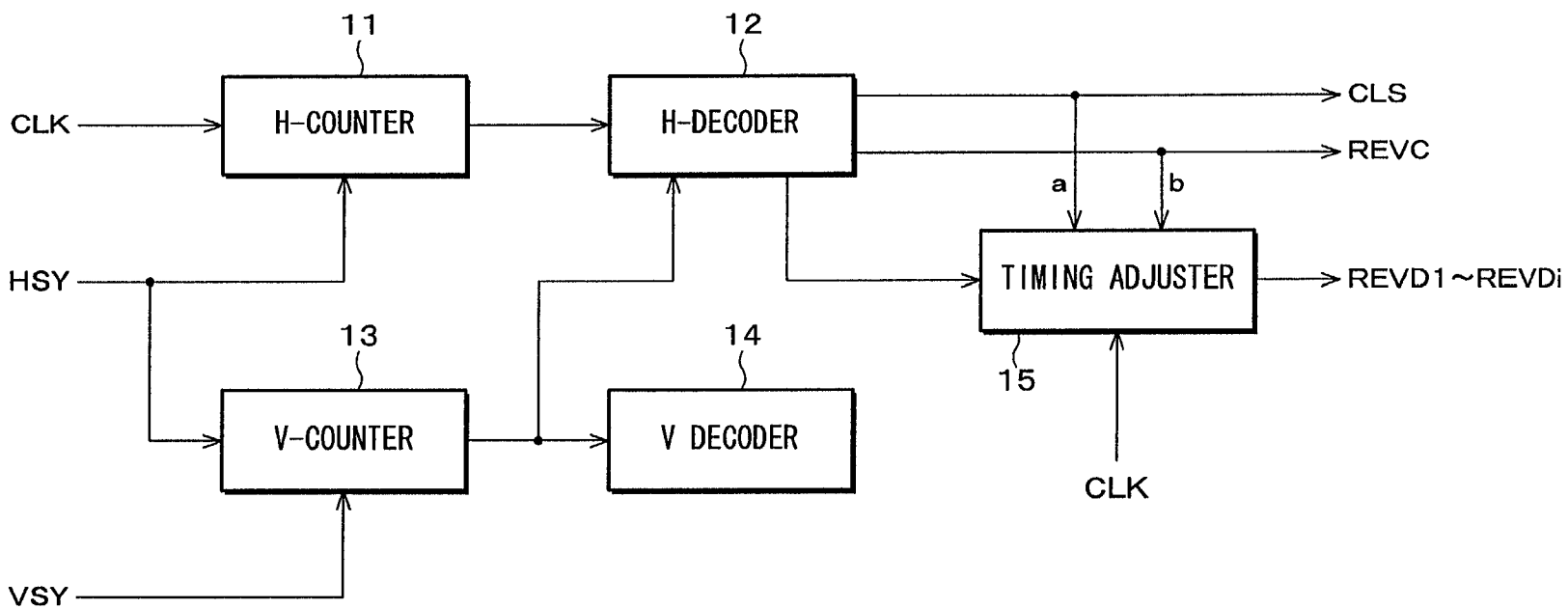
FIG. 20 is a block diagram showing an exemplary structure of a circuit for shifting waveform phases of signal lines.

As shown in FIG. 20, an H-counter 11, an H-decoder 12, a V-counter 13, a V-decoder 14, and a timing adjuster 15 are connected to one another to make up a signal line driving section. To the H-counter 11 are inputted a clock CLK and a horizontal synchronize signal HSY. To the V-counter 13 are inputted the horizontal synchronize signal HSY and a vertical synchronize signal VSY. The H-decoder 12 outputs a scanning line signal timing pulse (gate driver clock) CLS and a common electrode signal timing pulse REVC. The timing adjuster 15 receives a clock CLK and constantly outputs all of signal line signal timing pulses REVD1 through REVDi (collectively referred to as "REVD" hereinafter: i indicates the number of signals) based on the CLS and REVC.

The REVD is inverted at the same inversion period as the REVC. That is, the REVD has the same period as that of CLS. In the present embodiment, tones are displayed by shifting the phase of a waveform of the signal line with respect to the phase of a waveform of the scanning line or the common electrode, and therefore each tone has a different phase difference. This is the reason i signal line signal timing pulses, such as the REVD1 through REVDi, are created, corresponding to respective tones. The REVD1 through REVDi correspond to data of 1st tone to ith tone, respectively.

The timing adjuster 15 selects an input signal as indicated by "a" in the drawing when specifying the signal timing (REVD) of the signal line by a phase difference with respect to CLS. When specifying the signal timing (REVD) of the signal line by a phase difference with respect to REVC, the input signal as indicated by "b" in the drawing is selected. The timing of REVD is adjusted according to the selected signal. The signal line driving circuit is adapted such that its output timing is decided according to the timing of REVD, for example, by a circuit to be described later. This sets a phase difference between a signal of the signal line and a signal of the scanning line or a driving signal of the common electrode, thereby realizing tone display.

Figure 21:
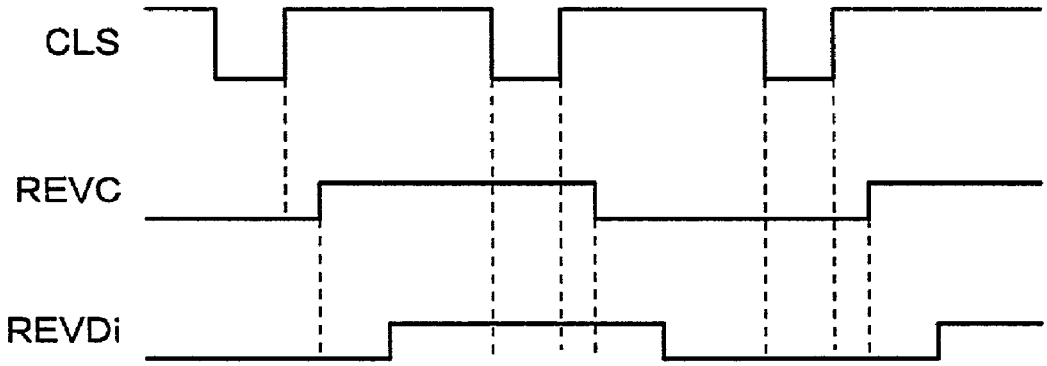
FIG. 21 is a timing chart showing respective timings of the signals of FIG. 20

The timings of these signals are shown in FIG. 21. Note that, for convenience of explanation, FIG. 21 is simplified to show only REVDi but analogous i signals are created in actual practice. The phases of REVD1 through REVDi may be shifted with respect to CLS, or, alternatively, REVC.

Figure 22:
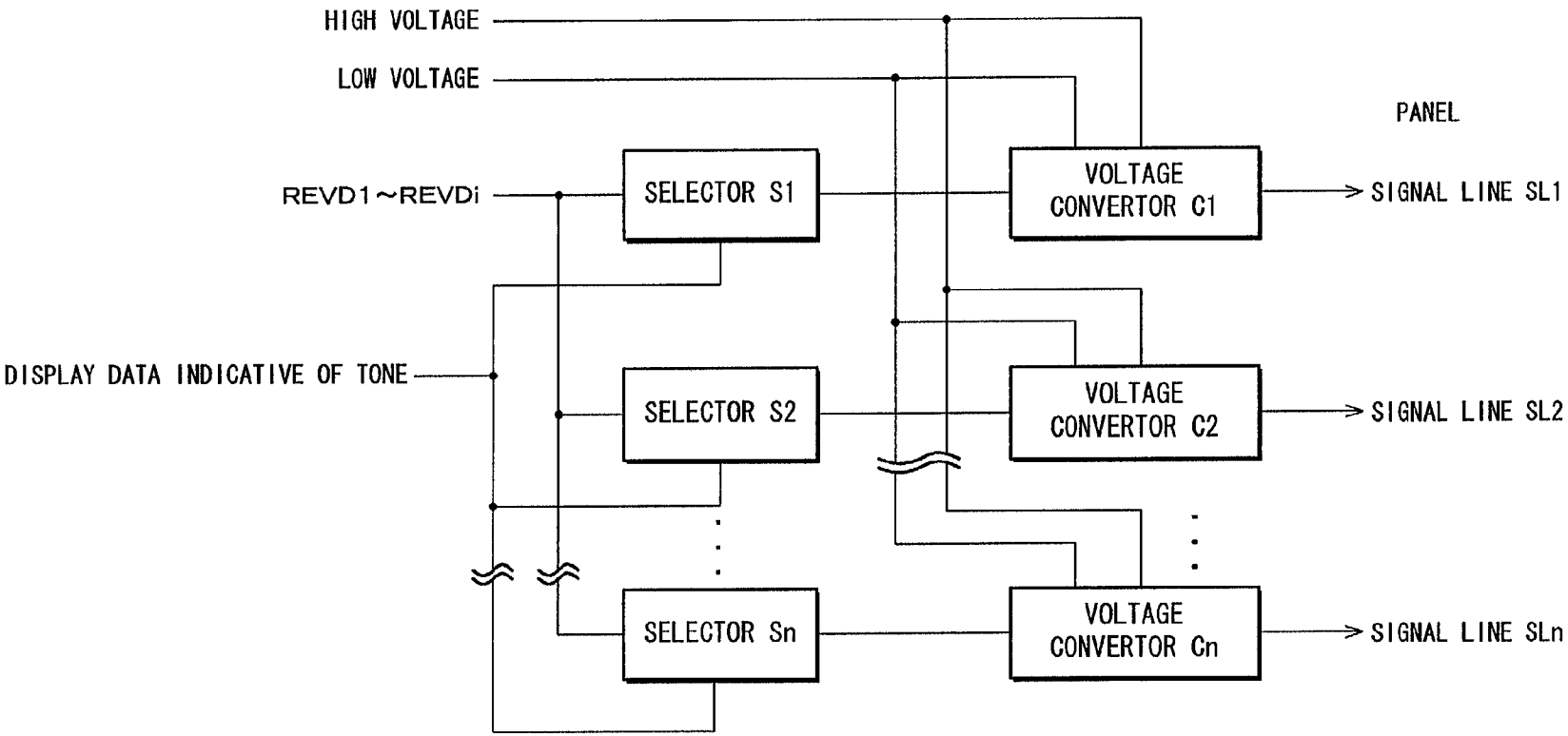
FIG. 22 is a block diagram showing an exemplary structure of a circuit for outputting signals of signal lines.

The circuit of this structure can be used to shift the phase of a waveform of the signal line with respect to the phase of a waveform of the scanning line. The timing adjuster 15 outputs REVD1 through REVDi according to data which indicate how much the phase of the waveform of the signal line should be shifted with respect to the phase of the waveform of the scanning line which is created based on the timing of CLS. As shown in FIG. 22, when driving n signal lines SL1 through SLn, the timings of pulses to be applied to the signal lines are sequentially selected from REVD1 through REVDi by selectors (S1 through Sn). This allows output of a high or low potential at a desired time interval as the voltage for the signal lines.

That is, when driving n signal lines SL1 through SLn, either one of REVD1 through REVDi is selected for each signal line according to display data. Then, by selecting a potential of high level or low level for each signal line at the timing of the selected REVD, a desired voltage waveform according to each tone is outputted to each signal line.

The foregoing structure of FIG. 20 may also be used for the case where the phase of a waveform of the signal line is shifted with respect to the phase of a waveform of the AC (two values) common electrode. This differs from the foregoing case in that the timing adjuster 15 outputs REVD1 through REVDi according to data which indicate how much the phase of the waveform of the signal line should be shifted with respect to the phase of the waveform of the common electrode which is created at the timing of the REVC.

Figures 23, 24:
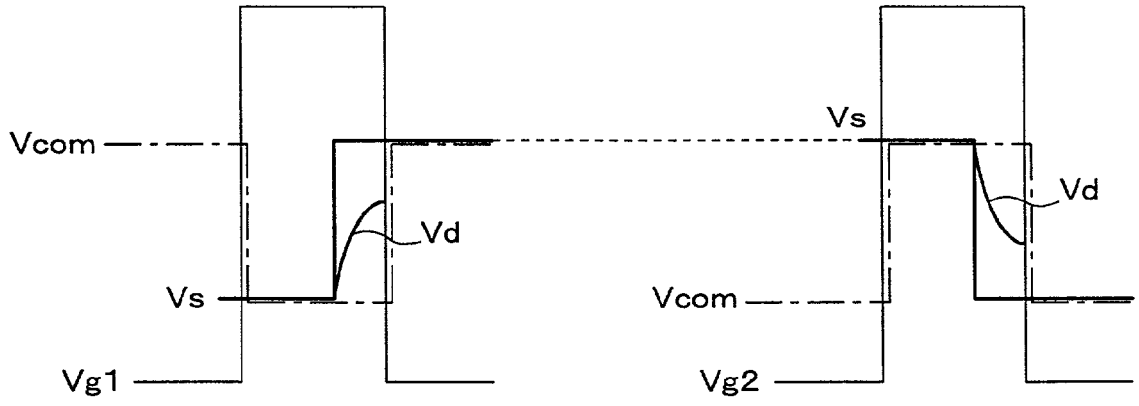
FIG. 23 is an explanatory drawing showing the signals outputted in the structure of FIG. 22.
FIG. 24 is an explanatory drawing showing waveforms of respective signals of an arbitrary pixel when carrying out a tone display by charging by one horizontal period inversion driving.

FIG. 23 shows signals which are outputted from voltage convertors (C1 through Cn). That is, the signals are classified according to the way tones are displayed, i.e., whether utilizing which level of a reference voltage, and whether utilizing charging or discharging. Note that, details of a tone display utilizing charging or discharging will be described later.

When displaying tones by charging, the signal output changes from Low to High when the reference voltage is at Low level, and from High to Low when the reference voltage is at High level. The potential difference between a potential of the signal line (signal line voltage) and a potential of the common electrode (common voltage) increases according to the time required for the change to occur, and the pixel capacitance is charged in accordance with the potential difference after increase.

When displaying tones by discharge, the signal output changes from High to Low when the reference voltage is at Low level, and from Low to High when the reference voltage is at High level. The potential difference between a potential of the signal line (signal line voltage) and a potential of the common electrode (common voltage) decreases according to the time required for the change to occur, and the pixel capacitance is discharged in accordance with the potential difference after decrease. In this manner, tones are displayed according to a potential of the pixel after charging or discharge.

Figure 41:
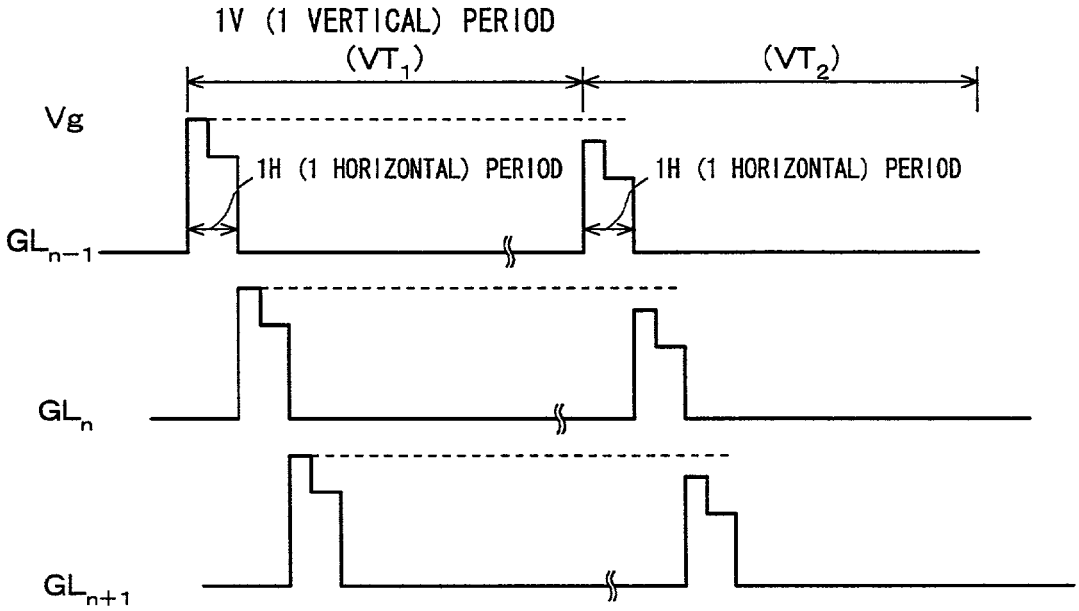
FIG. 41 is a timing chart showing signal waveforms of a gate potential.
Figure 42:
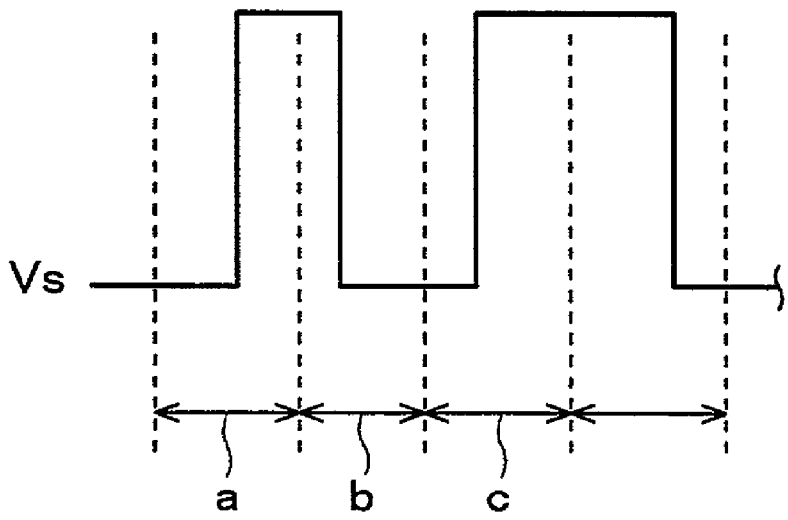
FIG. 42(*a*) and FIG. 42(*b*) are timing charts showing signal waveforms of a source potential, in which (a) is a timing chart in a vertical period $VT_1$; and (b) is a timing chart in a vertical period $VT_2$.
Figure 42:
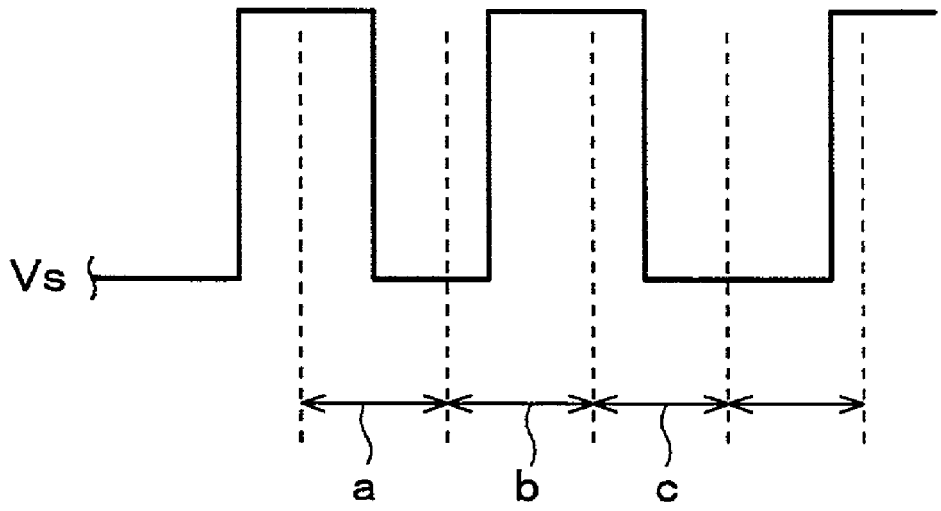
Figure 43:
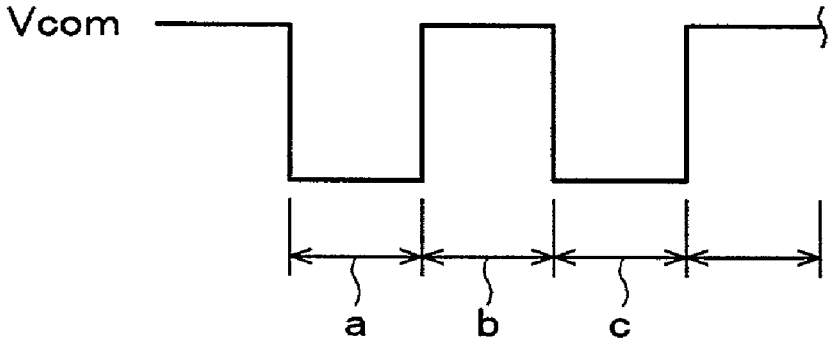
FIG. 43(*a*) and FIG. 43(*b*) are timing charts showing signal waveforms of a common voltage, in which (a) is a timing chart in a vertical period $VT_1$; and (b) is a timing chart in a vertical period $VT_2$.
Figure 43:
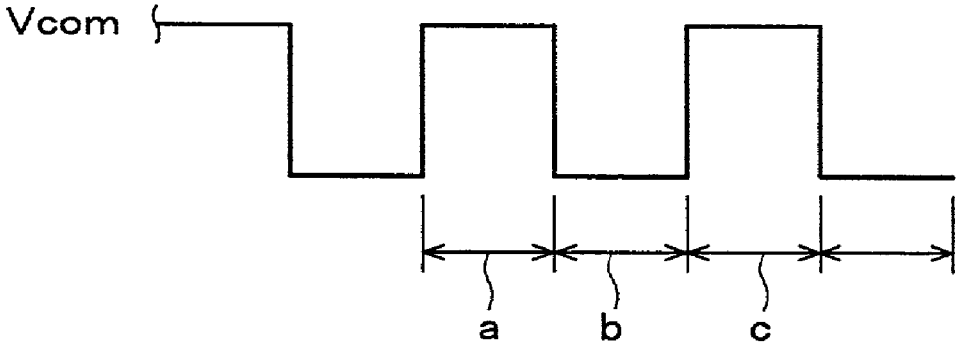

More specifically, in the present embodiment, a scanning line voltage (gate potential) Vg, a signal line voltage (source potential) Vs, and a common voltage (common potential) vcom are applied as shown in FIG. 41, FIGS. 42(*a*) and 42(*b*), and FIGS. 43(*a*) and 43(*b*), respectively. In the drawings, the horizontal axis indicates time, and the vertical axis indicates potential.

In FIG. 41, $VT_1$ indicates one vertical (1V) period, and $VT_2$ indicates the next 1V period. Indicated by $G_{n-1}$, $G_n$, and $G_{n+1}$ are (n−1)th, nth, and (n+1)th scanning lines, respectively.

In FIGS. 42(*a*) and 42(*b*), and FIGS. 43(*a*) and 43(*b*), indicated by "a", "b", and "c" are Vs when scanning (n−1)th, nth, and (n+1)th scanning lines, respectively.

FIG. 24 shows a superimposed view of these signals. That is, FIG. 24 shows how a voltage is applied to an arbitrary pixel when tones are displayed by charging by one H line inversion driving (one horizontal period inversion driving). Vs is a voltage of the signal line. Vcom is a voltage of the common electrode, which is an AC (two values) voltage. Vg1 is a voltage of an arbitrary scanning line within a certain horizontal period, and Vg2 is a voltage of the next signal line in the next horizontal period. Vd is a drain potential of a TFT as the pixel switching element.

For a brief moment after Vg1 becomes High (ON) level, Vs is at Low level as with Vcom and has the same potential as Vcom. Thus, at the beginning of one horizontal period, the potential difference between the signal line potential and the common electrode potential is minimum. As a result, the potential Vd of the drain decreases, and accordingly the liquid crystal capacitance of the pixel is discharged at the maximum level. Thereafter, after an elapsed time period which varies depending on the tone, Vs becomes High while Vcom stays Low. As a result, at the end of one horizontal period (at the time of application), the potential difference between the signal potential and the common electrode potential becomes maximum. With this increase in potential difference, the potential Vd of the drain increased in the positive direction, and the liquid crystal capacitance of the pixel is charged accordingly. When Vg1 becomes Low level (OFF), the potential Vd of the drain stops increasing, and the charging of the liquid crystal capacitance of the pixel comes to halt as a result. Thereafter, Vcom becomes High level, obtaining the same potential as Vs.

In the next horizontal period after Vg1 becomes Low level (OFF) in the described manner, Vg2 becomes High level (ON). For a brief moment after Vg2 becomes High (ON) level, Vs is at a potential where Vg1 became Low level (OFF), and is at High level as with Vcom and has the same potential as Vcom. Thus, at the beginning of one horizontal period, the potential difference between the signal line potential and the common electrode potential is minimum. As a result, the potential Vd of the drain decreases, and accordingly the liquid crystal capacitance of the pixel is discharged at the maximum level. Thereafter, after an elapsed time period which varies depending on the tone, Vs becomes Low while Vcom stays High. As a result, at the end of one horizontal period (at the time of application), the potential difference between the signal potential and the common electrode potential becomes maximum. With this increase in potential difference, the potential Vd of the drain increases in the negative direction, and the liquid crystal capacitance of the pixel is charged accordingly. When Vg2 becomes Low level (OFF), the potential Vd of the drain stops increasing, and the charging of the liquid crystal capacitance of the pixel comes to halt as a result. Thereafter, Vcom becomes Low level, obtaining the same potential as Vs.

In this manner, the polarity of the potential of the signal line is inverted between a certain horizontal period and the next horizontal period.

Figure 25:
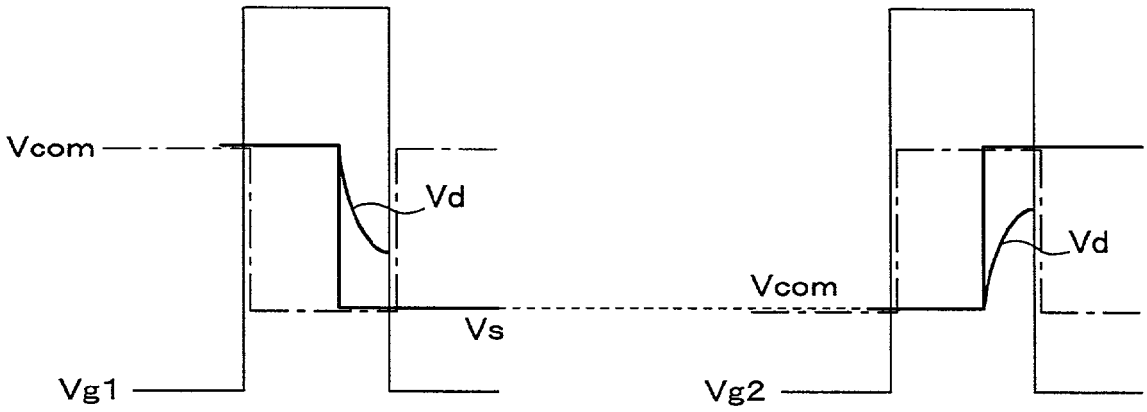
FIG. 25 is an explanatory drawing showing waveforms of respective signals of an arbitrary pixel when carrying out a tone display by discharging by one horizontal period inversion driving.
Figure 45:
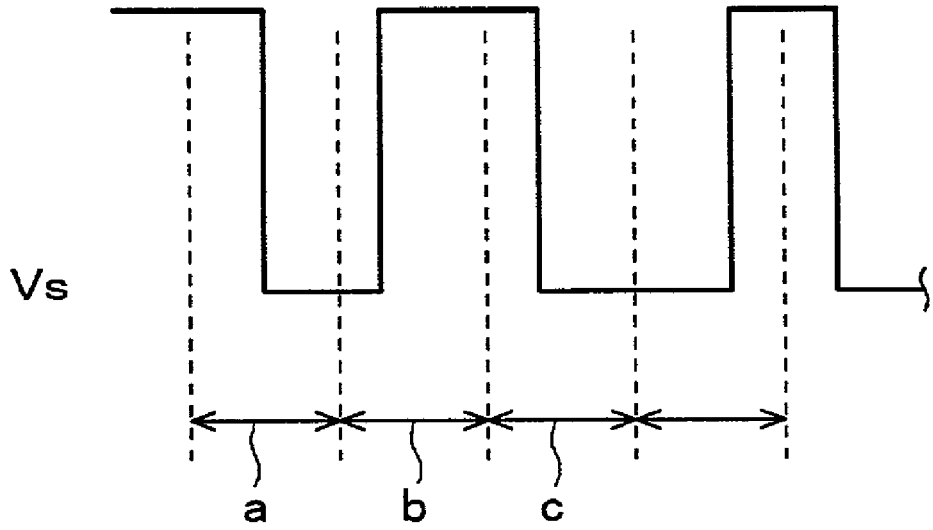
FIG. 45(*a*) and FIG. 45(*b*) are timing charts showing signal waveforms of a source potential, in which (a) is a timing chart in a vertical period $VT_1$; and (b) is a timing chart in a vertical period $VT_2$.
Figure 45:
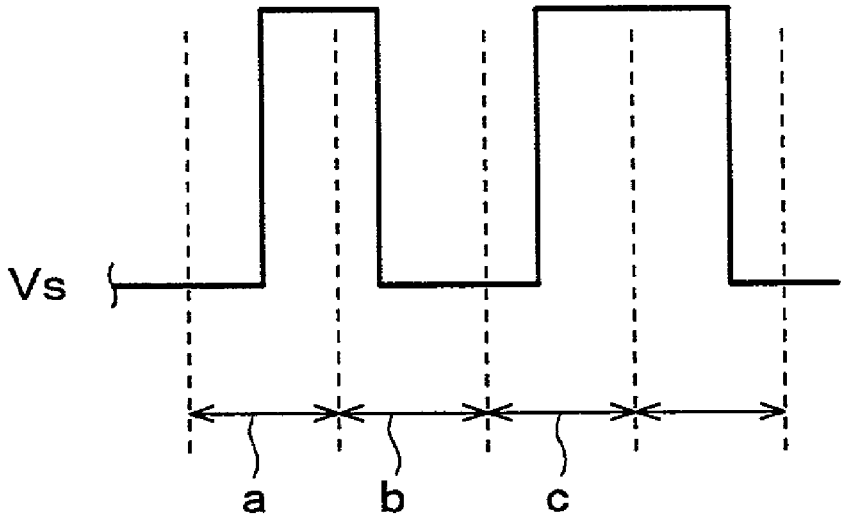

Note that, in the foregoing example, tones are displayed by charging in every horizontal period; however, tones may be displayed by discharging. In this case, the scanning line voltage Vg, the signal line voltage Vs, and the common voltage Vcom are applied as shown in FIG. 41, FIGS. 45(*a*) and 45(*b*), and FIGS. 43(*a*) and 43(*b*), respectively. FIG. 25 is a superimposed view of these signals. That is, FIG. 25 shows how a voltage is applied to an arbitrary pixel when tones are displayed by discharge. Vs is a voltage of the signal line. Vcom is a voltage of the common electrode, which is an AC (two values) voltage. Vg1 is a voltage of an arbitrary signal line within a certain horizontal period, and Vg2 is a voltage of the next scanning line of Vg1 in the next horizontal period. Vd is a drain potential of a TFT as the pixel switching element.

For a brief moment after Vg1 becomes High (ON) level, Vcom is at Low level and Vs is at High level. Thus, at the beginning of one horizontal period, the potential difference between the signal line potential and the common electrode potential is maximum. As a result, the potential Vd of the drain is increases in the positive direction by the amount of this potential difference, and accordingly the liquid crystal capacitance of the pixel is discharged at the maximum level. Thereafter, after an elapsed time period which varies depending on the tone, Vs takes the same potential (Low level) as Vcom. As a result, at the end of one horizontal period (at the time of application), the potential difference between the signal potential and the common electrode potential becomes minimum. With this decrease in potential difference, the potential Vd of the drain increases in the positive direction, and the liquid crystal capacitance of the pixel is discharged accordingly. When Vg1 becomes Low level (OFF), the potential Vd of the drain stops decreasing, and the discharge of the liquid crystal capacitance of the pixel comes to halt as a result.

In this manner, in the next horizontal period after Vg1 becomes Low level (OFF), Vg2 becomes High level (ON). For a brief moment after Vg2 becomes High (ON) level, Vcom is at High level and Vs is at Low level. Thus, at the beginning of one horizontal period, the potential difference between the signal line potential and the common electrode potential is maximum. As a result, the potential Vd of the drain increases in the negative direction by the amount of this potential difference, and accordingly the liquid crystal capacitance of the pixel is charged at the maximum level. Thereafter, after an elapsed time period which varies depending on the tone, Vs takes the same potential as Vcom (High level). As a result, at the end of one horizontal period (at the time of application), the potential difference between the signal potential and the common electrode potential becomes minimum. With this decrease in potential difference, the potential Vd of the drain decreases, and the liquid crystal capacitance of the pixel is discharged accordingly. When Vg1 becomes Low level (OFF), the potential Vd of the drain stops decreasing, and the discharge of the liquid crystal capacitance of the pixel comes to halt as a result.

In this manner, the polarity of the potential of the signal line is inverted between a certain horizontal period and the next horizontal period.

The scanning is carried out in a line sequential manner, and tones are realized by shifting the waveform phases of the signal line and the scanning line. Further, the polarities of pixels in the signal line direction are inverted alternately. Further, in the present embodiment, the common electrode has an AC (two values) voltage, and therefore it can be said that tones are realized by shifting the signal line and the common electrode in phase of their waveforms.

Further, the signal line is driven by being inverted for one horizontal (1H) period alternately per scanning line. Also, the phase of the common electrode (common voltage) remains the same in every tone, and the polarity of the signal line is inverted once in an absolute manner within one horizontal period.

Figure 26:
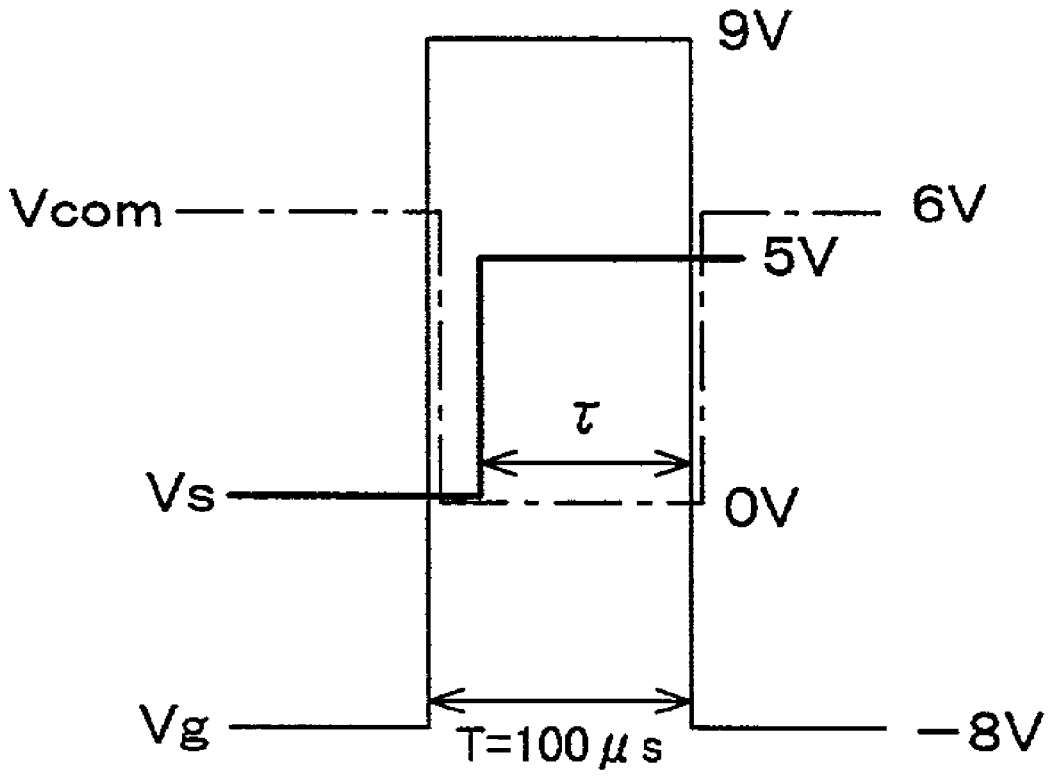
FIG. 26 is an explanatory drawing showing driving conditions of respective signals.
Figure 27:
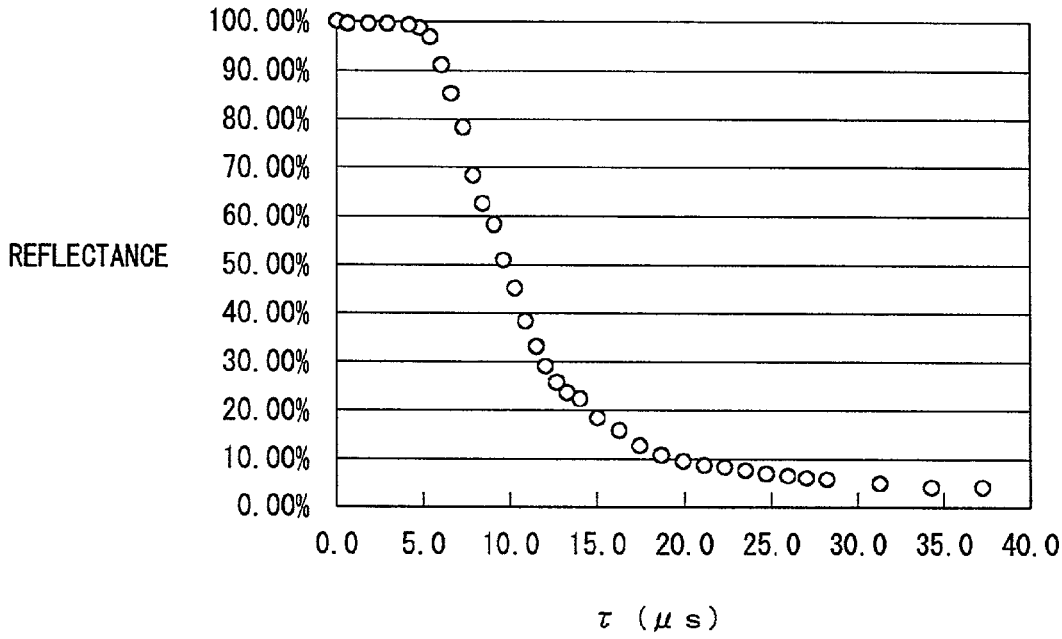
FIG. 27 is a graph showing characteristics of reflectance with respect to the phase difference of FIG. 26.

Here, FIG. 27 shows a relation between time τ, which is a phase difference in waveform between the signal line and the scanning line, and reflectance of the product liquid crystal screen under the driving condition of FIG. 26. T is the ON time of the scanning line. The measurement was made using a reflective TFT-LCD of a counter signal line structure, with the TFT size of W (width)=10 μm, L (length)=10 μm, and a pixel pitch of 80 μm.

Figure 33:
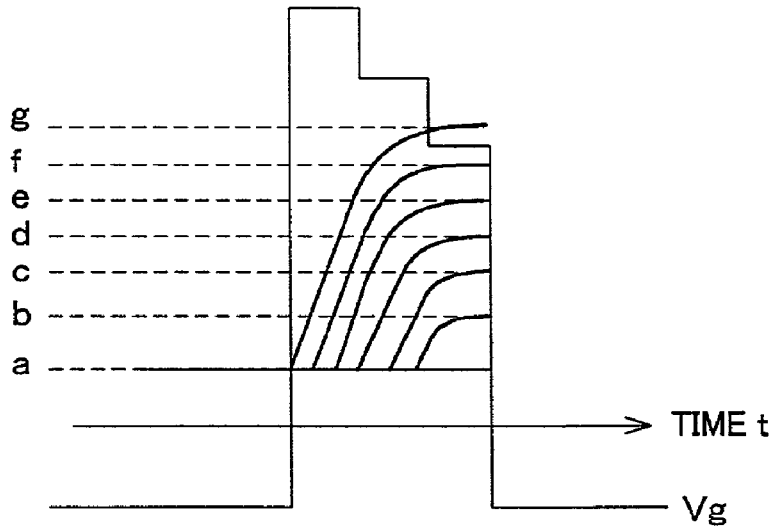
FIG. 33 is graph showing tone characteristics of the pulse width modulation driving method when a source amplitude is nearly equal to that of a conventional voltage modulation driving method and when an amplitude of an applied gate voltage is gradually decreased.

As shown in FIG. 41 and FIG. 33, a resistance of the transistor as the pixel switching element for switching ON or OFF the applied signal from the signal line to the pixel increases with time from the beginning to the end of the application time on a single pixel. That is, the voltage of the scanning signal is large in the beginning of 1 H period and decreases toward the end of this period, thus increasing the resistance of the transistor with time. Note that, in the present embodiment, the output of the application, i.e., the voltage of the scanning signal, or the resistance of the transistor has two levels, which, however, may take multi-levels as well. Also, instead of the step form as shown in the drawings, a continuous form is also possible.

Figure 28:
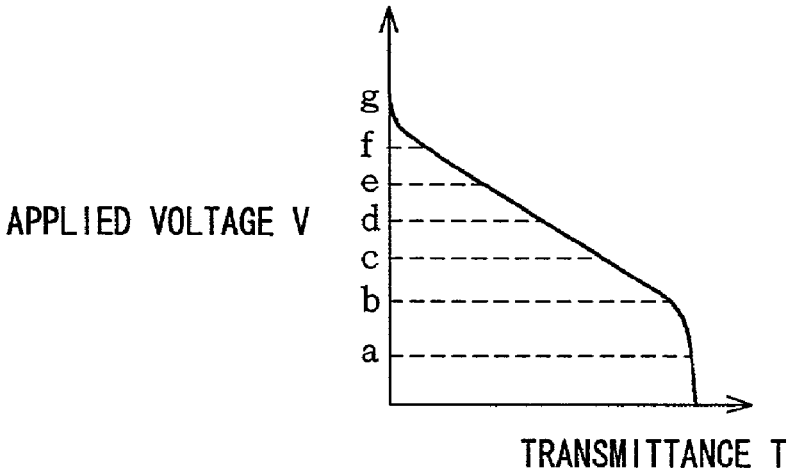
FIG. 28 is a graph showing a T-V curve of liquid crystal.
Figure 29:
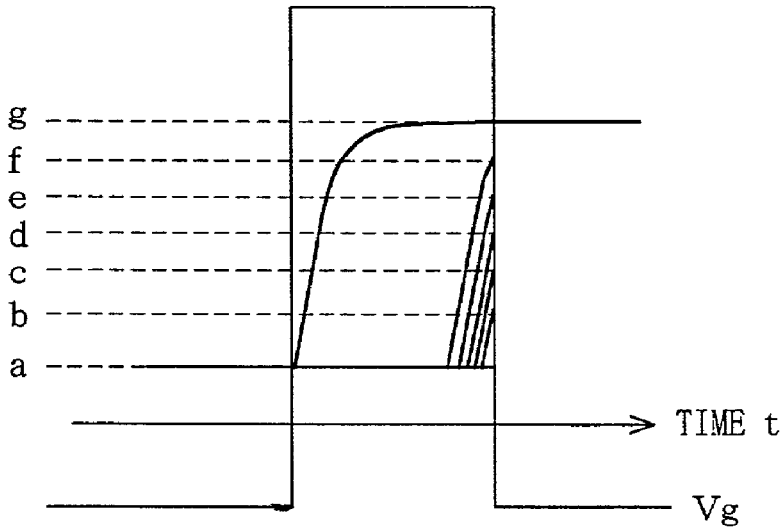
FIG. 29 is a graph showing tone characteristics of the pulse width modulation driving method when a source amplitude is nearly equal to that of a conventional voltage modulation driving method.

The following explains this in more detail. In general, the pulse width modulation driving method expresses tones by stopping charging pixels during charging. The resistance of transistors which are designed for the conventional voltage modulation driving method is too low for the pulse width modulation driving method, and, as shown in FIG. 28 and FIG. 29, it is required to have high resolution for the time when expressing tones on the low voltage side, making the tone expression difficult. FIG. 28 shows a T-V (transmittance-applied voltage) curve, and FIG. 29, corresponding to the curve of FIG. 28, shows tone characteristics (charging characteristics of a pixel) in the pulse width modulation driving method when the source amplitude is the same as that of the conventional voltage modulation driving method. That is, "a" through "g" of FIG. 28 correspond to "a" through "g" of FIG. 29. Here, FIG. 33 shows the case of the positive polarity as an example.

Figure 30:
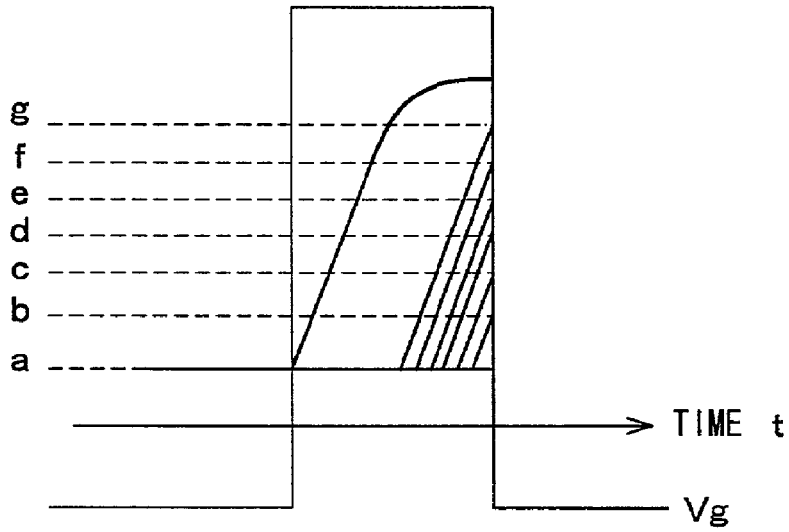
FIG. 30 is a graph showing tone characteristics of the pulse width modulation driving method when a source amplitude is larger than that of the conventional voltage modulation driving method.
Figure 31:
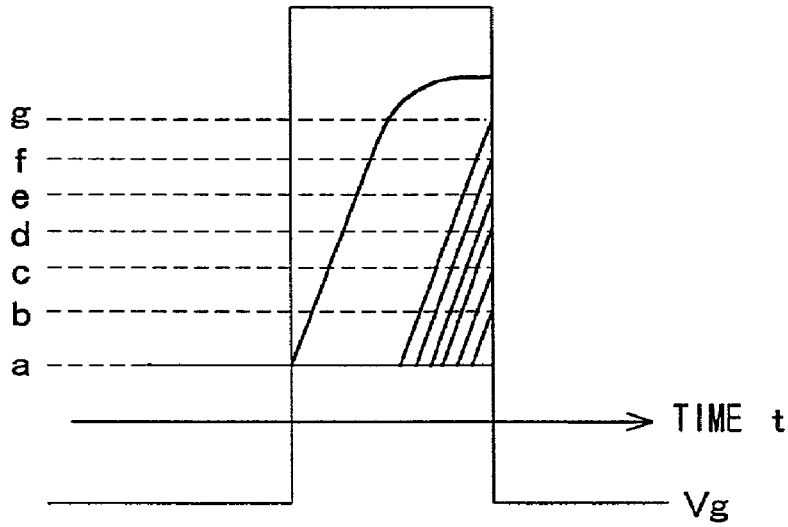
FIG. 31 is a graph showing tone characteristics of the pulse width modulation driving method in positive application when a source amplitude is larger than that of the conventional voltage modulation driving method.
Figure 32:
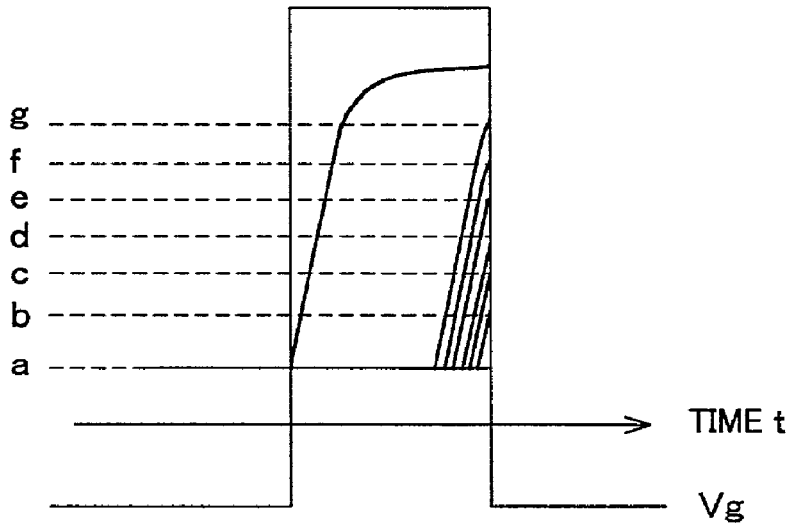
FIG. 32 is a graph showing tone characteristics of the pulse width modulation driving method in negative application when a source amplitude is larger than that of the conventional voltage modulation driving method.

In this case, as shown in FIG. 30, the voltage of the signal line may be increased to increase the time constant of the pixel application and to lower the application ability, so as to utilize intermediate voltages. This is shown in FIG. 31 and FIG. 32 which illustrate the cases of positive polarity and negative polarity, respectively. As can be seen from these drawings, in the conventional pulse width modulation driving method, the accuracy of time resolution which is required for the tone expression on the low voltage side is higher on the negative polarity.

Further, in the structure as shown in FIG. 33, the resistance of the transistor as the pixel switching element increases with time from the beginning to the end of the application time on a single pixel, requiring less accuracy for the time resolution which is needed for the expression of half tones in the pulse width modulation driving method. This makes it easier to express half tones on the low voltage side without increasing the voltage of the signal line. That is, a desirable multi-tone display can be realized while suppressing increase in power consumption in multi-tone image display devices which employ pulse width modulation driving.

Figure 34:
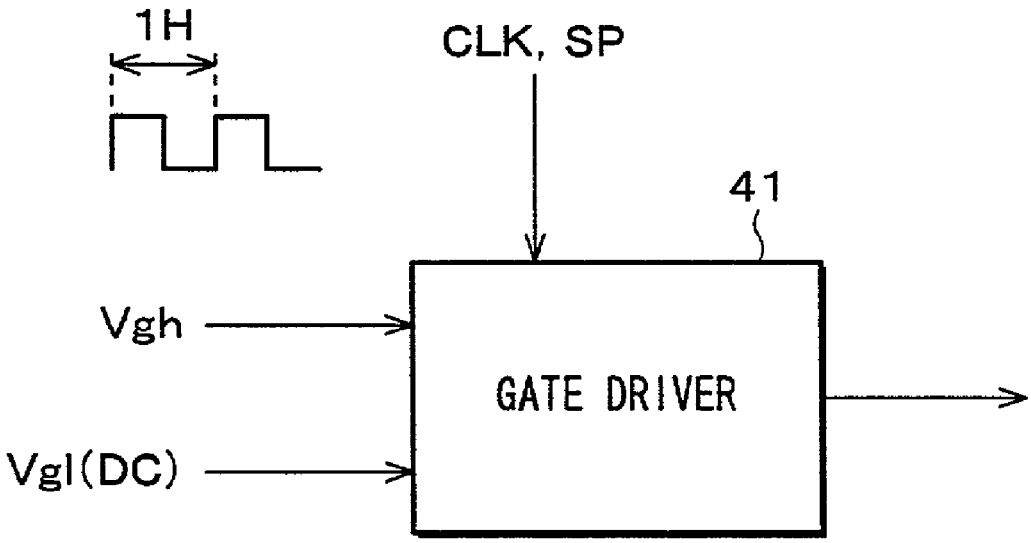
FIG. 34(*a*) is a block diagram showing an exemplary structure of a gate driver, and FIG. 34(*b*) is an explanatory drawing showing a waveform of a scanning line signal outputted from the gate driver.
Figure 34:
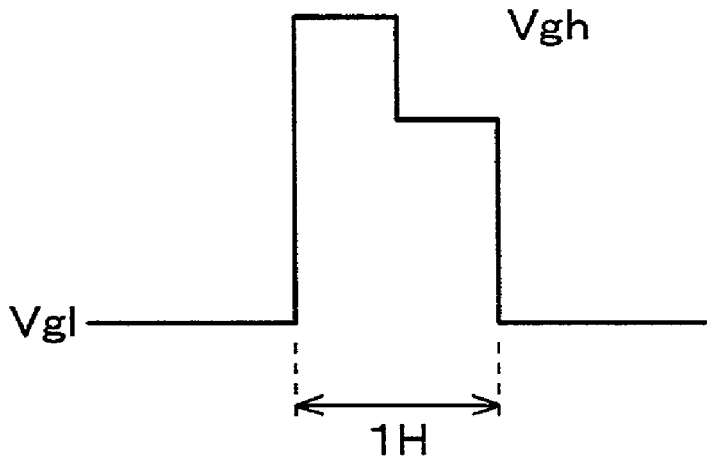

FIG. 34(*a*) and FIG. 34(*b*) shows an exemplary structure and explains how a voltage is decreased from the beginning to the end of an application time on a single pixel as in FIG. 41. As shown in FIG. 34(*a*), the gate driver 41 receives a DC voltage Vg1 and a rectangular voltage Vgh of a step form. The period of Vgh is made equal to one horizontal period. Also, the gate driver 41 receives a predetermined clock CLK and a start pulse SP for switching output in synchronization with the clock CLK at the timing indicated by data which is stored beforehand in a memory (not shown). As a result, as shown in FIG. 34(*b*), the gate driver 41 outputs Vg1 before input of the start pulse SP, and, after input of the start pulse SP, outputs Vgh until the next start pulse SP is inputted, i.e., until the end of one horizontal period in this example.

In this manner, the voltage of the scanning line can be decreased step-wise from the beginning to the end of one horizontal period, thus increasing the resistance of the transistor as the pixel switching element from the beginning to the end of one horizontal period. Note that, the example here is based on Vgh of the step form having two levels in one horizontal period, but the scanning line signal of the waveform as shown in FIG. 33 can be realized using a voltage Vgh of the step form having three levels in one horizontal period.

Figure 35:
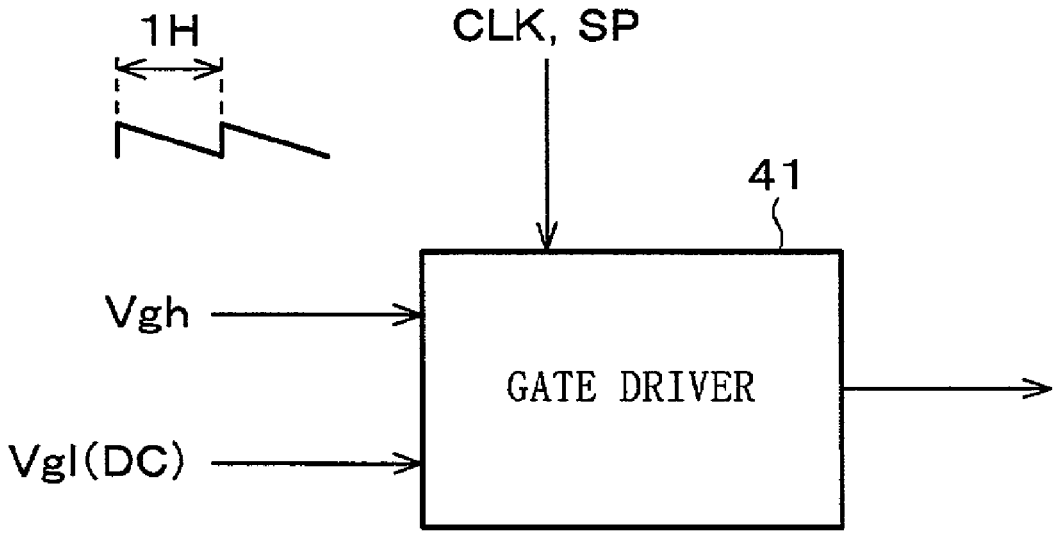
FIG. 35(*a*) is a block diagram showing an exemplary structure of a gate driver, and FIG. 35(*b*) is an explanatory drawing showing a waveform of a scanning line signal outputted from the gate driver.
Figure 35:
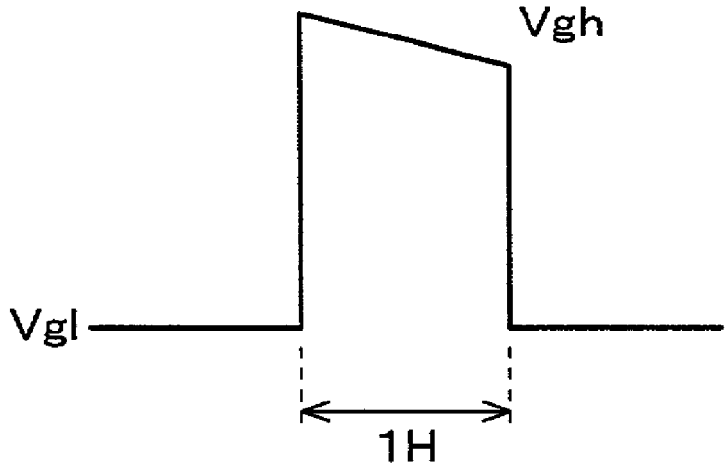

Further, instead of the step form, Vgh may be a voltage signal in the form of a saw tooth, for example, as shown in FIG. 35(*a*) and FIG. 35(*b*). In this way, the voltage of the scanning line can be decreased gradually from the beginning to the end of one horizontal period. As a result, the resistance of the transistor as the pixel switching element can be increased gradually from the beginning to the end of one horizontal period.

Incidentally, in general, in the pulse width modulation driving on a TFT-LCD, tones are expressed by stopping charging pixels during charging. Here, in order to improve reproduciability of tones, the initial state of applying an ON resistance to the transistor needs to be the same in every case. However, since the TFT is a three-terminal element, the resistance is changed by a relation of element potentials.

Therefore, respective potentials Vg, Vs, and Vd of the gate, source, and drain, and a threshold Vth of Vg are set so that source-drain voltage Vsd=Vd−Vs source-gate voltage Vgs=Vs−Vg drain-gate voltage Vgd=Vd−Vg.

Figure 36:
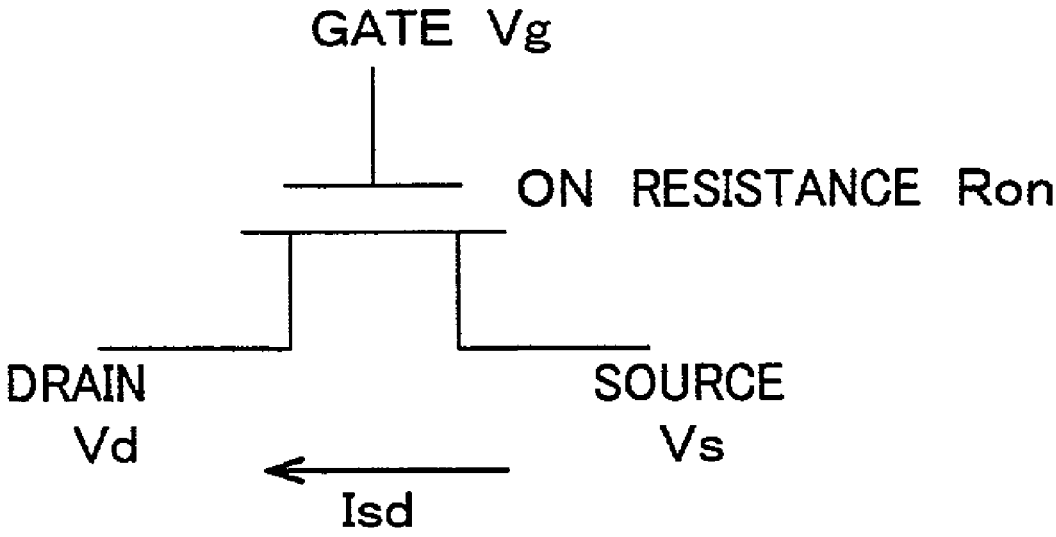
FIG. 36 is an explanatory drawing showing electrode structure s of a TFT.

Further, Vg>>Vth, and Vd>Vs, where W and L are the channel width and channel length of the transistor, Cox is the capacitance of a gate insulating film, and μ is the mobility. Here, the ON resistance of the transistor Ron can be approximated in the potential relation as shown in FIG. 36 as $$\mathrm{Ron}=Vsd/Isd \tag{1}$$

$$Isd=W/L\times\mu\times\mathrm{Con}\times((Vgs-Vth)\times Vsd-\tfrac{1}{2}\times Vsd^2) \tag{2}$$

Here, Isd is the source-drain current. Further, in FIG. 26, the gate, source, and drain are connected to the scanning line, signal line, and pixel electrodes, respectively.

Figure 37:
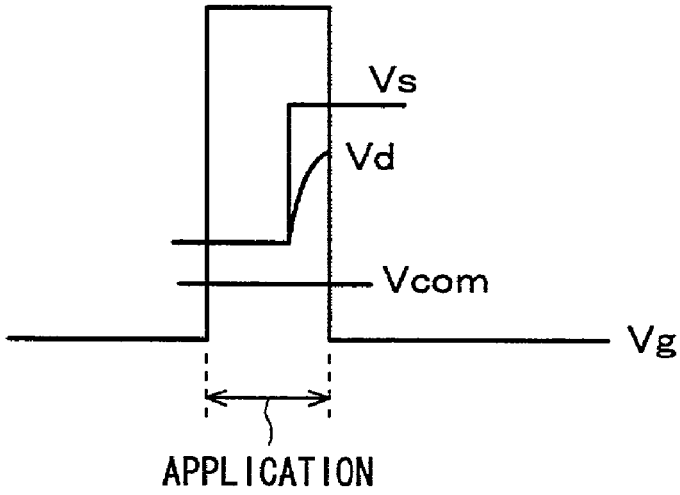
FIG. 37 is an explanatory drawing showing potential waveforms of the respective electrodes of the TFT in positive application.
Figure 38:
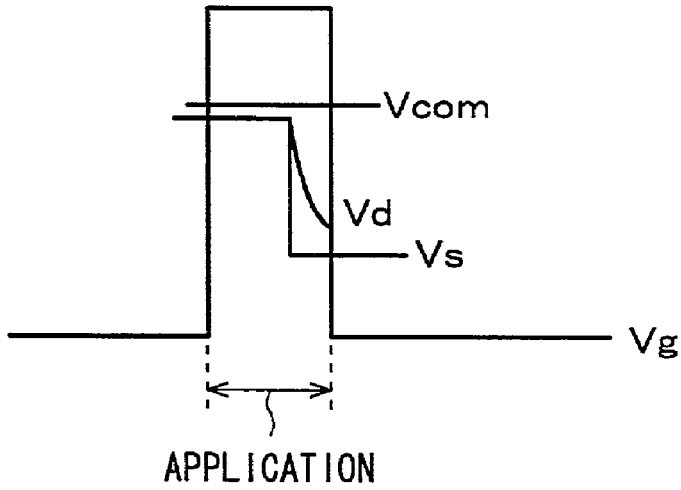
FIG. 38 is an explanatory drawing showing potential waveforms of the respective electrodes of the TFT in negative application.

The liquid crystal is AC driven to prevent image persistence and is generally applied with voltages of positive polarity and negative polarity even within a single signal. Here, as shown in FIG. 37 and FIG. 38, potential relations of the electrodes are different between the positive polarity and the negative polarity, and their Ron become different by Equations (1) and (2). Therefore, the positive polarity and the negative polarity have different application abilities. That is, in FIG. 37, an applied current $Isd_+$ is expressed by $$Isd_+=W/L\times\mu\times Con\times((Vgd-Vth)\times Vsd-\tfrac{1}{2}\times Vsd^2),$$

whereas in FIG. 38, an applied current Vsd_ is expressed by $$Isd_-=W/L\times\mu\times Con\times((Vgs-Vth)\times Vsd-\tfrac{1}{2}\times Vsd^2)$$

and the Ron are different between the two. Therefore, the application abilities are different between the positive polarity and the negative polarity and the applied potential is not the same at the same phase.

Figure 39:
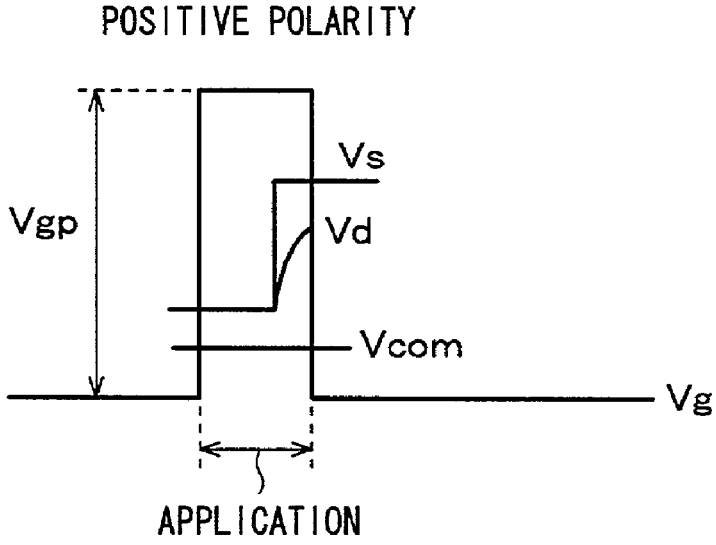
FIG. 39 is an explanatory drawing showing potential waveforms of the respective electrodes of the TFT in positive application of the present invention.
Figure 40:
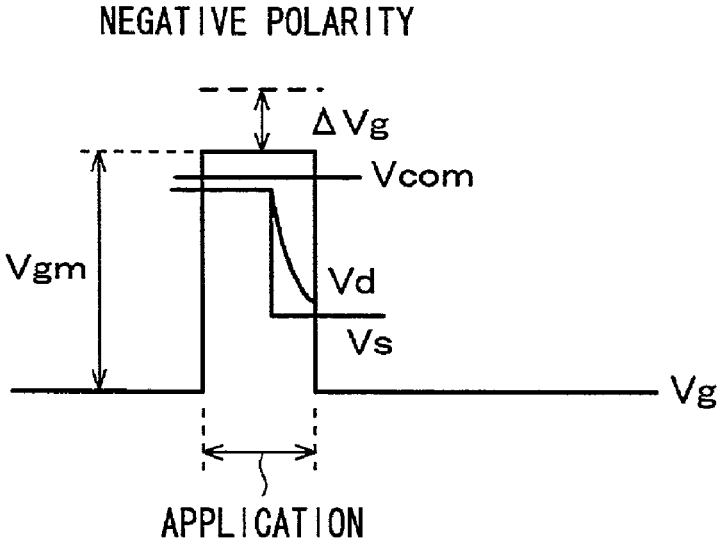
FIG. 40 is an explanatory drawing showing potential waveforms of the respective electrodes of the TFT in negative application of the present invention.

In contrast, in the present embodiment, as shown in FIG. 41, FIG. 39 and FIG. 40, the amplitudes of the signal lines are different between the positive application and the negative application, adapting to the alternating polarity of the applied voltage to the pixel per scanning line (polarity inversion). Thus, the scanning line voltage of the negative application is lower than the scanning line voltage of the positive application. That is, when their amplitudes are Vgp and Vgm, respectively, Vgp>Vgm, and ΔVg=Vgp−Vgm>0. Here, the applied current $Isd_+$ is $$Isd_+=W/L\times\mu\times Con\times((Vgd-Vth)\times Vsd-\tfrac{1}{2}\times Vsd^2),$$

and the applied current $Isd_{2-}$ is $$Isd_{2-}=W/L\times\mu\times Con\times((Vgs-Vth)\times Vsd-\tfrac{1}{2}\times Vsd^2),$$

and therefore $$|Isd_{2-}-Isd_+|<|Isd_--Isd_+|.$$

Note that, it is preferable that the difference in amplitude (Vgp−Vgm) be equal to the amplitude of the common voltage Vcom, since this makes it unnecessary to provide an additional element for creating the difference.

The foregoing signal waveforms and timings allow two-value output signal driving which is capable of high quality display, thus obtaining a liquid crystal display device with still lower power consumption.

[Third Embodiment]

The following will describe still another embodiment of the present invention with reference to FIG. 41, FIG. 42, and FIG. 44 through FIG. 46. Note that, for convenience of explanation, elements having the same function as those described in the drawings of the foregoing embodiments are given the same reference numerals and explanations thereof are omitted here.

The present embodiment is basically the same as the Second Embodiment and the following will focus on mainly those elements which are different from the Second Embodiment.

Figure 44:
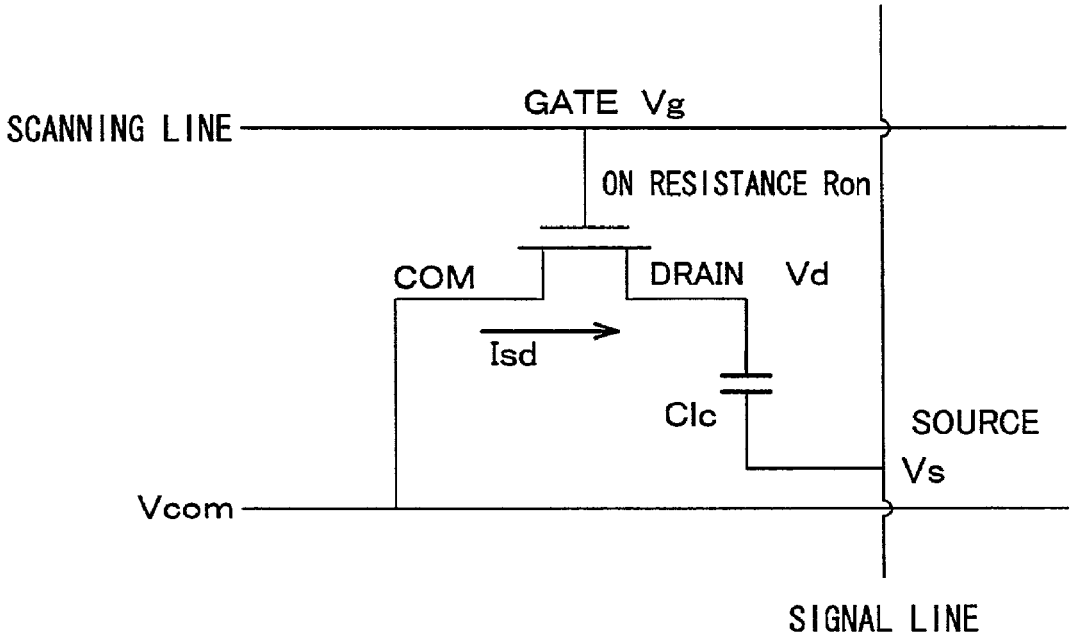
FIG. 44 is a circuit diagram showing an equivalent circuit of a unit pixel.

FIG. 44 is a circuit diagram of a single pixel (unit pixel) of a panel of a liquid crystal display device (TFT-LCD) as an image display device of the present embodiment. A group of such a pixel is disposed in a matrix pattern. In this example, a plurality of signal lines are connected to pixel switching elements via pixel electrodes, and the pixel switching elements are switched ON or OFF by scanning lines. Comparing the equivalent circuit diagram with that of the Second Embodiment as shown in FIG. 18, the signal line and the common electrode are switched in position, and accordingly waveforms of the respective signals are slightly different.

Figure 46:
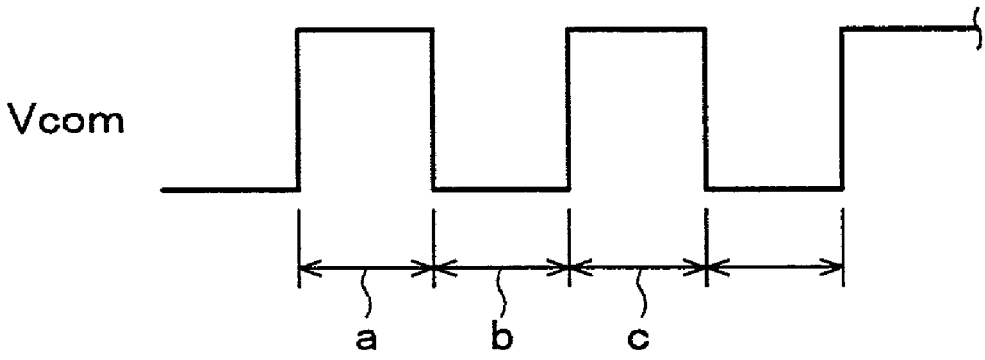
FIG. 46(*a*) and FIG. 46(*b*) are timing charts showing signal waveforms of a common voltage, in which (a) is a timing chart in a vertical period $VT_1$; and (b) is a timing chart in a vertical period $VT_2$.
Figure 46:
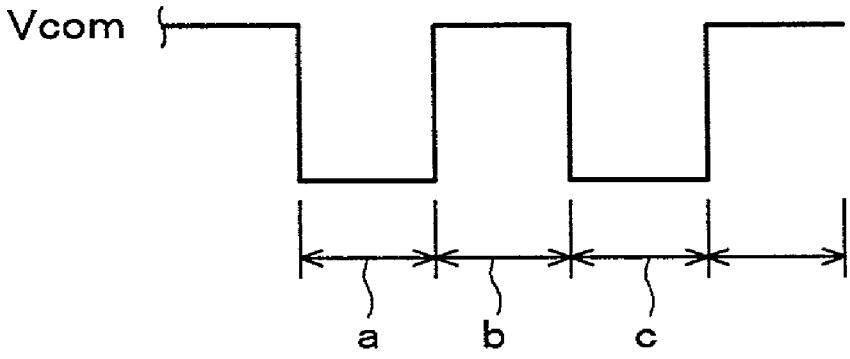

That is, in the present embodiment, a scanning line voltage Vg is applied as shown in FIG. 41 in the same manner as the Second Embodiment, but a signal line voltage Vs and a common voltage Vcom are applied as shown in FIGS. 45(*a*) and 45(*b*) and FIGS. 46(*a*) and 46(*b*), respectively. In the drawings, the horizontal axis indicates time and the vertical axis indicates potential. Namely, the polarities of the signal line voltage Vs and the common voltage Vcom are opposite to their counterparts of the Second Embodiment.

The other structure remains the same from the Second Embodiment. A superimposed view of these signals is shown in FIG. 24, except that order of scanning Vg1 and Vg2 is switched, and thus explanations thereof are omitted here.

Note that, the foregoing example displays tones by charging in every horizontal period, but tone can also be displayed by discharging. In this case, the scanning line voltage Vg, the signal line voltage Vs, and the common voltage Vcom are applied as shown in FIG. 41, FIGS. 42(*a*) and 42(*b*), and FIGS. 46(*a*) and 46(*b*), respectively. Further, a superimposed view of these signals is shown in FIG. 25, except that order of scanning Vg1 and Vg2 is switched, and thus explanations thereof are omitted here.

[Fourth Embodiment]

The following will describe yet another embodiment of the present invention with reference to FIG. 18, FIG. 41, FIG. 42, and FIG. 47. Note that, for convenience of explanation, elements having the same function as those described in the drawings of the foregoing embodiments are given the same reference numerals and explanations thereof are omitted here.

A circuit diagram of a single pixel (unit pixel) of a panel of a liquid crystal display device (TFT-LCD) as an image display device of the present embodiment is the same as that of the Second Embodiment and is as shown in FIG. 18. A group of such a unit pixel is disposed in a matrix pattern.

Figure 47:
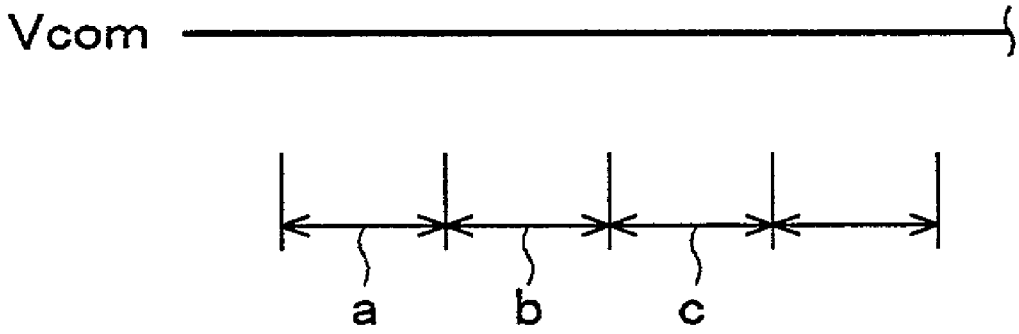
FIG. 47(*a*) and FIG. 47(*b*) are timing charts showing signal waveforms of a common voltage, in which (a) is a timing chart in a vertical period $VT_1$; and (b) is a timing chart in a vertical period $VT_2$.
Figure 47:
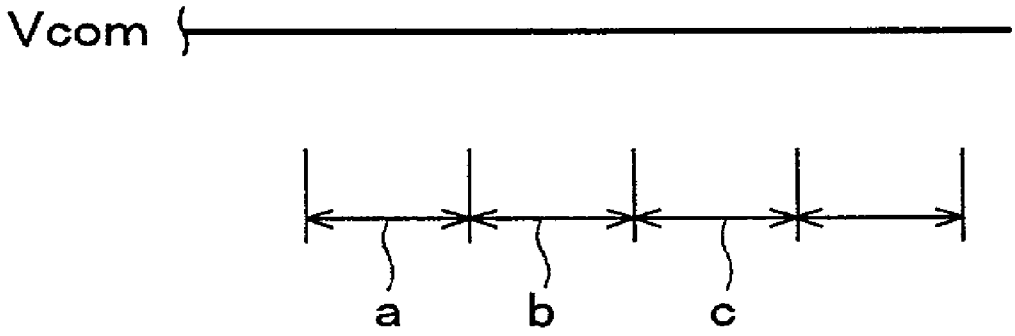

In the present embodiment, a scanning line voltage Vg and a signal line voltage Vs are applied as shown in FIG. 41 and FIGS. 42(*a*) and 42(*b*), respectively, in the same manner as the Second Embodiment, but a common voltage Vcom is applied as shown in FIGS. 47(*a*) and 47(*b*). In the drawings, the horizontal axis indicates time and the vertical axis indicates potential. That is, the common voltage is a direct current.

Figure 48:
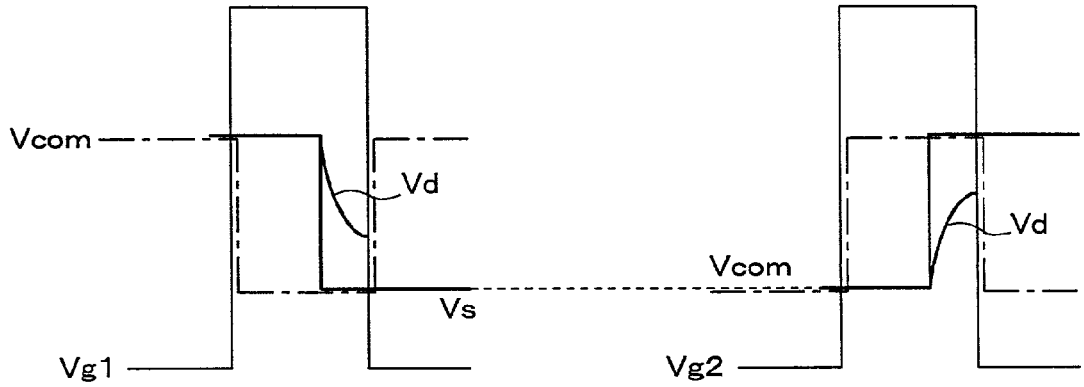
FIG. 48 is an explanatory drawing showing waveforms of respective signals of an arbitrary pixel when carrying out a tone display by charging in dot inversion driving.

FIG. 48 shows a superimposed view of these signals. That is, FIG. 48 shows how a voltage is applied to an arbitrary pixel when displaying tones by charging and discharging. Vs is a voltage of the signal line. Vcom is a voltage of the common electrode, which is an AC voltage. Vg1 is a voltage of an arbitrary scanning line in a certain horizontal period, and Vg2 is a voltage of the next scanning line of Vg1 in the next horizontal period. Vd is a drain potential of a TFT as the pixel switching element.

For a brief moment after Vg1 becomes High (ON) level, Vs is at the same potential as Vcom (Low level). Thus, at the beginning of one horizontal period, the potential difference between the signal line potential and the common electrode potential is minimum. As a result, the potential Vd of the drain decreases, and accordingly the liquid crystal capacitance of the pixel is discharged at the maximum level. Thereafter, after an elapsed time period which varies depending on the tone, Vs becomes High. As a result, at the end of one horizontal period (at the time of application), the potential difference between the signal potential and the common electrode potential becomes maximum. With this increase in potential difference, the potential Vd of the drain increases in the positive direction, and the liquid crystal capacitance of the pixel is charged accordingly. When Vg1 becomes Low level (OFF), the potential Vd of the drain stops increasing, and the charging of the liquid crystal capacitance of the pixel comes to halt as a result. Thereafter, Vcom becomes High level, obtaining the same potential as Vs.

In the next horizontal period after Vg1 becomes Low level (OFF) in the described manner, Vg2 becomes High level (ON). For a brief moment after Vg2 becomes High (ON) level, Vs is at a potential (High level) where Vg1 became Low level (OFF). Thus, at the beginning of one horizontal period, the potential difference between the signal line potential and the common electrode potential is maximum. As a result, the potential Vd of the drain increases in the positive direction by the amount of this potential difference, and accordingly the liquid crystal capacitance of the pixel is charged at the maximum level. Thereafter, after an elapsed time period which varies depending on the tone, Vs becomes the same potential (Low) as Vcom. As a result, at the end of one horizontal period (at the time of application), the potential difference between the signal potential and the common electrode potential becomes minimum. With this decrease in potential difference, the potential Vd of the drain decreases, and the liquid crystal capacitance of the pixel is discharged accordingly. When Vg1 becomes Low level (OFF), the potential Vd of the drain stops decreasing, and the discharge of the liquid crystal capacitance of the pixel comes to halt as a result.

In this manner, the polarity of the potential of the signal line is inverted between a certain horizontal period and the next horizontal period, and when tones are displayed by charging in a certain horizontal period, the next horizontal period displays tones by discharging.

As with the Second Embodiment, scanning is carried out in a time sequential manner. Further, tones are realized by shifting waveform phases of the signal line and the scanning line. Also, the polarities of pixels in the signal line direction are inverted alternately.

Further, unlike the Second Embodiment, the signal line is driven by dot inversion, wherein the polarity is inverted alternately between adjacent pixels.

Further, as with the Second Embodiment, the phase of the common electrode (common voltage) remains the same at any tone. Also, the polarity of the signal line is inverted once in an absolute manner within one horizontal period.

As with the Second Embodiment, the voltage of the scanning signal is large in the beginning of 1 H period and decreases toward the end of this period, thus increasing the resistance of the transistor with time. Also, in the present embodiment, the output of the application has two levels, which, however, may take multi-levels as well. Also, instead of the step form as shown in the drawings, a continuous form is also possible.

As with the Second Embodiment, the scanning line voltage is lower on the negative application than the positive application, adapting to the alternating polarity of the applied voltage to the pixel per scanning line (polarity inversion).

The foregoing signal waveforms and timings allow two-value output signal driving which is capable of high quality display, thus obtaining a liquid crystal display device with still lower power consumption.

[Fifth Embodiment]

The following will describe still another embodiment of the present invention with reference to FIG. 42, FIG. 44, FIG. 47, and FIG. 49. Note that, for convenience of explanation, elements having the same function as those described in the drawings of the foregoing embodiments are given the same reference numerals and explanations thereof are omitted here.

A circuit diagram of a single pixel (unit pixel) of a panel of a liquid crystal display device as an image display device of the present embodiment is as shown in FIG. 44 as with the Third Embodiment. A group of such a unit pixel is disposed in a matrix pattern.

Figure 49:
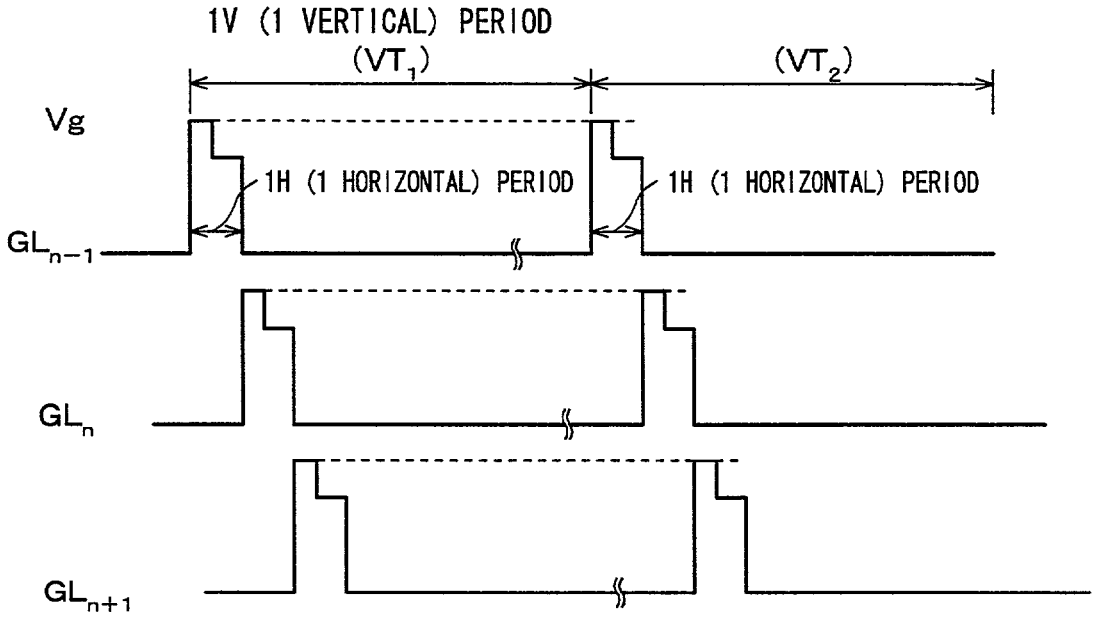
FIG. 49 is a timing chart showing signal waveforms of the gate potential.

In the present embodiment, a signal line voltage Vs and a common voltage Vcom are applied as shown in FIGS. 42(*a*) and 42(*b*) and FIGS. 47(*a*) and 47(*b*), respectively, in the same manner as the Fourth Embodiment, but a scanning line voltage Vg is applied as shown in FIG. 49. In the drawings, the horizontal axis indicates time and the vertical axis indicates potential. That is, unlike the Second through Fourth Embodiments, the scanning line voltage of the negative application is the same as the scanning line voltage of the positive application.

As with the Second Embodiment, scanning is carried out in a time sequential manner. Further, tones are realized by shifting waveform phases of the signal line and the scanning line. Also, the polarities of pixels in the signal line direction are inverted alternately.

Further, as with the Fourth Embodiment, the signal line is driven by dot inversion, wherein the polarity is inverted alternately between adjacent pixels.

Further, as with the Second Embodiment, the phase of the common electrode (common voltage) remains the same at any tone. Also, the polarity of the signal line is inverted once in an absolute manner within one horizontal period.

As with the Second Embodiment, the voltage of the scanning signal is large in the beginning of 1 H period and decreases toward the end of this period, thus increasing the resistance of the transistor with time. Further, in the present embodiment, the output of the application has two levels, which, however, may take multi-levels as well. Also, instead of the step form, a continuous form is also possible.

The foregoing signal waveforms and timings allow two-value output signal driving which is capable of high quality display, thus obtaining a liquid crystal display device with still lower power consumption.

Note that, the foregoing operations can be realized by suitably adjusting the pulse width modulation driving (PWM), i.e., a circuit which carries out driving for controlling an applied voltage to the pixel electrodes in a conduction period of the pixel switching elements according to a pulse width which is supplied to the signal lines.

In general, PWM refers to driving whereby a width itself of a discrete pulse is shortened or extended, but the present invention employs a broader definition of pulse width modulation driving (PWM), including driving by modulation of a pulse width by way of modulating a phase difference in waveform between the scanning line and the signal line (gist of the present invention).

Figure 50:
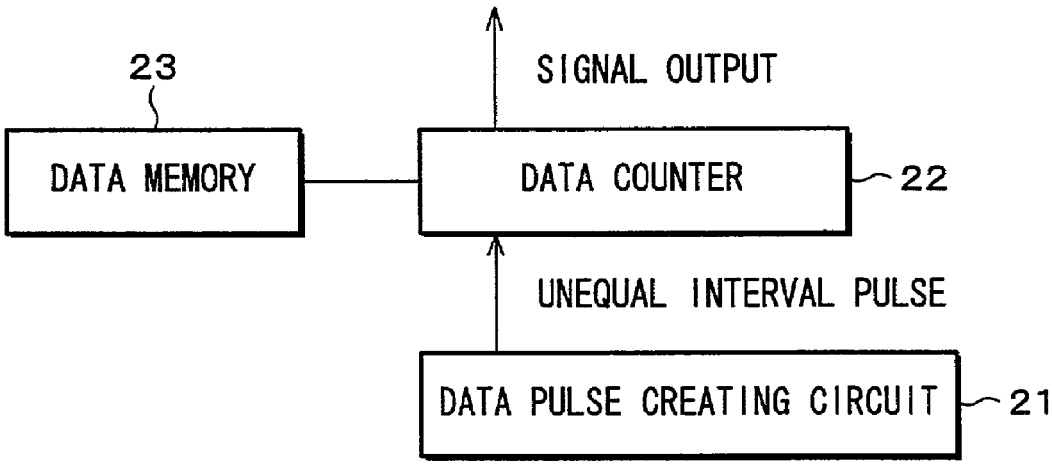
FIG. 50 is a block diagram showing an exemplary structure of a circuit for outputting signals of signal lines.

Such pulse width modulation driving is carried out, as shown in FIG. 50, by the provision of a data pulse creating circuit 21 for converting pulses of equal intervals (e.g., 25 MHz in the case of VGA), which are used for a dot clock, into pulses of unequal intervals, which have been subjected to γ correction or which have been corrected to adapt to application characteristics and the like of the pixels.

When the output has n tone levels, n pulses of unequal intervals are used in 1 H period (one horizontal period). The pulses of unequal intervals are sent to a signal line driver (signal line driving circuit), which is an image signal output driver, and are counted by a data counter 22 therein. The number stored in the counter is compared with the number indicative of output data which is stored in a data memory 23, and when there is a match, the output signal is switched from an OFF potential to an ON potential. The data of the counter is reset and becomes 0 when a horizontal synchronize signal is detected, and the output signal becomes an OFF potential as well.

In order to hold the applied voltage to the pixel electrodes below the level of the supplied voltage to the signal line, it is required to set a high voltage value for the signal line driving voltage by the signal line driver. The pixels on the activematrix substrate are designed in such a way that the transistor size or pixel capacitance is set to have a time constant which holds the charging rate below 100 percent during a predetermined gate ON time, and therefore the applied voltage to the pixels does not reach the voltage value which is set for the signal line driving voltage, even when the counter indicates zero and the pulse width supplied to the signal line extends over the entire conduction period of the switching elements. The extent to which the set value of the signal line driving voltage is increased is determined so that the pixel voltage takes a predetermined value as its maximum value.

Further, in order to change the proportion of the maximum value of the applied voltage to the pixel electrodes with respect to the supplied voltage to the signal line depending on the polarity of the applied voltage to the pixel electrode, the voltage value set for the signal line driving voltage is set according to the polarity of the applied voltage to the pixel electrodes. For example, the foregoing voltage value is set both for the positive polarity and the negative polarity by such a measure as resistance division, and these voltage values are switched in synchronization with a clock signal which indicates a polarity inversion timing. Here, as with the foregoing case, and with respect to each of the positive polarity and the negative polarity, the extent to which the set value of the signal line driving voltage is increased is determined so that the pixel voltage takes a predetermined value as its maximum value.

Further, in order to change the supplied pulse width to the signal lines in a conduction period of the pixel switching elements depending on the polarity of the applied voltage to the pixel electrodes even when displaying the same tone, the clock generating circuit and the counter are provided both for the positive polarity and the negative polarity, and they are switched in synchronization with a clock signal which indicates a polarity inversion timing.

Further, in order to change an allocation time for a single scanning line depending on the polarity of the applied voltage to the pixel electrodes, such a measure is taken as to suitably change a duty ratio of a clock having predetermined intervals for deciding a duration of one horizontal period. To this end, the horizontal synchronize signal is prepared as a pulse which is generated at unequal intervals, and the pulse intervals are changed according to the polarity of the applied voltage to the pixels.

Further, with respect to the image display device including the common electrode for applying a common potential to all pixels, and a plurality of scanning lines for driving the pixel switching elements, in order to perform display by displacing the liquid crystal according to a potential difference between the common electrode and the pixel electrodes so that the amplitude of the voltage supplied to the signal line is equal to the amplitude of the voltage supplied to the common electrode, the same power circuit is used for the signal line driver and the counter electrode.

Further, in the circuit for performing the pulse width modulation driving, in order to realize the phase shift in waveform between the signal lines and the scanning lines by switching an ON potential and an OFF potential per 1 H period, and to display tones by shifting the waveforms of the signal lines and the scanning lines, and to invert the polarities of pixels in the signal line direction alternately, the pulse width modulation driving is carried out while performing the one horizontal period inversion driving or dot inversion driving. In this way, for example, the voltage becomes High (OFF) and Low (ON) in a certain horizontal period and becomes Low (High) and High (ON) in the next horizontal period, and therefore there is no polarity inversion at the border of the two horizontal periods since the voltage remains at Low level at the border. Thus, unlike the conventional method in which the voltage is inverted twice within one horizontal period at the beginning of the horizontal period and the middle of the horizontal period where the voltage is switched from High level to Low level, the frequency of the signal line driving voltage will not be increased.

Here, in the one horizontal period inversion driving, since the phase of the common electrode is always constant with respect to the scanning signal, it can be said that tones are displayed by shifting the signal line and the common electrode in phase of their waveforms.

Further, the potential difference between the signal line and the common electrode may be minimum at the beginning of one horizontal period, and the potential difference between the signal line and the common electrode may be maximum at the end of one horizontal period. Alternatively, the potential difference between the signal line and the common electrode may be maximum at the beginning of one horizontal period, and the potential difference between the signal line and the common electrode may be minimum at the end of one horizontal period.

Further, in order to change the amplitude of the scanning line between the positive application and the negative application, for example, a voltage value of one polarity is generated from the voltage value of the other polarity by such a measure as resistance division.

Further, in order to for the difference in amplitude of the voltages supplied to the scanning lines to be equal to the amplitude of the voltage supplied to the common electrode, the voltage which corresponds to the difference created by the resistance division is used as the applied voltage to the common electrode.

Further, in order to increase the resistance of the transistor with time from the first half to the latter half of the application time on a single pixel, the gate voltage of the transistor is reduced with time.

In order to vary the resistance of the transistor by varying the gate voltage, the gate voltage of the transistor is reduced with time. To this end, e.g., to reduce the gate voltage step-wise, a plurality of predetermined voltage values are set, for example, by the resistance division, and the voltage values are switched at the timing utilizing a clock which is obtained by suitably dividing the clock for determining a duration of one horizontal period. Further, in order to cause continuous reduction, a differentiating circuit is added to the circuit which produces an ON voltage of the gate voltage.

As described, the image display device in accordance with the present invention may have an arrangement, in the image display device which includes at least a plurality of pixel electrodes which are formed on a substrate, pixel switching elements which are individually connected to the pixel electrodes, and a plurality of signal lines which are connected to the pixel electrodes via the pixel switching elements, and which controls a voltage applied to the pixel electrodes in a conduction period of the pixel switching elements according to a pulse width supplied to the signal lines, wherein the voltage applied to the pixel electrodes is less than a voltage supplied to the signal lines.

Further, in addition to the foregoing arrangement, the image display device of the present invention may have an arrangement wherein the maximum value of the voltage applied to the pixel electrodes is not less than 80 percent and not more than 90 percent of the voltage supplied to the signal lines.

This prevents the pulse intervals from becoming too small even in multi-tone display devices, thus preventing change in tone level due to external factors such as increased power consumption, and temperature.

Further, in addition to the foregoing arrangement, the image display device of the present invention may have an arrangement wherein a proportion of the maximum value of the voltage applied to the pixel electrodes with respect to the voltage supplied to the signal lines becomes different depending on a polarity of the voltage applied to the pixel electrodes.

This makes it possible to obtain a desired charge voltage irrespective of the switching elements which vary according to the polarity of the applied voltage. Further, it is also possible to take measure against the common problem of the activematrix liquid crystal display devices that the capacitance in part of the liquid crystal layer becomes different depending on a displayed tone, which results in change in optimum counter voltage.

Further, the image display device of the present invention may have an arrangement, in the liquid crystal display device which includes a plurality of pixel electrodes which are formed on a substrate, pixel switching elements which are individually connected to the pixel electrodes, a plurality of signal lines for driving the pixel switching elements, and a plurality of signal lines which are connected to the pixel electrodes via the pixel switching elements, and which carries out display by controlling an applied voltage to the pixel electrodes in a conduction period of the pixel switching elements according to a pulse width supplied to the signal lines and by displacing liquid crystal according to a potential difference between the common electrode and the pixel electrodes, wherein the voltage applied to the pixel electrodes is set to be less than the voltage supplied to the signal lines, and an amplitude of the voltage supplied to the signal lines is equal to an amplitude of the voltage supplied to the common electrode.

This allows the power circuit of the signal line driver to be the same as that of the counter electrode, thus reducing loss in creating power. Conventionally, supply from the same power circuit was impossible, even when the signal lines and the counter electrode had the same amplitude, due to a difference in DC level by the common problem of the activematrix liquid crystal display devices that the capacitance in part of the liquid crystal layer becomes different depending on a displayed tone, which results in change in optimum counter voltage. In contrast, the foregoing arrangement can overcome this deficiency by setting the applied voltage to the pixel electrodes less than the voltage supplied to the signal lines, and by setting the proportion with respect to the supplied voltage to the signal lines to be different depending on a polarity of the voltage applied to the pixel electrodes.

Further, the driving method of an image display device of the present invention, in the driving method of the liquid crystal display device which includes a plurality of pixel electrodes which are formed on a substrate, pixel switching elements which are individually connected to the pixel electrodes, a plurality of scanning lines for driving the pixel switching elements, and a plurality of signal lines which are connected to the pixel electrodes via the pixel switching elements, and which carries out display by controlling an applied voltage to the pixel electrodes in a conduction period of the pixel switching elements according to a pulse width supplied to the signal lines, and by displacing liquid crystal according to a potential difference between the common electrode and the pixel electrodes, wherein the supplied pulse width to the signal lines in the conduction period of the pixel switching elements becomes different depending on a polarity of the voltage applied to the pixel electrodes.

This makes it possible to take measure against the common problem of the activematrix liquid crystal display devices that the capacitance in part of the liquid crystal layer becomes different depending on a displayed tone, which results in change in optimum counter voltage.

Further, the driving method of an image display device of the present invention, in the driving method of the liquid crystal display device which includes a plurality of pixel electrodes which are formed on a substrate, pixel switching elements which are individually connected to the pixel electrodes, a plurality of scanning lines for driving the pixel switching elements, and a plurality of signal lines which are connected to the pixel electrodes via the pixel switching elements, and which carries out display by controlling an applied voltage to the pixel electrodes in a conduction period of the pixel switching elements according to a pulse width supplied to the signal lines, and by displacing liquid crystal according to a potential difference between the common electrode and the pixel electrodes, wherein an allocated time for a single scanning line is different for each polarity of the voltage applied to the pixel electrodes.

This makes it possible to obtain a desired charge voltage irrespective of the switching elements which vary according to the polarity of the applied voltage. Further, it is also possible to take measure against the common problem of the activematrix liquid crystal display devices that the capacitance in part of the liquid crystal layer becomes different depending on a displayed tone, which results in change in optimum counter voltage. Further, an optimum time period can be allocated for the positive application and the negative application within a limited time period which is determined by the operating frequency of the display device, thus making it easier to prevent pulse intervals from becoming too small even in multi-tone display devices and preventing change in tone level due to external factors such as increase in power consumption, and temperature.

Further, the driving method of an image display device of the present invention may have an arrangement, in the driving method of the image display device for a TFT-LCD, i.e., a liquid crystal display device adopting the TFT (thin-film-transistor) system which display tones by modulating a pulse width of a two-value voltage supplied to the signal lines, wherein tones are displayed by shifting phases of waveforms of the signal lines and scanning lines, and polarities of pixels in a signal line direction are inverted alternately.

Further, the driving method of an image display device of the present invention may have an arrangement, in the driving method of the image display device for a TFT-LCD which display tones by modulating a pulse width of a two-value voltage supplied to the signal lines, wherein the phase of the common electrode is the same at any tone.

Further, the driving method of an image display device of the present invention may have an arrangement, in the driving method of the image display device for a TFT-LCD which display tones by modulating a pulse width of a two-value voltage supplied to the signal lines, wherein an amplitude of the scanning lines is varied between positive application and negative application.

Further, in addition to the foregoing arrangement, the driving method of the image display device of the present invention may have an arrangement wherein a difference in amplitude of the voltage supplied to the scanning lines is equal to the amplitude of the voltage supplied to the common electrode.

Further, the driving method of an image display device of the present invention may have an arrangement, in the driving method of the image display device for a TFT-LCD which display tones by modulating a pulse width of a two-value voltage supplied to the signal lines, wherein a resistance of a transistor is increased with time from the beginning to the end of an application time of a single pixel.

Further, in addition to the foregoing arrangement, the driving method of the image display device of the present invention may have an arrangement wherein the resistance of the transistor is varied by varying the gate voltage.

Further, in addition to the foregoing arrangement, the driving method of the image display device of the present invention may have an arrangement wherein the polarity of the signal lines is inverted once in an absolute manner within one horizontal period.

As described in the foregoing First through Fifth Embodiments, the driving method of an image display device of the present invention is for an image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, the method controlling a voltage applied to the pixel electrodes in a conduction period of the pixel switching elements according to a pulse width supplied to the signal lines, wherein the voltage applied to the pixel electrodes is less than a voltage supplied to the signal lines.

Further, the driving method of an image display device of the present invention, in the foregoing method, may be adapted so that a proportion of the maximum value of the voltage applied to the pixel electrodes with respect to the voltage supplied to the signal lines becomes different depending on a polarity of the voltage applied to the pixel electrodes.

Generally, when transistors are used as the pixel switching elements, charging characteristics such as the charging rate become different depending on a polarity of the applied voltage. In the case as shown in FIG. 61, the polarity acts to reduce the gate voltage in a relative manner as the application of the voltage to the pixels proceeds, whereas in the case as shown in FIG. 62, the pixel potential is brought up to a higher potential with respect to the gate potential and as a result the ON resistance of the transistor is reduced at an increasing rate as the application of the voltage to the pixels proceeds, thus rapidly charging the pixels.

On the other hand, in the foregoing method, the proportion of the maximum value of the applied voltage to the pixel electrodes with respect to the supplied voltage to the signal lines varies depending on a polarity of the applied voltage to the pixel electrodes.

Thus, when transistors are used as the pixel switching elements, a desired charge voltage can be obtained at either polarity by varying the proportion according to the slope of charging characteristics which is determined by the polarity of the applied voltage, thus obtaining a desired charge voltage irrespective of charging characteristics of the pixel switching elements which are decided by the polarity of the applied voltage.

Further, the common problem of the activematrix liquid crystal display devices is that the capacitance in part of the liquid crystal layer becomes different depending on a displayed tone, which results in change in optimum counter voltage. Even in this case, a desired charge voltage can be obtained irrespective of the difference in optimum counter voltage due to displayed tone.

Further, the driving method of an image display device of the present invention, in the foregoing method, may be adapted so that, even when displaying the same tone, the pulse width of the supplied voltage to the signal lines in the conduction period of the pixel switching elements becomes different depending on a polarity of the applied voltage to the pixel electrodes.

With this method, even when displaying the same tone, the pulse width of the supplied voltage to the signal lines in the conduction period of the pixel switching elements becomes different depending on a polarity of the applied voltage to the pixel electrodes. Therefore, when transistors are used as the pixel switching elements, a desired charge voltage can be obtained at either polarity by varying the pulse width according to a slope of charging characteristics which is determined by the polarity of the applied voltage, thereby obtaining a desired charge voltage irrespective of charging characteristics of the pixel switching elements which are decided by the polarity of the applied voltage.

Further, the driving method of an image display device, in the foregoing method, may be adapted so that an allocated time for a single scanning line is different for each polarity of the voltage applied to the pixel electrodes.

With this method, an allocated time for a single scanning line is different for each polarity of the voltage applied to the pixel electrodes. Thus, when transistors are used as the pixel switching elements, a desired charge voltage can be obtained at either polarity by varying the allocation time for a single scanning line according to a slope of charging characteristics which is determined by the polarity of the applied voltage, thereby obtaining a desired charge voltage irrespective of the charging characteristics of the pixel switching elements which are decided by a polarity of the applied voltage.

Further, the common problem of the activematrix liquid crystal display devices is that the capacitance in part of the liquid crystal layer becomes different depending on a displayed tone, which results in change in optimum counter voltage. Even in this case, a desired charge voltage can be obtained irrespective of the difference in optimum counter voltage due to displayed tone.

Further, an optimum time period can be allocated for the positive application and the negative application within a limited time period which is determined by the operating frequency of the display device, thus making it easier to prevent required pulse intervals from becoming too small at high tone levels. As a result, it is possible to realize more desirable multi-tone display while suppressing increase in power consumption in multi-tone image display devices which employ pulse width modulation driving.

Further, the driving method of an image display device of the present invention, in the foregoing method, may be adapted so that, with respect to an image display device having a common electrode for applying a common potential to pixels and having a plurality of scanning lines for driving the pixel switching elements, liquid crystal is displaced according to a potential difference between the common electrode and the pixel electrodes so as to carry out display, and an amplitude of the voltage supplied to the signal lines is equal to an amplitude of the voltage supplied to the common electrode.

According to this method, an amplitude of the voltage supplied to the signal lines is equal to an amplitude of the voltage supplied to the common electrode.

Conventionally, supply from the same power circuit was impossible, even when the signal lines and the counter electrode (common electrode) had the same amplitude, due to a difference in DC (direct current) level by the common problem of the activematrix liquid crystal display devices that the capacitance in part of the liquid crystal layer becomes different depending on a displayed tone, which results in change in optimum counter voltage.

In contrast, in the method of the present invention, the applied voltage to the pixel electrodes is set to be less than the voltage supplied to the signal lines. Therefore, even when the optimum counter voltage is changed by the displayed tone in a black display, i.e., in a state where the pixels are charged to a high potential, one only needs to set a charging rate which takes into account this change, and no problem will be posed even when the voltage is supplied from the same power circuit. Thus, in addition to the effects by the foregoing arrangements, since the power circuit of the signal line driver can be made the same as that of the counter electrode, a loss in creating a voltage can be reduced.

Further, the driving method of an image display device of the present invention, in addition to the foregoing arrangement, may be adapted so that the maximum value of an amplitude of a voltage applied to the pixel electrodes is not less than 80 percent and not more than 98 percent of an amplitude of a voltage supplied to the signal lines.

According to this method, the maximum value of an amplitude of a voltage applied to the pixel electrodes is not less than 80 percent and not more than 98 percent of an amplitude of a voltage supplied to the signal lines. Thus, it is possible to omit the area of markedly poor efficiency where there is no substantial increase in pixel voltage as a function of charging time, and where an increase in transmittance of the liquid crystal with respect to an increase in pixel potential is small. As a result, the linearity of the charging characteristics can be improved, in addition to the effect by the foregoing arrangement.

Further, the driving method of an image display device of the present invention may be adapted to apply a voltage between a potential of signal lines and a potential of common electrode when a potential of scanning lines is ON, and display tones by modulating a pulse width of a two-value voltage supplied to the signal lines, wherein tones are displayed by shifting phases of waveforms of the signal lines and the scanning lines, and polarities of pixels in a signal line direction are inverted alternately.

Further, the driving method of an image display device of the present invention may be adapted to apply a voltage between a potential of signal lines and a potential of a common electrode when a potential of scanning lines is ON, and displays tones by modulating a pulse width of a two-value voltage supplied to the signal lines, wherein tones are displayed by shifting phases of waveforms of the signal lines and the common electrode, and polarities of pixels in a signal line direction are inverted alternately.

Further, the driving method of an image display device of the present invention may be adapted so that the waveform (driving waveform) of the common electrode is off-phase by a certain degree with respect to the waveform (driving waveform) of the scanning lines.

According to this method, the waveform of the common electrode is off-phase by a certain degree with respect to the waveform of the scanning lines. Thus, the phase of the waveform of the signal lines can be shifted with respect to a selected waveform of either the scanning lines or the common electrode when displaying tones.

The certain degree of phase difference may be set to 0, i.e., the waveform phase of the common electrode and the waveform phase of the scanning lines are exactly in-phase. Further, taking into consideration a delay in scanning signals, the waveform phase of the common electrode may be slightly delayed, instead of exactly in-phase, with respect to the waveform phase of the scanning lines.

Further, the driving method of an image display device of the present invention may be adapted, in the foregoing method, so that a potential difference between a potential of the signal lines and a potential of the common electrode is maximum at the end of one horizontal period.

According to this method, a potential difference between a potential of the signal lines and a potential of the common electrode is maximum at the end of one horizontal period. Thus, charging of the pixel electrodes proceeds toward the end of one horizontal period before it stops with OFF of the scanning line signal, thereby controlling the potential of the pixel electrodes at the end of one horizontal period, i.e., tones, by varying the level of charging. As a result, tones can be displayed with a simpler arrangement.

Further, the driving method of an image display device of the present invention may be adapted, in the foregoing method, so that a potential difference between a potential of the signal lines and a potential of the common electrode is minimum at the end of one horizontal period.

According to this method, a potential difference between a potential of the signal lines and a potential of the common electrode is maximum at the end of one horizontal period. Thus, discharging of the pixel electrodes proceeds toward the end of one horizontal period before it stops with OFF of the scanning line signal, thereby controlling the potential of the pixel electrodes, i.e., tones, at the end of one horizontal period by varying the level of discharging. As a result, tones can be displayed with a simpler arrangement.

Further, a driving method of an image display device of the present invention is adapted to apply a voltage between a potential of the signal lines and a potential of the common electrode when a potential of scanning lines is ON, and display tones by modulating a pulse width of a two-value voltage supplied to the signal lines, wherein an amplitude of a voltage supplied to the scanning lines is varied between positive application and negative application.

Further, the driving method of an image display device of the present invention may be adapted, in the foregoing method, so that a difference in amplitude of the voltage supplied to the scanning lines is equal to an amplitude of the voltage supplied to the common electrode.

According to this method, the difference in amplitude of the voltage supplied to the scanning lines is equal to the amplitude of the voltage supplied to the common electrode, and thus it is not required to create an additional power voltage. Thus, in addition to the effects by the foregoing arrangements, increase in number of components and power consumption can be suppressed.

Further, a driving method of an image display device of the present invention is adapted to apply a voltage between a potential of the signal lines and a potential of the common electrode when a potential of scanning lines is ON, and display tones by modulating a pulse width of a two-value voltage supplied to the signal lines, wherein a resistance of a transistor is increased with time from the beginning to the end of an application time of a single pixel.

Further, the driving method of an image display device of the present invention, in the foregoing method, may be adapted so that the resistance of the transistor is varied by varying the gate voltage.

According to this method, the resistance of the transistor is varied by varying the gate voltage, and thus it is not required to newly create elements for varying the resistance of transistors. Thus, in addition to the effects by the foregoing arrangements, increase in number of components and power consumption can be suppressed.

Note that, for example, in the foregoing arrangements, the phase of the common electrode may be the same at any tone. Also, for example, in the foregoing arrangements, the polarity of the signal lines may be inverted only once in an absolute manner within one horizontal period.

Further, a driving device of an image display device of the present invention is for an image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, the driving device applying a voltage between a potential of the signal lines and a potential of the common electrode when a potential of scanning lines is ON, and displaying tones by modulating a pulse width of a two-value voltage supplied to the signal lines, wherein the driving device includes a signal line driving section for supplying a signal, which is created by shifting a phase of a voltage waveform whose polarity is inverted per one horizontal period, according to tone data of the display image, with respect to a phase of a voltage waveform of the scanning lines, to the signal lines.

With this arrangement, tones are displayed by shifting the phases of waveforms of the signal lines and the scanning lines, and the polarities of pixels in a signal line direction are inverted alternately. Thus, any tone can be expressed without increasing the frequency of the signal lines. As a result, it is possible to realize a desirable multi-tone display while suppressing increase in power consumption in a multi-tone image display device for employs the pulse width modulation driving.

Further, a driving device of an image display device of the present invention is for an image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, the driving device applying a voltage between a potential of the signal lines and a potential of the common electrode when a potential of scanning lines is ON, and displaying tones by modulating a pulse width of a two-value voltage supplied to the signal lines, wherein the driving device includes a signal line driving section for supplying a signal, which is created by shifting a phase of a voltage waveform whose polarity is inverted per one horizontal period, according to tone data of the display image, with respect to a phase of a voltage waveform of the common electrode, to the signal lines.

With this arrangement, tones are displayed by shifting the phases of waveforms of the signal lines and the common electrode, and the polarities of pixels in a signal line direction are inverted alternately. Thus, any tone can be expressed without increasing the frequency of the signal lines. As a result, it is possible to realize a desirable multi-tone display while suppressing increase in power consumption in a multi-tone image display device for employs the pulse width modulation driving.

[Sixth Embodiment]

The following will describe yet another embodiment of the present invention with reference to FIG. 51 through FIG. 58. Note that, for convenience of explanation, elements having the same functions as those described in the drawings of the foregoing embodiments are given the same reference numerals and explanations thereof are omitted here.

Figure 51:
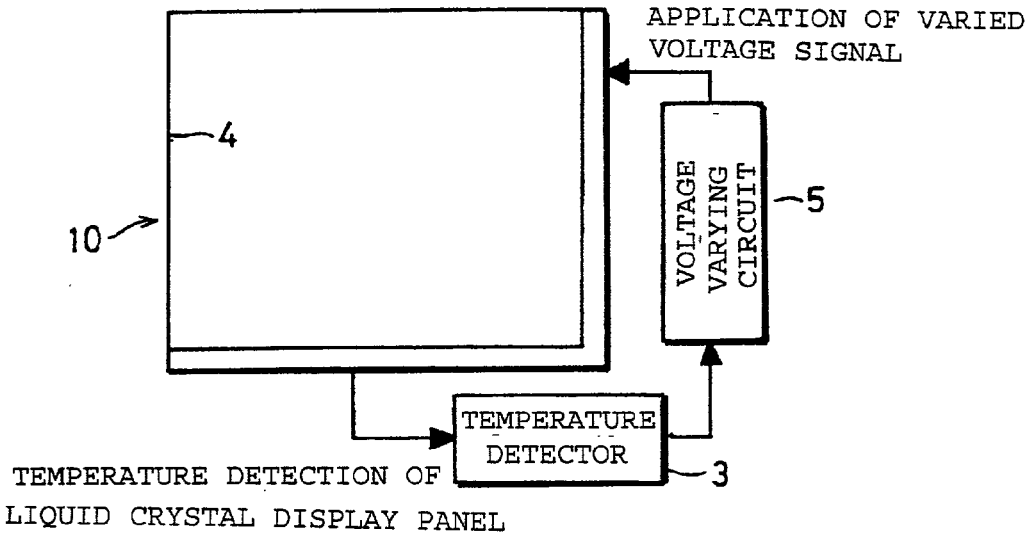
FIG. 51 is a schematic diagram showing a liquid crystal display device in accordance with one embodiment of the present invention.

FIG. 51 is a schematic diagram showing a liquid crystal display device 10 in accordance with one embodiment of the present invention. The liquid crystal display device 10 includes a liquid crystal display panel 4 which is made up of a pair of substrates and a liquid crystal placed therebetween, a temperature detector 3 for detecting temperature of the liquid crystal display panel 4, and a voltage varying circuit 5 for applying a driving voltage to the liquid crystal display panel 4.

The liquid crystal display device 10 is an activematrix liquid crystal display device, and includes thin-film transistor (TFT) elements as the active elements. The active elements such as the TFT elements change their electrical characteristics in response to change in temperature.

The temperature detector 3 detects temperature of the liquid crystal display panel 4. The detected temperature is transferred to the voltage varying circuit 5. The voltage varying circuit 5 varies signals for driving the liquid crystal display panel 4 in accordance with the temperature detected by the temperature detector 3.

The following describes a liquid crystal driving system for the liquid crystal display device 10 based on an example of phase modulation driving, in which a display shows a sensitive change in response to a change in temperature characteristics of the TFT elements. In the liquid crystal display panel having the TFT elements, the TFT elements are disposed at the intersections of the signal lines and the scanning lines which are disposed in a matrix pattern, and the gate, source, and drain of the TFT elements are connected to the scanning lines, signal lines, and liquid crystal capacitance, respectively. In this liquid crystal panel, when the gate electrode is in a selected state, the transistor is conducted and video signals of the signal lines are applied on the liquid crystal capacitance. When the gate electrode is in a non-selected state, the transistor takes high impedance to prevent video signals of the signal lines from leaking into the liquid crystal capacitance.

Figure 66:
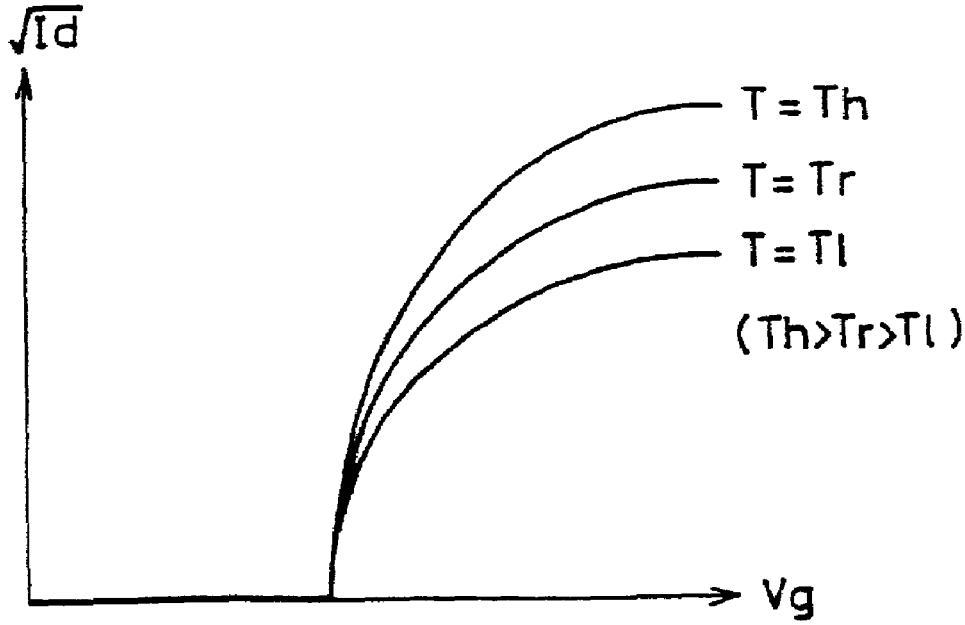
FIG. 66 is a graph showing temperature dependence of Vg-$\sqrt{}$Id characteristics of a TFT (a-Si).
Figure 67A:
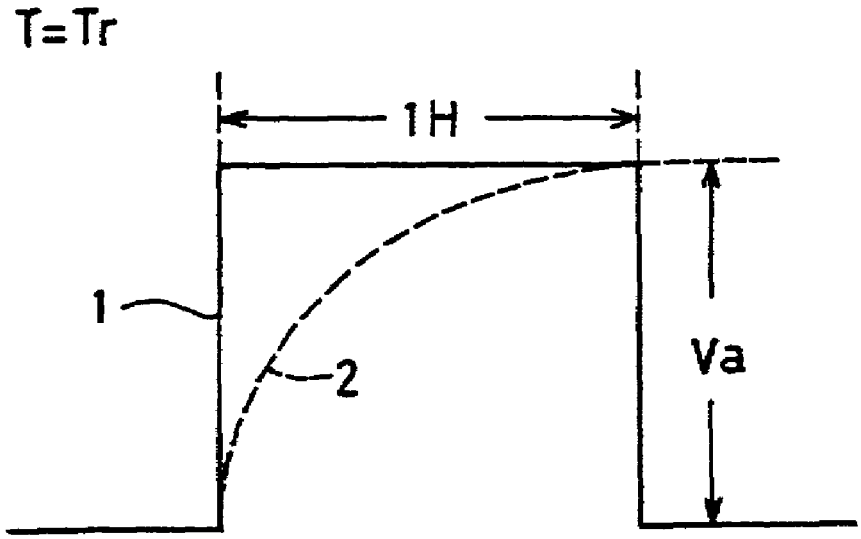
FIG. 67(*a*) and FIG. 67(*b*) are graphs showing a change in tone signal and drain voltage in voltage variance driving, in which (a) shows the case where temperature T=Tr (at room temperature); and (b) shows the case where temperature T=Th (increased temperature).
Figure 67B:
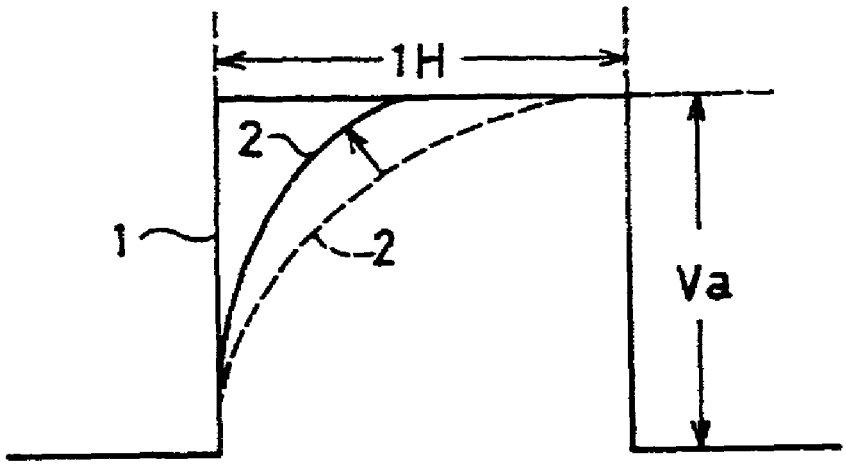
Figure 68A:
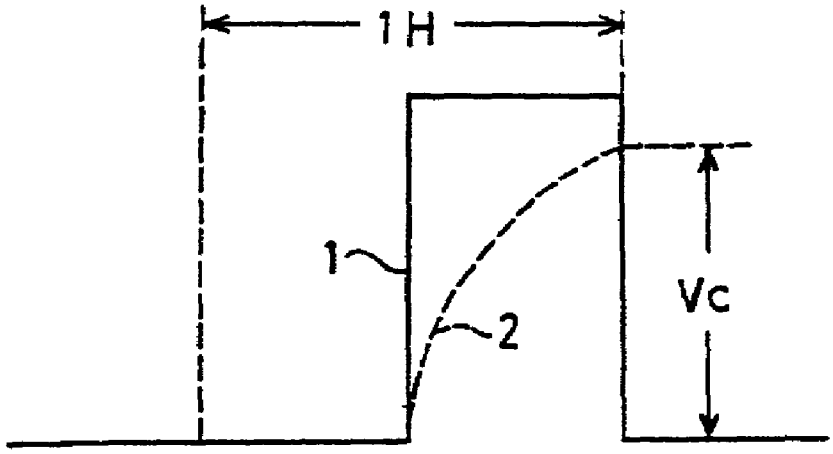
FIG. 68(*a*) and FIG. 68(*b*) are graphs showing a change in tone signal and drain voltage in phase modulation driving, in which (a) shows the case where temperature T=Tr (at room temperature); and (b) shows the case where temperature T=Th (increased temperature).
Figure 68B:
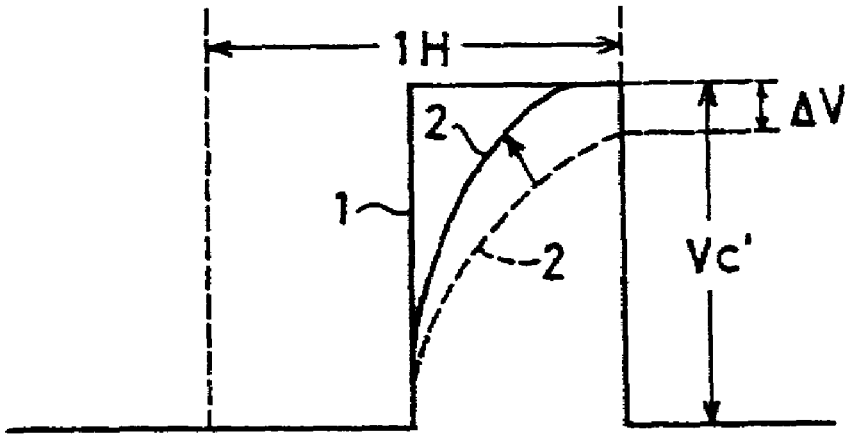

As described above with reference to FIG. 66, the drain current flown into the TFT increases with increase in temperature. The increased flow of the drain current means an increased current flow into the liquid crystal. The result is an abrupt increase in drain voltage with respect to an input signal, having an adverse effect on the liquid crystal display panel. If a change in temperature results in change in current flow, one can take a measure of changing the input signal in such a manner as to compensate for a change in current flow.

Figure 52:
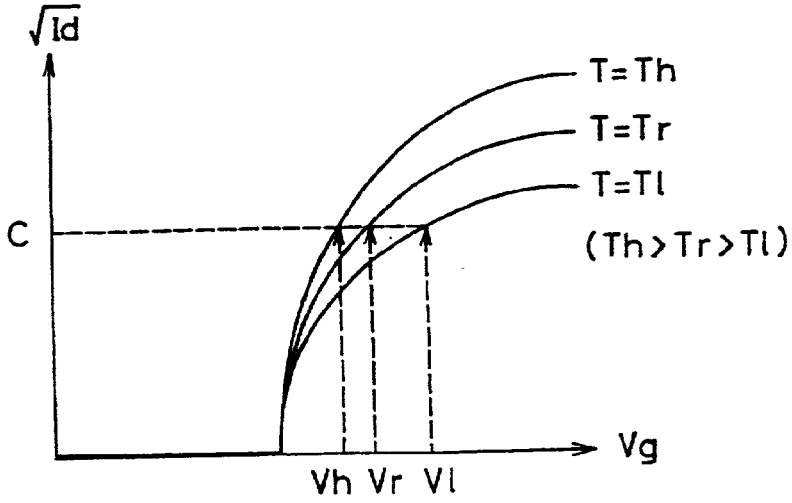
FIG. 52 is a graph showing temperature dependence of Vg-$\sqrt{}$Id characteristics of a TFT (a-Si).

The following considers a driving method for changing an applied voltage Vg of a scanning signal according to a temperature change of the liquid crystal display panel. FIG. 52 is a graph which shows temperature dependence of Vg-$\sqrt{Id}$ characteristics of a TFT (a-Si), where Vg indicates a voltage applied to the gate electrode of the TFT element, and Id indicates drain current. As can be seen from FIG. 52, in order to constantly supply a constant current flow $\sqrt{Id}=c$ to the drain electrode with respect to temperature change, one only needs to change the scanning signal voltage Vg according to the temperature. That is, when temperatures Th, Tr, and Tl are related by Th>Tr>Tl, and when the scanning signal voltage Vg=Vr and √Id=C at temperature Tr, √Id=C by the scanning signal voltage Vg=Vh (Vh<Vr) at temperature Th, and √Id=C by the scanning signal voltage Vg=Vl (Vr<M) at temperature Tl, thus holding the drain current constant irrespective of the temperature.

Figure 53A:
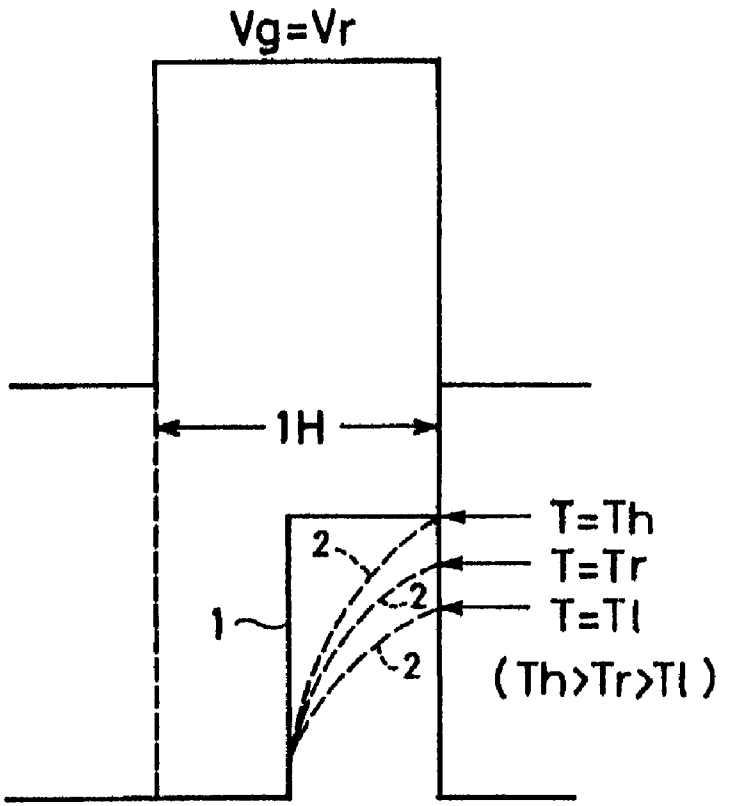
FIG. 53(*a*) is a graph showing an input waveform of a tone signal (in half-tone display) and a change in drain voltage at temperatures Th, Tr, and Tl under constant scanning signal voltage, and FIG. 53(*b*) is a graph showing a change in drain voltage at temperatures Th, Tr, and Tl when the scanning signal voltage is varied according to temperature.
Figure 53B:
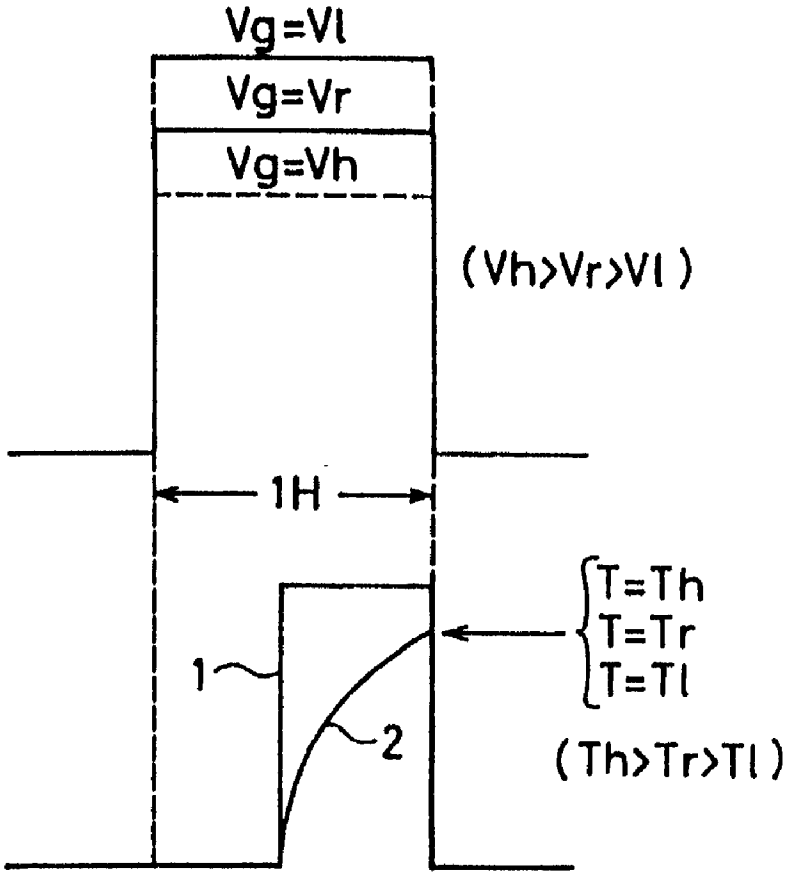

FIG. 53(*a*) is a graph which shows an input waveform of a tone signal (in half-tone display) under a constant scanning signal voltage Vg, and a change in drain voltage at temperatures Th, Tr, and Tl. It can be seen from FIG. 53(*a*) that the TFT characteristics change according to temperature, and how the current flow into the drain, i.e., a rise of the drain voltage, changes.

FIG. 53(*b*) is a graph which shows a change in drain voltage when the scanning signal voltage Vg is varied with temperature. As shown in FIG. 53(*b*), the temperature dependance of the rise of the drain voltage can be eliminated by controlling the current flow into the drain electrode at a constant value by varying the scanning signal voltage Vg to Vh, Vr, and to Vl according to temperature. As a result, it is possible to realize a liquid crystal display panel which does not show a change in display due to temperature change.

This driving is also effective in panels which employ the voltage modulation driving, but is especially effective in the phase modulation driving in which a display shows a sensitive change with respect to a change in temperature characteristics of the active elements in particular. Further, since the driving voltage in tone display takes only two values in the phase modulation driving, there will be no significant loss in step-up or step-down of the voltage, thus driving the liquid crystal display panel with low power consumption.

Figure 54A:
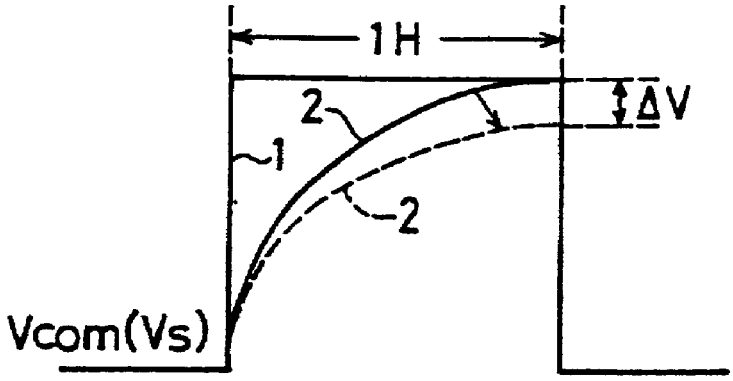
FIG. 54(*a*) through FIG. 54(*c*) are graphs explaining a driving method of changing an applied voltage Vcom of a common signal or an applied voltage Vs of a tone signal according to a temperature change of the liquid crystal display panel, in which (a) shows an input signal and a drain voltage by rectangular wave 1 and curve 2, respectively; (b) shows a voltage applied to a counter electrode; and (c) shows a voltage applied to a drain electrode.
Figure 54B:
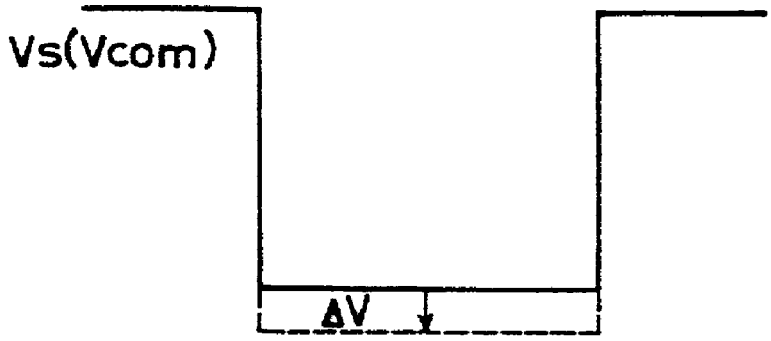
Figure 54C:
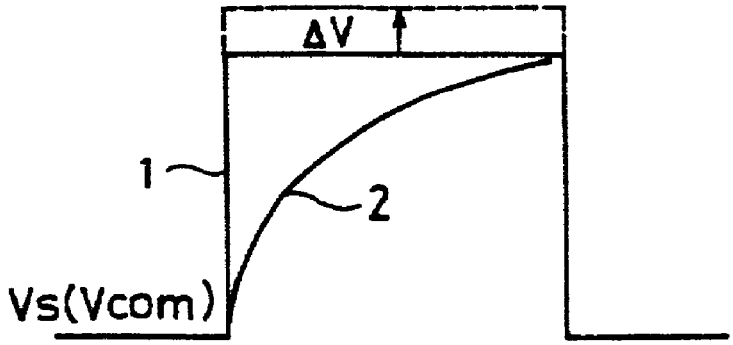

The following considers a driving method in which an applied voltage Vcom of a common signal or an applied voltage Vs of a tone signal is changed according to a change in temperature in the liquid crystal display panel. FIG. 54(*a*) through FIG. 54(*c*) are graphs for explaining the driving method of changing the applied voltage Vcom of a common signal or the applied voltage Vs of a tone signal. In FIG. 54(*a*), a signal indicated by a rectangular signal 1 is an input signal, and a signal indicated by a curve 2 is a drain voltage. As shown in FIG. 54(*a*), the characteristics of the TFT element vary, for example, with decrease in temperature of the panel, and the current flow into the drain electrode decreases, thus reducing a potential of the drain electrode.

FIG. 54(*b*) is a graph explaining the driving method of changing a voltage applied to the counter electrode according to a change in temperature of the liquid crystal display panel. First, the following considers applying the tone signal voltage Vs to the drain electrode and applying the common signal voltage Vcom to the counter electrode. For example, when the potential of the drain electrode drops by ΔV from Vs with decrease in temperature of the liquid crystal display panel, the common signal voltage Vcom applied to the counter electrode is decreased by ΔV as shown in FIG. 54(*b*) so as to hold the potential difference of the liquid crystal constant irrespective of the temperature change, thereby carrying out temperature compensation of the TFT element.

This driving has the advantage of setting a lower voltage for the voltage to be varied because the applied voltage Vcom of the common signal is lower than the scanning signal voltage.

The following considers applying the common signal voltage Vcom to the drain electrode and the tone signal voltage Vs to the counter electrode. As with the foregoing case, the characteristics of the TFT element vary according to a temperature change of the liquid crystal display panel, and the potential of the drain electrode changes. Here, for example, when the potential of the drain electrode drops by ΔV from Vcom with decrease in temperature of the liquid crystal display panel, the tone signal voltage Vs applied to the counter electrode is decreased by ΔV as shown in FIG. 54(*b*) so as to hold the potential difference of the liquid crystal constant irrespective of the temperature change, thereby carrying out temperature compensation of the TFT element.

When carrying out this driving in the voltage variance driving, in which each tone has its own tone voltage, temperature compensation can be performed by utilizing this pre-set tone voltage, without newly creating a voltage for the temperature compensation, when varying the tone signal voltage Vs according to temperature.

As described, temperature compensation of the TFT element can be carried out by varying the applied voltage to the counter electrode according to temperature, thus realizing a liquid crystal display panel which does not show change is display due to temperature change.

Further, the method of varying the applied voltage to the counter electrode is also effective in panels employing the voltage variance driving, but is especially effective in the phase modulation driving in which a display shows a sensitive change with respect to change in temperature characteristics of the active element in particular. Further, since the driving voltage in tone display only takes two values in the phase modulation driving, there will be no significant loss in step-up or step-down of the voltage, thus driving the liquid crystal display panel with low power consumption.

FIG. 54(*c*) is a graph explaining the driving method of changing the applied voltage to the drain electrode according to a temperature change of the liquid crystal display panel. First, the following considers applying the tone signal voltage Vs to the drain electrode and applying the common signal voltage Vcom to the counter electrode. For example, when the potential of the drain electrode is expected to drop by ΔV from Vs with decrease in temperature of the liquid crystal display panel, the voltage applied as the tone signal is increased by ΔV as shown in FIG. 54(*c*) so as to hold the potential difference of the liquid crystal constant irrespective of the temperature change, thereby carrying out temperature compensation of the TFT element.

When carrying out this driving in the voltage variance driving in which each tone has its own tone voltage, temperature compensation can be performed by utilizing this pre-set tone voltage, without newly creating a voltage for the temperature compensation, when varying the tone signal voltage Vs according to temperature.

The following considers applying the common signal voltage Vcom to the drain electrode and applying the tone signal voltage Vs to the counter electrode. As with the foregoing case, the characteristics of the TFT element vary according to a temperature change of the liquid crystal display panel, and the potential of the drain electrode varies. Here, for example, when the potential of the drain electrode is expected to drop by ΔV from Vm with decrease in temperature of the liquid crystal display panel, the voltage applied as the common signal is increased by ΔV as shown in FIG. 54(*c*) so as to hold the potential difference of the liquid crystal constant irrespective of the temperature change, thereby carrying out temperature compensation of the TFT element.

This driving has the advantage of setting a lower voltage for the voltage to be varied because the applied voltage Vcom of the common signal is lower than the scanning signal voltage.

As described, temperature compensation of the TFT element can be carried out by varying the applied voltage to the drain electrode according to temperature, thus realizing a liquid crystal display panel which does not show change is display due to temperature change.

Further, the method of varying the applied voltage to the drain electrode is also effective in panels employing the voltage variance driving, but is especially effective in the phase modulation driving in which a display shows a sensitive change with respect to a change in temperature characteristics of the active element in particular. Further, since the driving voltage in tone display takes only two values in the phase modulation driving, there will be no significant loss in step-up or step-down of the voltage, thus driving the liquid crystal display panel with low power consumption.

Figure 55:
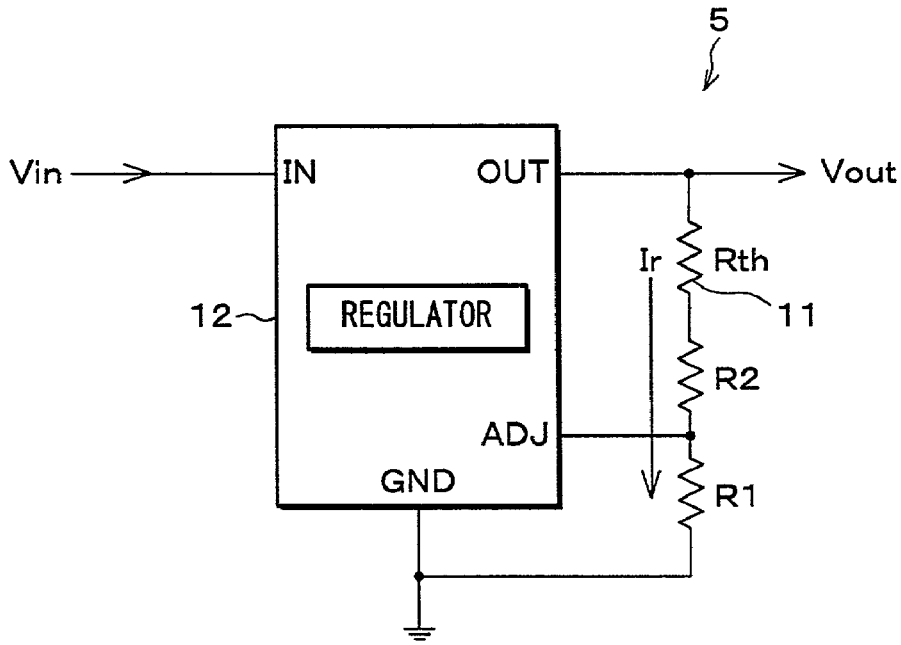
FIG. 55 is a circuit diagram showing an exemplary circuit structure of a voltage varying circuit.

The following will describe a structure of the voltage varying circuit 5. The voltage varying circuit 5 for carrying out temperature compensation includes a thermistor 11 which shows change in resistance value according to temperature, and a regulator 12 for controlling an output voltage according to a proportion of a pre-set resistance value. FIG. 55 is a circuit diagram showing a specific circuit structure of the voltage varying circuit 5.

Here, R1 and R2 are fixed resistance values, Rth is a resistance value of the thermistor 11, Vin is an input voltage value, and Vout is an output voltage value. Rth varies with temperature. Further, Vout is represented by the following equation (1)

$$Vout=\alpha\times(1+(R2+Rth)/R1) \quad (1).$$

Note that, in equation (1), α is a constant. Further, this equation of Vout is drawn from the specifications of a standard regulator. It can be seen from this equation that the voltage varying circuit 5 outputs the output voltage value Vout from the regulator 12 by varying it according to a change in resistance value of the Rth with temperature. That is, temperature compensation is carried out as a result of a temperature dependent change of a signal voltage, which reflects the value of Vout.

The current flown through R1, R2, and Rth is denoted by Ir. Note that, strictly speaking, the currents through R1, R2, Rth, and an adjustor pin ADJ of the regulator 12 should be more correctly denoted by I1, I2, and Iadj, respectively. However, in the low-loss regulator 12 intended for low power consumption driving, the current value of the current Iadj flown from the adjustor pin is only minute (specifically, about several ten nA). Therefore, the following description will be based on the approximated value I1≈I2=Ir.

Considering the foregoing circuit structure, the power consumption by the external resistance values (R1, R2, and Rth), which are provided to output a pre-set voltage poses a problem. The power consumption Pr by the external resistance values is represented by a product of the output voltage value Vout and the current flow Ir. That is, $$Pr=Vout\times Ir \quad (2).$$

Further, since I1≈I2=Ir, the output voltage value Vout can also be represented by $$Vout=Ir\times(R1+R2+Rth) \quad (3).$$

From the equations (3) and (2), the power consumption Pr can be represented by $$Pr=\beta\times(Vout)^2(\beta=1/(R1+R2+Rth)) \quad (4).$$

That is, by decreasing the value of the output voltage value Vout which is outputted from the voltage varying circuit, the power consumption by the external resistance values can be reduced. For example, when the output voltage Vout is reduced in ½, the power consumption Pr is reduced in ¼.

In view of this, the following describes an actual driving circuit including the voltage varying circuit. In general, a high signal voltage such as a scanning voltage is created by stepping up a power voltage supplied to a liquid crystal module by several fold.

Figure 56:
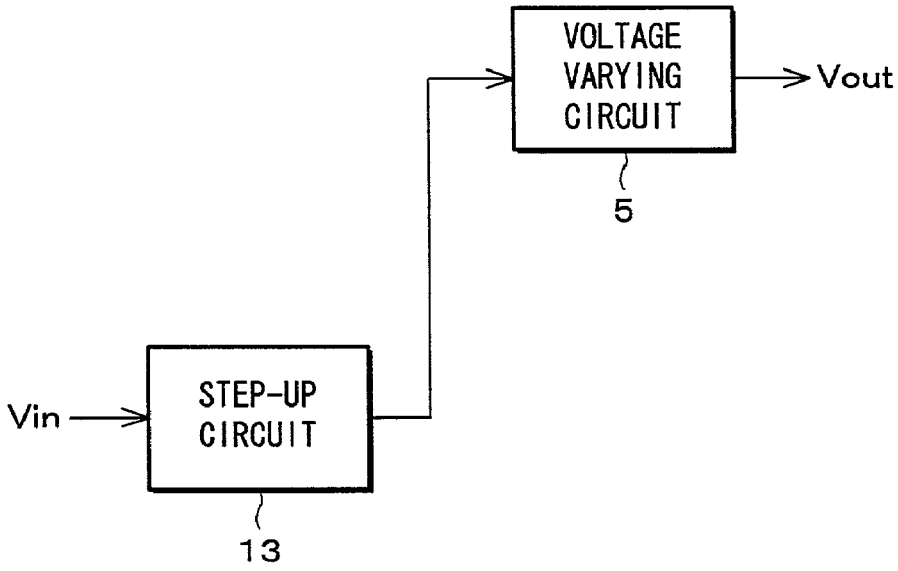
FIG. 56 is a block diagram showing a schematic structure of a conventional driving circuit.

Here, a conventional driving circuit will be explained as an comparative example. FIG. 56 is a block diagram showing a schematic structure of a conventional driving circuit. As shown in the drawing, the conventional driving circuit has a structure wherein an input voltage Vin is first inputted into a step-up circuit 13, and then an output voltage Vout is outputted from a voltage varying circuit 5. That is, in the conventional driving circuit, a signal voltage is subjected to temperature compensation by the voltage varying circuit 5 immediately before it is supplied to the panel. However, in this case, the signal voltage which is subjected to temperature compensation is a high voltage which has been stepped-up by the step-up circuit 13. As a result, the output voltage Vout outputted from the voltage varying circuit 5 becomes high, and therefore the conventional driving circuit of this type has large power consumption by the external resistance values.

Figure 57:
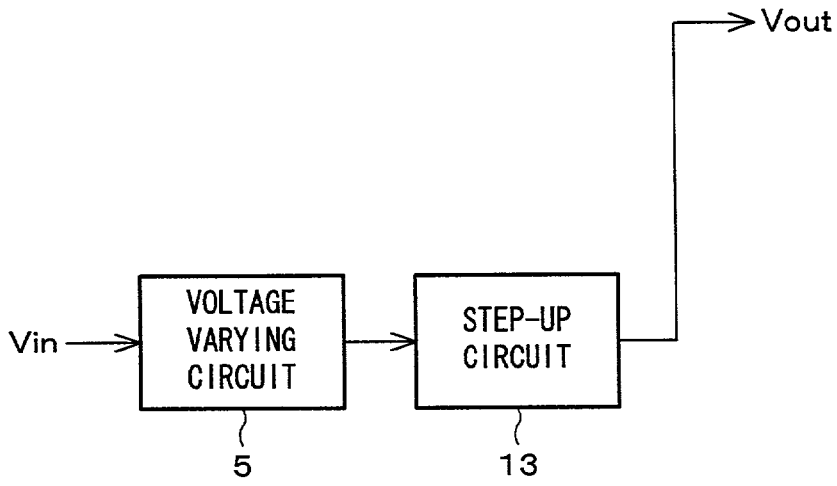
FIG. 57 is a block diagram showing a schematic diagram of a driving circuit in accordance with one embodiment of the present invention.

On the other hand, the driving circuit of the present embodiment has a structure as shown in FIG. 57. That is, the driving circuit has a structure wherein an input voltage Vin is first inputted to the voltage varying circuit 5, and then an output voltage Vout is outputted from the step-up circuit 13. Namely, unlike the conventional structure, in the driving circuit of the present embodiment, the voltage varying circuit 5 applies the temperature compensation with respect to a power voltage (input voltage Vin) before it is stepped up. The voltage thus subjected to temperature compensation is then stepped up by the step-up circuit 13 and supplied to the panel. This allows the voltage value Vout from the voltage varying circuit 5 to be suppressed at low level, thereby suppressing the power consumption by the external resistances in the voltage varying circuit 5 at low level.

Further, because the value of the input voltage Vin can be made lower than that in the conventional circuit structure, an operation voltage range of ICs making up the regulator or other elements in the voltage varying circuit 5 can be set at low level. That is, the voltage varying circuit 5 can be made with low-voltage-resistant ICs, thus realizing the voltage varying circuit 5 for carrying out temperature compensation at lower cost.

Figure 58:
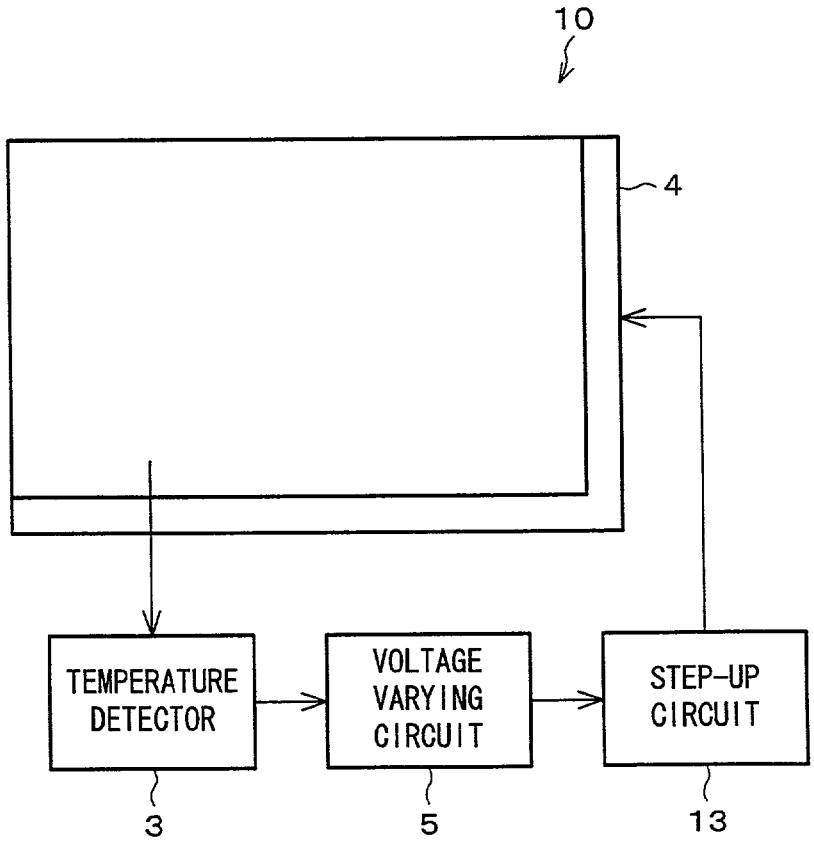
FIG. 58 is an explanatory drawing showing a schematic structure of a liquid crystal display device having the driving circuit of FIG. 57.
Figure 59:
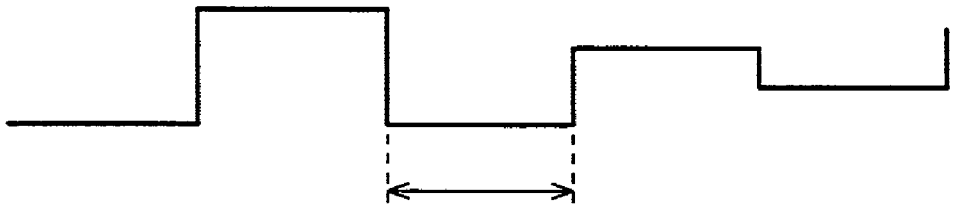
FIG. 59 is an explanatory drawing showing a source signal waveform in a conventional voltage modulation driving method.
Figure 60:
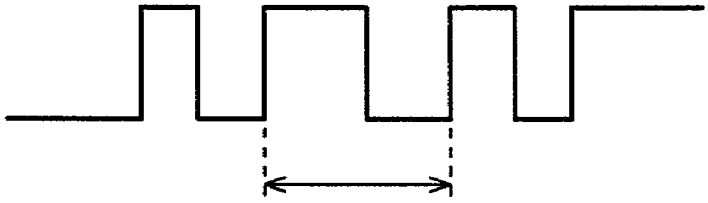
FIG. 60 is an explanatory drawing showing a source signal waveform in a conventional pulse width modulating driving method.

FIG. 58 is an explanatory drawing showing a schematic structure of the liquid crystal display device 10 having the foregoing driving circuit. In this structure, the temperature of the liquid crystal display panel 4 is detected by the temperature detector 3, and the temperature thus detected is transferred to the voltage varying circuit 5. The voltage varying circuit 5 varies the input voltage according to the temperature detected by the temperature detector so as to carry out temperature compensation. The signal which was subjected to temperature compensation is then inputted into the step-up circuit 13, and after being stepped up to a required voltage, inputted into the liquid crystal display panel 4.

Note that, the foregoing structure of the driving circuit is effective not only in the phase modulation driving but also in the voltage modulation driving. Further, the signal subjected to temperature compensation is not just limited to the scanning signal, and is applicable to any signals which require the temperature compensation process and the step-up process, so as to obtain the effect of reducing power consumption.

As described in the foregoing Sixth Embodiment, the liquid crystal display device in accordance with the present invention has an image display panel for displaying an image by switching by a plurality of active elements, and further includes a voltage varying circuit for varying a voltage of a signal for driving the active elements according to temperature change of the image display panel, so as to carry out temperature compensation of the active elements.

Further, the liquid crystal display device in accordance with the present invention may have an arrangement, in addition to the foregoing arrangement, a temperature detector for detecting a temperature change of the liquid crystal display panel.

With this arrangement, by the provision of the temperature detector for detecting a temperature change of the liquid crystal display panel, the temperature of the liquid crystal display panel can be detected constantly, thus carrying out temperature compensation of active elements according to a temperature change of the liquid crystal display panel.

Further, the liquid crystal display device in accordance with the present invention may have an arrangement, in the foregoing arrangement, employing phase modulation driving. In the phase modulation driving, the driving voltage in tone display has two levels, and there is no power loss associated with step-up or step-down, thus driving the liquid crystal display panel at lower power consumption. However, the problem of phase modulation driving is that the display quality is easily changed by a change in ambient temperature of operation.

On the other hand, in the arrangement of the present invention, temperature compensation of the active elements is carried out by varying the voltage of signals for driving the active elements according to a temperature change of the liquid crystal display panel, thus preventing change in display quality due to temperature change also in liquid crystal display devices which employ phase modulation driving.

Further, the liquid crystal display device may have an arrangement, in the foregoing arrangement, wherein the applied voltage of the scanning signal is varied according to a temperature change of the liquid crystal display panel.

With this arrangement, since the applied voltage of the scanning signal is varied according to a temperature change of the liquid crystal display panel, it is possible to realize a liquid crystal display panel which does not show change in display by a change in temperature.

Further, the liquid crystal display device may have an arrangement, in the foregoing arrangement, wherein the applied voltage of the common signal is varied according to a temperature change of the liquid crystal display panel.

With this arrangement, since the applied voltage of the common signal is varied according to a temperature change of the liquid crystal display panel, it is possible to realize a liquid crystal display panel which does not show change in display by a change in temperature. Further, since the applied voltage of the common signal is lower than other voltages such as the voltage applied as the scanning signal, a low voltage can be adopted for the voltage to be varied.

Further, the liquid crystal display device in accordance with the present invention may have an arrangement, in the foregoing arrangement, wherein the applied voltage of the tone signal is varied according to a temperature change of the liquid crystal display panel.

With this arrangement, since the applied voltage of the tone signal is varied according to a temperature change of the liquid crystal display panel, it is possible to realize a liquid crystal display panel which does not show change in display by a change in temperature. Further, since the tone voltage is set for each tone when driving the liquid crystal display device by voltage variance driving, temperature compensation can be carried out utilizing these voltages, without newly creating a voltage for temperature compensation.

Further, the liquid crystal display device in accordance with the present invention may have an arrangement, in the foregoing arrangement, including a step-up circuit for stepping up a signal voltage for driving the active elements, and signal voltage for driving the active elements is stepped up by the step-up circuit after being varied by the voltage varying circuit.

In this arrangement, the signal voltage for driving the active elements is varied by the voltage varying circuit for carrying out temperature compensation of the active elements before being stepped up by the step-up circuit. Thus, compared with the case where the voltage varying circuit carries out temperature compensation with respect to the signal voltage which was stepped up by the step-up circuit, the voltage value inputted to the voltage varying circuit, and the voltage value outputted from the voltage varying circuit can be lowered.

By the lower voltage value of the output from the voltage varying circuit, the power consumption at external resistances of the voltage varying circuit can be suppressed at low level, thus providing a liquid crystal display device with lower power consumption.

Further, by the lower input voltage value of the voltage varying circuit, the operation voltage range of ICs making up elements such as the regulator used in the voltage varying circuit can be set at low level. That is, the voltage varying circuit can be constructed with low-voltage-resistance ICs, thus realizing the voltage varying circuit for temperature compensation further inexpensively.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A method for driving an image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, said method controlling a voltage applied to the pixel electrodes in a conduction period of the pixel switching elements according to a pulse width supplied to the signal lines, wherein the voltage applied to the pixel electrodes is less than a voltage supplied to the signal lines, and wherein the pulse width of a supplied voltage to the signal lines in the conduction period of the pixel switching elements when a positive polarity voltage is applied to the pixel electrodes is different from the pulse width of a supplied voltage to the signal lines in the conduction period of the pixel switching elements when a negative polarity voltage is applied to the pixel electrodes, when the same tone is being displayed.

2. A method for driving an image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, said method controlling a voltage applied to the pixel electrodes in a conduction period of the pixel switching elements according to a pulse width supplied to the signal lines, wherein the voltage applied to the pixel electrodes is less than a voltage supplied to the signal lines, and wherein, with respect to an image display device having the common electrode for applying a common potential to the pixels and having a plurality of scanning lines for driving the pixel switching elements, liquid crystal is displaced according to a potential difference between the common electrode and the pixel electrodes so as to carry out display, and an amplitude of a voltage supplied to the signal lines is equal to an amplitude of a voltage supplied to the common electrode.

3. A method for driving an image display device, said method applying a voltage between a potential of signal lines and a potential of a common electrode when a potential of scanning lines is ON, and displaying tones by modulating a pulse width of a two-value voltage supplied to the signal lines, wherein tones are displayed by shifting phases of waveforms of the signal lines and the scanning lines, and polarities of pixels in a signal line direction are inverted alternately; and wherein a potential difference between the potential of the signal lines and the potential of the common electrode is maximum at an end of one horizontal period.

4. A method for driving an image display device, said method applying a voltage between a potential of signal lines and a potential of a common electrode when a potential of scanning lines is ON, and displaying tones by modulating a pulse width of a two-value voltage supplied to the signal lines, wherein tones are displayed by shifting phases of waveforms of the signal lines and the common electrode, and polarities of pixels in a signal line direction are inverted alternately, and wherein a potential difference between the potential of the signal lines and the potential of the common electrode is maximum at an end of one horizontal period.

5. A method for driving on image display device, said method applying a voltage between a potential of signal lines and a potential of a common electrode when a potential of scanning lines is ON, and displaying tones by modulating a pulse width of a two-value voltage supplied to the signal lines, wherein tones are displayed by shifting phases of waveforms of the signal lines and the scanning lines, and polarities of pixels in a signal line direction are inverted alternately, and wherein a potential difference between the potential of the signal lines and the potential of the common electrode is minimum at an end of one horizontal period.

6. A method for driving an image display device, said method applying a voltage between a potential of signal lines and a potential of a common electrode when a potential of scanning lines is ON, and displaying tones by modulating a pulse width of a two-value voltage supplied to the signal lines, wherein tones are displayed by shifting phases of waveforms of the signal lines and the common electrode, and polarities of pixels in a signal line direction are inverted alternately, and wherein a potential difference between the potential of the signal lines and the potential of the common electrode is minimum at an end of one horizontal period.

7. A method for driving an image display device, said method applying a voltage between a potential of signal lines and a potential of a common electrode when a potential of scanning lines is ON, and displaying tones by modulating a pulse width of a two-value voltage supplied to the signal lines, wherein tones are displayed by shifting phases of waveforms of the signal lines and the scanning lines, and polarities of pixels in a signal line direction are inverted alternately, and wherein:

a phase of the common electrode is constant with respect to a scanning signal, and tones are displayed by shifting phases of waveforms of the signal lines and the scanning lines so that the potential of the signal lines is switched between high level and low level after an elapsed time period which varies depending on the tone when the potential of the scanning lines is ON.

8. A method for driving an image display device, said method applying a voltage between a potential of signal lines and a potential of a common electrode when a potential of scanning lines is ON, and displaying tones by modulating a pulse width of a two-value voltage supplied to the signal lines, wherein tones are displayed by shifting phases of waveforms of the signal lines and the common electrode, and polarities of pixels in a signal line direction are inverted alternately, wherein the waveform of the common electrode is off-phase by a certain degree with respect to the waveform of the scanning lines, and wherein tones are displayed by shifting phases of waveforms of the signal lines and the common electrode so that the potential of the signal lines is switched between high level and low level after an elapsed time period which varies depending on the tone when the potential of the scanning lines is ON.

9. A driving device of an image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, said driving device applying a voltage between a potential of the signal lines and a potential of the common electrode when a potential of scanning lines is ON, and displaying tones by modulating a pulse width of a two-value voltage supplied to the signal lines, wherein said driving device includes a signal line driving section for supplying a signal, which is created by shifting a phase of a voltage waveform whose polarity is inverted per one horizontal period, according to tone data of the display image, with respect to a phase of a voltage waveform of the scanning lines, to the signal lines, and wherein:

a phase of a waveform of the common electrode has a constant phase difference with respect to a phase of a waveform of the scanning line, and the signal line driving section supplies a signal, which is created by shifting a phase of a voltage waveform whose polarity is inverted per one horizontal period so that the potential of the signal lines is switched between high level and low level after an elapsed time period which varies depending on the tone when the potential of the scanning lines is ON, with respect to a phase of a voltage waveform of the scanning lines, to the signal lines.

10. An image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, said image display device applying a voltage between a potential of the signal lines and a potential of the common electrode when a potential of scanning lines is ON, and displaying tones by modulating a pulse width of a two-value voltage supplied to the signal lines, wherein said image display device includes a signal line driving section for supplying a signal, which is created by shifting a phase of a voltage waveform whose polarity is inverted per one horizontal period, according to tone data of the display image, with respect to a phase of a voltage waveform of the scanning lines, to the signal lines, and wherein:

a phase of a waveform of the common electrode has a constant phase difference with respect to a phase of a waveform of the scanning line, and the signal line driving section supplies a signal, which is created by shifting a phase of a voltage waveform whose polarity is inverted per one horizontal period so that the potential of the signal lines is switched between high level and low level after an elapsed time period which varies depending on the tone when the potential of the scanning lines is ON, with respect to a phase of a voltage waveform of the scanning lines, to the signal lines.

11. A driving device of an image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, said driving device applying a voltage between a potential of the signal lines and a potential of the common electrode when a potential of scanning lines is ON, and displaying tones by modulating a pulse width of a two-value voltage supplied to the signal lines, wherein said driving device includes a signal line driving section for supplying a signal, which is created by shifting a phase of a voltage waveform whose polarity is inverted per one horizontal period, according to tone data of the display image, with respect to a phase of a voltage waveform of the common electrode, to the signal lines, and wherein:

a phase of a waveform of the common electrode has a constant phase difference with respect to a phase of a waveform of the scanning line, and the signal line driving section supplies a signal, which is created by shifting a phase of a voltage waveform whose polarity is inverted per one horizontal period so that the potential of the signal lines is switched between high level and low level after an elapsed time period which varies depending on the tone when the potential of the scanning lines is ON, with respect to a phase of a voltage waveform of the common electrode, to the signal lines.

12. An image display device which includes a plurality of pixel electrodes which are formed on a substrate, pixel switching elements which are individually connected to the pixel electrodes, a plurality of signal lines for applying a data signal according to a display image to the pixel electrodes, and a common electrode for applying a common potential to pixels, said image display device applying a voltage between a potential of the signal lines and a potential of the common electrode when a potential of scanning lines is ON, and displaying tones by modulating a pulse width of a two-value voltage supplied to the signal lines, wherein said image display device includes a signal line driving section for supplying a signal, which is created by shifting a phase of a voltage waveform whose polarity is inverted per one horizontal period, according to tone data of the display image, with respect to a phase of a voltage waveform of the common electrode, to the signal lines, and wherein:

a phase of a waveform of the common electrode has a constant phase difference with respect to a phase or a wave form of the scanning line, and the signal line driving section supplies a signal, which is created by shifting a phase or a voltage waveform whose polarity is inverted per one horizontal period so that the potential of the signal lines is switched between high level and low level after an elapsed time period which varies depending on the tone when the potential of the scanning lines is ON, with respect to a phase of a voltage waveform of the common electrode, to the signal lines.

* * * * *